US007864058B2

(12) United States Patent
Kondo et al.

(10) Patent No.: US 7,864,058 B2
(45) Date of Patent: Jan. 4, 2011

(54) DANGER DETERMINING DEVICE, METHOD, DANGER NOTIFYING DEVICE, AND PROGRAM FOR DETERMINING DANGER BASED ON IDENTIFICATION INFORMATION OF A PERSON IN A WATCHED ENVIRONMENT AND IDENTIFICATION INFORMATION OF AN ARTICLE IN THE WATCHED ENVIRONMENT

(75) Inventors: Kenji Kondo, Kyoto (JP); Tomonobu Naruoka, Kyoto (JP)

(73) Assignee: Panasonic Corporation, Osaka (JP)

( * ) Notice: Subject to any disclaimer, the term of this patent is extended or adjusted under 35 U.S.C. 154(b) by 332 days.

(21) Appl. No.: 12/160,186

(22) PCT Filed: Aug. 31, 2007

(86) PCT No.: PCT/JP2007/066978

§ 371 (c)(1),
(2), (4) Date: Jul. 7, 2008

(87) PCT Pub. No.: WO2008/029724

PCT Pub. Date: Mar. 13, 2008

(65) Prior Publication Data

US 2009/0021381 A1 Jan. 22, 2009

(30) Foreign Application Priority Data

Sep. 4, 2006 (JP) ..... 2006-238421

(51) Int. Cl.
*G08B 23/00* (2006.01)

(52) U.S. Cl. ..... 340/573.1; 340/539.13; 340/539.15

(58) Field of Classification Search ..... 340/572.1, 340/573.1, 10.1, 539.11, 539.13, 539.15
See application file for complete search history.

(56) References Cited

U.S. PATENT DOCUMENTS 6,972,677 B2 * 12/2005 Coulthard ..... 340/531

(Continued)

FOREIGN PATENT DOCUMENTS

JP 7-49952 2/1995

(Continued)

OTHER PUBLICATIONS

International Search Report issued Nov. 27, 2007 in the International (PCT) Application No. PCT/JP2007/066978.

(Continued)

*Primary Examiner*—Jeffery Hofsass
(74) *Attorney, Agent, or Firm*—Wenderoth, Lind & Ponack, L.L.P.

(57) ABSTRACT

A sensing history database for storing ID and position information of an article detected by an article detecting unit and ID and position information of a person detected by a person detecting unit, a dangerous article database in which an article having a possibility of posing danger in an environment to be watched over is defined for each individual, an accessible location database for storing accessible locations in the environment for each individual, an article-leaving-operation determining unit for determining that the person has left the article from the position information of the article and the position information of the person stored in the sensing history database, and a left-article danger degree determining unit for determining as dangerous when determined that combination of the ID of the person and the ID of the left article in the environment is dangerous from information defined in the dangerous article database and determined that the person present in the environment can access the position of the left article in the article-leaving-operation determining unit.

10 Claims, 35 Drawing Sheets

U.S. PATENT DOCUMENTS

| | | | | |
|---|---|---|---|---|
| 7,046,139 | B2 * | 5/2006 | Kuhn et al. | 340/539.15 |
| 2007/0075411 | A1 | 4/2007 | Tanigawa et al. | |

FOREIGN PATENT DOCUMENTS

| | | |
|---|---|---|
| JP | 2001-101547 | 4/2001 |
| JP | 2002-42272 | 2/2002 |
| JP | 2002-74560 | 3/2002 |
| JP | 2002-288756 | 10/2002 |
| JP | 2004-78304 | 3/2004 |
| JP | 2004-96501 | 3/2004 |
| JP | 2004-234061 | 8/2004 |
| JP | 2005-78222 | 3/2005 |
| JP | 3811496 | 6/2006 |

OTHER PUBLICATIONS

International Preliminary Report on Patentability issued Mar. 26, 2009 in the International (PCT) Application No. PCT/JP2007/066978.

* cited by examiner

| PERSON ID | ARTICLE ID |
|---|---|
| 6 | 0008 |

Fig.6

| TIME | PERSON ID | | | | | | | | | | ARTICLE ID | | | | | | |
|---|---|---|---|---|---|---|---|---|---|---|---|---|---|---|---|---|---|
| | 1 | | | 2 | | | 3 | | | … | 0001 | | | 0002 | | | … |
| | X | Y | Z | X | Y | Z | X | Y | Z | | X | Y | Z | X | Y | Z | |
| $t_1$ | 577 | 230 | 142 | 208 | 304 | 123 | — | — | — | … | 442 | 506 | 0 | 550 | 320 | 0 | … |
| $t_2$ | 585 | 305 | 138 | 246 | 328 | 122 | — | — | — | … | 442 | 506 | 0 | 550 | 320 | 0 | … |
| $t_3$ | 578 | 319 | 141 | 236 | 466 | 124 | — | — | — | … | 442 | 506 | 0 | 550 | 320 | 0 | … |
| $t_4$ | 569 | 320 | 143 | 241 | 513 | 122 | — | — | — | … | 442 | 506 | 0 | 550 | 320 | 0 | … |
| $t_5$ | 541 | 326 | 139 | 257 | 493 | 121 | — | — | — | … | 442 | 506 | 0 | 550 | 320 | 0 | … |
| $t_6$ | 498 | 339 | 140 | 258 | 421 | 124 | — | — | — | … | 442 | 506 | 0 | 496 | 345 | 70 | … |
| $t_7$ | 359 | 307 | 142 | 255 | 388 | 123 | — | — | — | … | 442 | 506 | 0 | 351 | 322 | 75 | … |
| $t_8$ | 292 | 276 | 141 | 261 | 341 | 119 | — | — | — | … | 442 | 506 | 0 | 288 | 295 | 76 | … |
| $t_9$ | 272 | 257 | 139 | 307 | 311 | 118 | — | — | — | … | 442 | 506 | 0 | 269 | 244 | 68 | … |
| $t_{10}$ | 245 | 280 | 137 | 365 | 306 | 122 | — | — | — | … | 442 | 506 | 0 | 255 | 284 | 66 | … |
| $t_{11}$ | 235 | 316 | 135 | 442 | 322 | 124 | — | — | — | … | 442 | 506 | 0 | 242 | 320 | 72 | … |
| $t_{12}$ | 169 | 297 | 140 | 458 | 342 | 122 | — | — | — | … | 442 | 506 | 0 | 174 | 305 | 73 | … |
| $t_{13}$ | 131 | 294 | 141 | 469 | 389 | 122 | — | — | — | … | 442 | 506 | 0 | 143 | 299 | 69 | … |
| $t_{14}$ | 124 | 294 | 142 | 459 | 446 | 121 | — | — | — | … | 442 | 506 | 0 | 131 | 298 | 67 | … |
| $t_{15}$ | 121 | 295 | 139 | 454 | 476 | 119 | — | — | — | … | 442 | 506 | 0 | 125 | 304 | 71 | … |
| $t_{16}$ | 121 | 293 | 137 | 453 | 503 | 118 | — | — | — | … | 442 | 506 | 0 | 128 | 321 | 72 | … |
| $t_{17}$ | 120 | 294 | 140 | 456 | 503 | 119 | — | — | — | … | 442 | 506 | 0 | 127 | 311 | 77 | … |
| $t_{18}$ | 121 | 294 | 141 | 450 | 503 | 122 | — | — | — | … | 442 | 506 | 0 | 128 | 323 | 71 | … |
| $t_{19}$ | 122 | 294 | 140 | 448 | 503 | 120 | — | — | — | … | 442 | 506 | 0 | 127 | 311 | 66 | … |
| $t_{20}$ | 144 | 294 | 139 | 444 | 506 | 121 | — | — | — | … | 442 | 506 | 0 | 133 | 307 | 65 | … |
| … | … | … | … | … | … | … | … | … | … | … | … | … | … | … | … | … | … |

| PERSON ID | PERSON | ARTICLE HANDLING THRESHOLD VALUE |
|---|---|---|
| 1 | GRANDFATHER | 70cm |
| 2 | GRANDMOTHER | 70cm |
| 3 | FATHER | 70cm |
| 4 | MOTHER | 70cm |
| 5 | CHILD 1 (SIX YEARS OLD) | 50cm |
| 6 | CHILD 2 (TWO YEARS OLD) | 30cm |

Fig.9

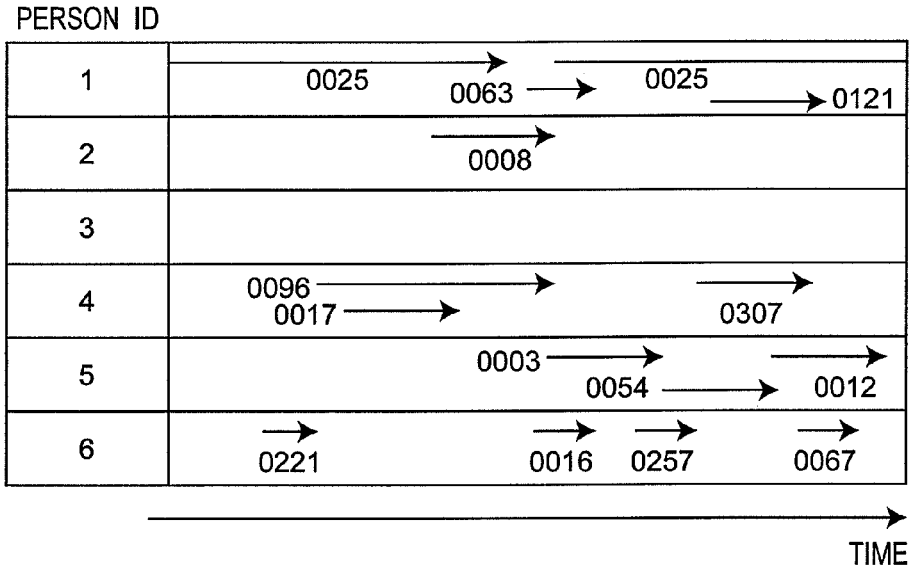

Fig.10

| PERSON ID | PERSON | ARTICLE |
|---|---|---|
| 1 | GRANDFATHER | |
| 2 | GRANDMOTHER | |
| 3 | FATHER | |
| 4 | MOTHER | |
| 5 | CHILD 1 (SIX YEARS OLD) | 0307(KNIFE), 0252(CUTTER KNIFE) |
| 6 | CHILD 2 (TWO YEARS OLD) | 0025(CIGARETTE), 0008(MEDICINE), 0252(CUTTER KNIFE), 0307(KNIFE), 0388(SCISSORS) |

Fig.11A

| PERSON ID | PERSON | ACCESSIBLE LOCATION |
|---|---|---|
| 1 | GRANDFATHER | ENTIRE REGION |
| 2 | GRANDMOTHER | ENTIRE REGION |
| 3 | FATHER | ENTIRE REGION |
| 4 | MOTHER | ENTIRE REGION |
| 5 | CHILD 1 (SIX YEARS OLD) | HEIGHT FROM FOOT OF LESS THAN 140 cm |
| 6 | CHILD 2 (TWO YEARS OLD) | HEIGHT FROM FOOT OF LESS THAN 70 cm |

*Fig.11B*

| LOCATION | | TWO-DIMENSIONAL POSITION | HEIGHT | ACCESSIBLE FLAG PERSON ID | | | | | |
|---|---|---|---|---|---|---|---|---|---|
| | | | | 1 | 2 | 3 | 4 | 5 | 6 |
| DT | | $(x_1,y_1)-(x_2,y_2)$ | 75cm | | | | | ○ | |
| LT | | $(x_3,y_3)-(x_4,y_4)$ | 50cm | | | | | ○ | ○ |
| CB | ON TOP PLATE | $(x_5,y_5)-(x_6,y_6)$ | 85cm | | | | | ○ | |
| | UPPER SHELF | $(x_7,y_7)-(x_8,y_8)$ | 45cm | | | | | ○ | ○ |
| | LOWER SHELF | $(x_9,y_9)-(x_{10},y_{10})$ | 5cm | | | | | ○ | ○ |
| BS | UPPER MOST SHELF | $(x_{11},y_{11})-(x_{12},y_{12})$ | 150cm | | | | | | |
| | FOURTH SHELF | $(x_{13},y_{13})-(x_{14},y_{14})$ | 120cm | ○ | ○ | ○ | ○ | ○ | |
| | THIRD SHELF | $(x_{15},y_{15})-(x_{16},y_{16})$ | 90cm | | | | | ○ | |
| | SECOND SHELF | $(x_{17},y_{17})-(x_{18},y_{18})$ | 60cm | | | | | ○ | ○ |
| | BOTTOMMOST SHELF | $(x_{19},y_{19})-(x_{20},y_{20})$ | 30cm | | | | | ○ | ○ |
| SF1 | | $(x_{21},y_{21})-(x_{22},y_{22})$ | 45cm | | | | | ○ | ○ |
| SF2 | | $(x_{23},y_{23})-(x_{24},y_{24})$ | 45cm | | | | | ○ | ○ |
| FL | | $(x_{25},y_{25})-(x_{26},y_{26})$ | 0cm | | | | | ○ | ○ |
| CH1 | | $(x_{27},y_{27})-(x_{28},y_{28})$ | 48cm | | | | | ○ | ○ |
| ... | | ... | ... | ... | | | | | |

*Fig.11C*

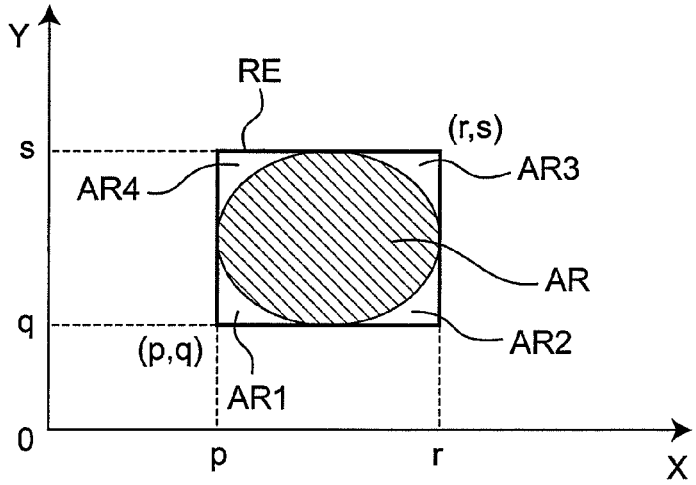

| ARTICLE ID | ARTICLE-HANDLING FLAG | PERSON ID OF HANDLING-PERSON |
|---|---|---|
| 0001 | OFF | — |
| 0002 | OFF | — |
| 0003 | ON | 2 |
| 0004 | OFF | — |
| 0005 | OFF | — |
| 0006 | OFF | — |
| 0007 | ON | 1 |
| ... | ... | ... |

| ARTICLE ID | FOOTSTEP FLAG | HEIGHT AS FOOTSTEP (cm) | DISTANCE THRESHOLD VALUE (cm) |
|---|---|---|---|
| 0001 | OFF | — | — |
| 0002 | OFF | — | — |
| 0003 | OFF | — | — |
| 0004 | OFF | — | — |
| 0005 | OFF | — | — |
| 0006 | ON | 30 | 50 |
| 0007 | OFF | — | — |
| 0008 | OFF | — | — |
| 0009 | ON | 40 | 200 |
| 0010 | OFF | — | — |
| ... | ... | ... | ... |

Fig.25
| PERSON ID | PERSON | ACCESSIBLE LOCATION |
|---|---|---|
| 1 | GRANDFATHER | ENTIRE REGION |
| 2 | GRANDMOTHER | ENTIRE REGION |
| 3 | FATHER | ENTIRE REGION |
| 4 | MOTHER | ENTIRE REGION |
| 5 | CHILD 1 (SIX YEARS OLD) | HEIGHT FROM FOOT OF LESS THAN 140 cm |
| 6 | CHILD 2 (TWO YEARS OLD) | HEIGHT FROM FOOT OF LESS THAN 80 cm |
Fig.26A
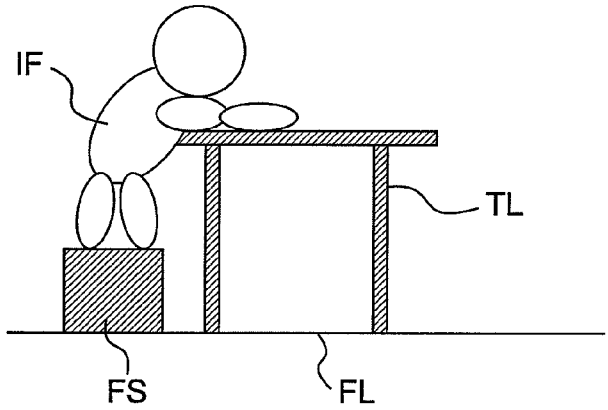
Fig.26B
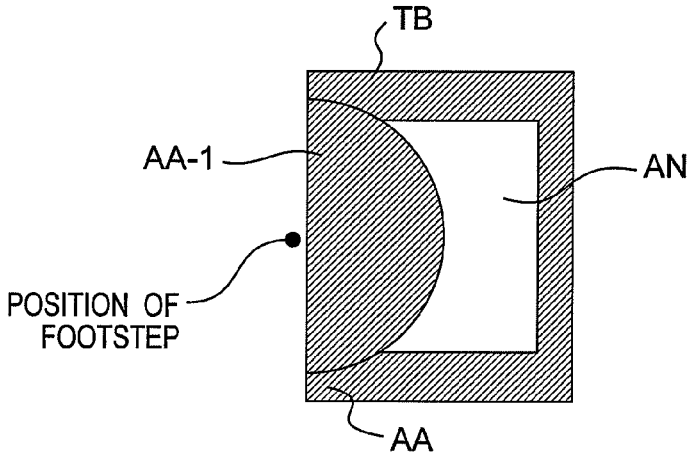

*Fig.32*

| PERSON ID | PERSON | MOVEMENT SPEED (m/sec) |
|---|---|---|
| 1 | GRANDFATHER | $V_1$ |
| 2 | GRANDMOTHER | $V_2$ |
| 3 | FATHER | $V_3$ |
| 4 | MOTHER | $V_4$ |
| 5 | CHILD 1 (SIX YEARS OLD) | $V_5$ |
| 6 | CHILD 2 (TWO YEARS OLD) | $V_6$ |

DANGER DETERMINING DEVICE, METHOD, DANGER NOTIFYING DEVICE, AND PROGRAM FOR DETERMINING DANGER BASED ON IDENTIFICATION INFORMATION OF A PERSON IN A WATCHED ENVIRONMENT AND IDENTIFICATION INFORMATION OF AN ARTICLE IN THE WATCHED ENVIRONMENT

TECHNICAL FIELD

The present invention mainly relates to a technique of determining danger on youngsters such as infants and children in a household, in particular, to a danger determining device, a danger determining method, a danger notifying device, and a danger determining program for determining whether an article left by an adult poses danger.

BACKGROUND OF THE INVENTION

According to the vital statistics of 2002 by Health, Labor and Welfare Ministry, reports have been made on the cause of death and the mortality by age class of 2003. Among them, the rank order of cause of death is substantially constant between 1997 and 2002, where it is reported that casualty is the number one cause of death for one to four year olds and for five to nine year olds, and the number four cause of death for children under one year old. Casualty includes car accidents, but it is reported that domestic accidents occupy 73% of the casualty for children under one year old, and 44% for one to four year olds, which outweighs the percentage of car accidents.

Techniques of patent document 1 and patent document 2 have been proposed to prevent such domestic accidents.

In patent document 1, a transmitter with sensor function is attached to a little child, so that the state of the little child is monitored from the position of the little child detected by the transmitter with sensor function, or the sound of crying, respiratory rate, body temperature, and the like of the little child detected with various sensors arranged in the transmitter with sensor function, and danger is detected to determine the degree of danger. A response system for responding to danger according to the degree of danger is further arranged. The response system is operated or a notification is made to the guardian of the little child according to the degree of danger, thereby avoiding the danger to the little child.

In patent document 2, a database for storing a dangerous area for each individual, a person position detecting means for detecting the position of a person, an individual identification means for identifying a predetermined individual, and an issuing means for issuing an alarm are arranged, where an alarm is issued from the issuing means when the predetermined individual identified by the individual identification means and the person whose position is detected by the person position detecting means are identified, and the identified predetermined individual enters a corresponding dangerous area stored in the database. Since the dangerous location differs between the elderly and infants, a danger alarm corresponding to the person can be issued according to the above configuration.

In patent document 3, a target person who has entered a monitoring region is authenticated, and if detecting that the authenticated target person approached a risk factor of the monitoring region, support information enabling the guardian of the target person to take action to move the target person away from the risk factor is provided. The little child care support information is provided to the guardian if the target person is an infant who cannot be disciplined, whereas the little child is "disciplined" to alleviate the load of little child care on the guardian if the target person is a little child who has learning ability.

[Patent document 1] Japanese Unexamined Patent Publication No. 2002-74560

[Patent document 2] Japanese Unexamined Patent Publication No. 2004-234061

[Patent document 3] Japanese Unexamined Patent Publication No. 2004-78304

SUMMARY OF THE INVENTION

The report "National Consumer Information Center 1996: special research, research report on domestic accident" where accident case examples are collected is known. The accident information of 56,040 cases was collected over six years and five months from August, 1992 to December, 1998 by the National Consumer Information Center by building a mechanism for collecting consultation information related to goods, services, and facilities from cooperating hospitals at twenty locations across the country. This report reveals the fact that 28,464 cases (51%) are domestic accidents, and the number of accidents by goods/facilities related to the relevant domestic accident. In the number of accidents caused by goods/facilities related to the accident, accidents caused by the dangerousness of the location itself such as stairs and bathroom occupy the top side, but accidents caused by articles such as kitchen knives, cigarettes, china bowls, drugs and medicines, and the like occupy about 20% of the total.

In patent document 1, accidents caused by location can be prevented since the position of the little child can be acquired by attaching the transmitter with sensor function to the little child. However, accidents caused by articles are known only after the accident occurred from the sound of crying, respiratory rate, or body temperature of the little child.

In patent document 2, the dangerous area is set by individuals, but such area is fixed, and danger determination carried out by detecting the approach of the target person to be watched over to the fixed location is disclosed. However, if a movable dangerous article exists, the danger determination carried out by detecting the approach to such article cannot be made.

In patent document 3, the support information is provided for the first time when approach of an infant or a little child to the "risk factor" is detected. In other words, the idea of providing information to remove the "risk factor" before approach is not disclosed. The "discipline" information is provided to the little child, but there is a possibility an accident might occur if the little child does not follow such "discipline" information. Countermeasures such as raising the railing of the terrace to eliminate danger thereby physically preventing danger are also disclosed, but it is not realistic in a general household to introduce such device for all the "risk factors".

In view of solving such issues, it is an object of the present invention to provide a danger determining device, a danger determining method, a danger notifying device, and a danger determining program for determining the risk of an accident mostly caused by articles, and preventing the accident in advance.

In order to solve the above issues, the present invention is configured as below.

According to a first aspect of the present invention, there is provided a danger determining device characterized by comprising:

an article detecting means for detecting an ID and position information of an article in an environment to be watched over;

a person detecting means for detecting an ID and position information of a person in the environment to be watched over;

a sensing history database for storing the ID and the position information of the article detected by the article detecting means and the ID and the position information of the person detected by the person detecting means along with respective times;

a dangerous article database for storing dangerous combination information in which an ID of a dangerous article, which is an article having a possibility of posing danger, of the articles in the environment to be watched over and an ID of a person, who may be present in the environment to be watched over, are associated;

an accessible location database for storing information on accessible locations in the environment to be watched over for every ID of a person who may be present in the environment to be watched over;

an article-leaving-operation determining means for determining that the person has left the article when the position of the article and the position of the person are apart by more than a predetermined distance from the ID, the position information, and the time of the article as well as the ID, the position information, and the time of the person stored in the sensing history database; and a left-article danger degree determining means for performing a first determination of determining whether a combination of the ID of the person in the environment to be watched over and the ID of the article determined as being left by the article-leaving-operation determining means stored in the sensing history database matches the dangerous combination information of the ID of the dangerous article and the ID of the person stored in the dangerous article database; a second determination of determining whether or not the person in the environment to be watched over is capable of accessing the position of the article determined as being left by the article-leaving-operation determining means, from the ID and the position information of the person in the environment to be watched over and the ID and the position information of the article determined as being left by the article-leaving-operation determining means, which are stored in the sensing history database, and the information on the accessible location of the person stored in the accessible location database; and determining that the article determined as being left by the article-leaving-operation determining means poses danger by being left when determined as matching in the first determination and determined as accessible in the second determination in the left-article danger degree determining means.

According to a fifth aspect of the present invention, there is provided a danger notifying device characterized by comprising:

the danger determining device according to the above-mentioned aspect; and a notifying means for issuing an alarm when determined as dangerous by the left-article danger degree determining means.

According to a seventh aspect of the present invention, there is provided a danger determining method for determining danger using, a sensing history database for storing an ID and position information of an article in an environment to be watched over, and an ID and position information of a person in the environment to be watched over, along with respective times;

a dangerous article database for storing dangerous combination information in which an ID of a dangerous article, which is an article having a possibility of posing danger, of the articles in the environment to be watched over and an ID of a person, who may be present in the environment to be watched over, are associated; and an accessible location database for storing information on accessible locations in the environment to be watched over for every ID of a person who may be present in the environment to be watched over;

the method characterized by comprising:

an article-leaving-operation determination step for determining that the person has left the article when the position of the article and the position of the person are apart by more than a predetermined distance from the ID, the position information, and the time of the article as well as the ID, the position information, and the time of the person stored in the sensing history database; and a left-article danger degree determination step for determining whether or not the article determined as being left in the article-leaving-operation determination step has a possibility of posing danger by being left; wherein in the left-article danger degree determination step, is performed a first determination of determining whether a combination of the ID of the person in the environment to be watched over and the ID of the article determined as being left by the article-leaving-operation determination step stored in the sensing history database matches the dangerous combination information of the ID of the dangerous article and the ID of the person stored in the dangerous article database; is performed a second determination of determining whether or not the person in the environment to be watched over is capable of accessing the position of the article determined as being left by the article-leaving-operation determination step from the ID and the position information of the person in the environment to be watched over and the ID and the position information of the article determined as being left by the article-leaving-operation determination step stored in the sensing history database, and information on the accessible location of the person stored in the accessible location database; and is determined that the article determined as being left by the article-leaving-operation determination step poses danger by being left when determined as matching in the first determination and determined as accessible in the second determination in the left-article danger degree determining step.

According to a ninth aspect of the present invention, there is provided a danger determining program for causing a computer to execute:

an article-leaving-operation determination step for determining that a person has left an article when a position of the article and a position of the person are apart by more than a predetermined distance from the ID, position information, and time of the article as well as an ID, position information, and time of the person stored in a sensing history database; and a left-article danger degree determination step for determining whether or not the article determined as being left in the article-leaving-operation determination step has a possibility of posing danger by being left, while using a sensing history database for storing the ID and the position information of the article in an environment to be watched over, and the ID and the position information of the person in the environment to be watched over, along with respective times;

a dangerous article database for storing dangerous combination information in which an ID of a dangerous article, which is an article having a possibility of posing danger, of the articles in the environment to be watched over and an ID of a person, who may be present in the environment to be watched over, are associated; and an accessible location database for storing information on accessible locations in the environment to be watched over for every ID of persons who may be present in the environment to be watched over, characterized in that in the left-article danger degree determination step, is performed a first determination of determining whether a combination of the ID of the person in the environment to be watched over and the ID of the article determined as being left by the article-leaving-operation determination step stored in the sensing history database matches the dangerous combination information of the ID of the dangerous article and the ID of the person stored in the dangerous article database; is performed a second determination of determining whether or not the person in the environment to be watched over is capable of accessing the position of the article determined as being left by the article-leaving-operation determination step from the ID and the position information of the person in the environment to be watched over and the ID and the position information of the article determined as being left by the article-leaving-operation determination step stored in the sensing history database, and information on the accessible location of the person stored in the accessible location database; and is determined that the article determined as being left by the article-leaving-operation determination step poses danger by being left when determined as matching in the first determination and determined as accessible in the second determination in the left-article danger degree determining step.

According to the present invention, if determined that the combination of the ID of the person present in the environment to be watched over detected by the person detecting means and the article ID determined as being left by the article-leaving-operation determining means is dangerous from the information stored in the dangerous article database, and that the person present in the environment to be watched over can access the position of the article determined as being left in the article-leaving-operation determining means or step from the information stored in the accessible location database, determination is made that the article determined as being left in the article-leaving-operation determining means or step poses danger by being left, thereby preventing in advance youngsters such as infants and children from causing accidents with such article.

At the same time, even if the left article is a dangerous article, determination is avoided from being made as dangerous when left at places outside the reach of the hands of the target youngster such as infant or child, and even if the article is left at places within the reach of the hands of the target youngster such as infant or child, determination is avoided from being made as dangerous when an article that is not a dangerous article to the target youngster such as infant or child is left. Therefore, when making a notification to the guardian or the person who has left the article after performing the danger determination, the trouble of being notified when it is not truly dangerous can be reduced.

BRIEF DESCRIPTION OF THE DRAWINGS

These and other aspects and features of the present invention will become clear from the following description taken in conjunction with the preferred embodiments thereof with reference to the accompanying drawings, in which:

FIG. 6 is a view showing in a table format one example of information stored in a sensing history database according to the first embodiment of the present invention;

FIG. 9 is a view showing a determination result of handling of article with respect to six people in the article-leaving-operation determining means according to the first embodiment of the present invention;

FIG. 10 is a view showing information stored in a dangerous article database;

FIG. 11A is a view showing one example of information stored in the accessible location database;

FIG. 11B is a view showing another example of information stored in the accessible location database;

FIG. 11C is a view describing a representation method of a two-dimensional position of FIG. 11B;

FIG. 25 is a view showing one example of information after information of FIG. 11A stored in the accessible location database is updated by the accessible location updating means;

FIG. 26A is an explanatory view showing a state in which a little child uses a footstep;

FIG. 26B is a plan view of a table top plate showing an accessible area of the table top plate when the little child uses the footstep in FIG. 26A;

FIG. 32 is a view of an example showing a relationship between a person ID, a person, and a movement speed stored in the database according to the first embodiment of the present invention.

DETAILED DESCRIPTION OF THE INVENTION

Figure 1A:
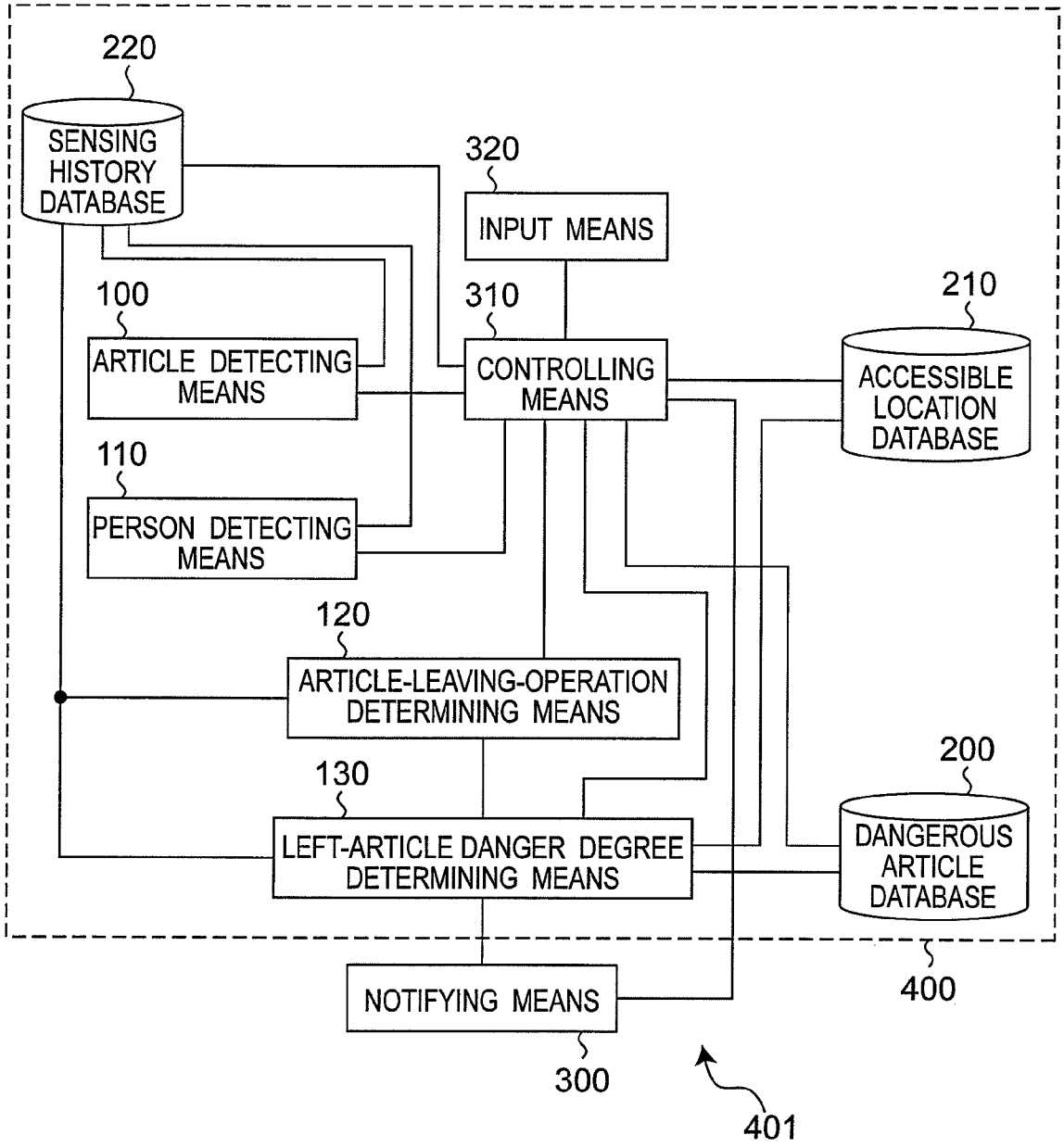
FIG. 1A is a block diagram showing a configuration example of a danger determining device and a danger notifying device according to a first embodiment of the present invention.

Embodiments of the present invention will now be described in detail based on the drawings. Before the description of the present invention proceeds, it is to be noted that like parts are designated by like reference numerals throughout the accompanying drawings.

Various modes of the present invention will be described before describing in detail the embodiments of the present invention with reference to the drawings.

According to a first aspect of the present invention, there is provided a danger determining device characterized by comprising:

an article detecting means for detecting an ID and position information of an article in an environment to be watched over;

a person detecting means for detecting an ID and position information of a person in the environment to be watched over;

a sensing history database for storing the ID and the position information of the article detected by the article detecting means and the ID and the position information of the person detected by the person detecting means along with respective times;

a dangerous article database for storing dangerous combination information in which an ID of a dangerous article, which is an article having a possibility of posing danger, of the articles in the environment to be watched over and an ID of a person, who may be present in the environment to be watched over, are associated;

an accessible location database for storing information on accessible locations in the environment to be watched over for every ID of a person who may be present in the environment to be watched over;

an article-leaving-operation determining means for determining that the person has left the article when the position of the article and the position of the person are apart by more than a predetermined distance from the ID, the position information, and the time of the article as well as the ID, the position information, and the time of the person stored in the sensing history database; and a left-article danger degree determining means for performing a first determination of determining whether a combination of the ID of the person in the environment to be watched over and the ID of the article determined as being left by the article-leaving-operation determining means stored in the sensing history database matches the dangerous combination information of the ID of the dangerous article and the ID of the person stored in the dangerous article database; a second determination of determining whether or not the person in the environment to be watched over is capable of accessing the position of the article determined as being left by the article-leaving-operation determining means, from the ID and the position information of the person in the environment to be watched over and the ID and the position information of the article determined as being left by the article-leaving-operation determining means, which are stored in the sensing history database, and the information on the accessible location of the person stored in the accessible location database; and determining that the article determined as being left by the article-leaving-operation determining means poses danger by being left when determined as matching in the first determination and determined as accessible in the second determination in the left-article danger degree determining means.

According to a second aspect of the present invention, there is provided the danger determining device according to the first aspect, characterized in that the left-article danger degree determining means further determines, in the first determination, whether or not, when the ID of the article determined as being left by the article-leaving-operation determining means is the ID of the dangerous article, the person matching the dangerous combination information in combination with the ID of the dangerous article but has the ID of the person related to the dangerous combination information and is not present in the environment to be watched over is detected by the person detecting means; and after it is determined that the person who has the ID of the person related to the dangerous combination information and is not present in the environment to be watched over is detected by the person detecting means, when the person determined as being present in the environment to be watched over is able to access the position of the article determined as being left by the article-leaving-operation determining means in the second determination based on the ID, the position information, and the time of the article as well as the ID and the position information of the person, and the ID and the position information of the article determined as being left by the article-leaving-operation determining means stored in the sensing history database, and the information on the accessible location of the person stored in the accessible location database, the left-article danger degree determining means determines that the article determined as being left by the article-leaving-operation determining means poses danger by being left.

According to a third aspect of the present invention, there is provided the danger determining device according to the first or second aspect, characterized by further comprising an accessible location updating means for changing the accessible location stored in the accessible location database to become wider when an article to be determined of danger by combination with the ID of the person and a furnishing other than the article exist in the environment to be watched over, and when the position of the article stored in the accessible location database and determined as being left by the article-leaving-operation determining means and a position of the furnishing are within a predetermined distance.

According to a fourth aspect of the present invention, there is provided the danger determining device according to any one of the first to third aspects, characterized by further comprising:

an article usage determining means for determining that the person is using the article when the position of the article and the position of the person are within a predetermined value from the ID and the position information of the article and the ID and the position information of the person stored in the sensing history database; and an accessible location updating means for changing the accessible location stored in the accessible location database to become wider; wherein the accessible location updating means updates content of the accessible location database to acquire, from the sensing history database, before-use position information of where the article has been placed before use by the person based on the ID of the article when determined that the person is using the article in the environment to be watched over by the article usage determining means, determine whether or not the person is able to access a before-use position related to the before-use position information from the ID and the position information of the person present in the environment to be watched over, the ID and the position information of the article determined as being left by the article-leaving-operation determining means stored in the sensing history database, and the information on the accessible location stored in the accessible location database, and store in the accessible location database, information of being the accessible location with respect to all the before-use position information of the article and the information of the accessible location same as the before-use position of the article or more easily accessible than the before-use position information stored in the accessible location database when it is determined that the before-use position of the article is not the accessible location as not accessible for the person, according to the information of the accessible location stored in the accessible location database.

According to a fifth aspect of the present invention, there is provided a danger notifying device characterized by comprising:

the danger determining device according to any one of the first to fourth aspects; and a notifying means for issuing an alarm when determined as dangerous by the left-article danger degree determining means.

According to a sixth aspect of the present invention, there is provided the danger notifying device according to the fifth aspect, characterized by further comprising a usage danger degree determining means for determining whether or not current usage state is dangerous from whether or not the ID of the article being used and the ID of the person using the article are dangerous combination information by the information stored in the dangerous article database when determined that the person is using the article in the article usage determining means; wherein the notifying means issues an alarm when determined as dangerous by the usage danger degree determining means.

According to a seventh aspect of the present invention, there is provided a danger determining method for determining danger using, a sensing history database for storing an ID and position information of an article in an environment to be watched over, and an ID and position information of a person in the environment to be watched over, along with respective times;

a dangerous article database for storing dangerous combination information in which an ID of a dangerous article, which is an article having a possibility of posing danger, of the articles in the environment to be watched over and an ID of a person, who may be present in the environment to be watched over, are associated; and an accessible location database for storing information on accessible locations in the environment to be watched over for every ID of a person who may be present in the environment to be watched over;

the method characterized by comprising:

an article-leaving-operation determination step for determining that the person has left the article when the position of the article and the position of the person are apart by more than a predetermined distance from the ID, the position information, and the time of the article as well as the ID, the position information, and the time of the person stored in the sensing history database; and a left-article danger degree determination step for determining whether or not the article determined as being left in the article-leaving-operation determination step has a possibility of posing danger by being left; wherein in the left-article danger degree determination step, is performed a first determination of determining whether a combination of the ID of the person in the environment to be watched over and the ID of the article determined as being left by the article-leaving-operation determination step stored in the sensing history database matches the dangerous combination information of the ID of the dangerous article and the ID of the person stored in the dangerous article database; is performed a second determination of determining whether or not the person in the environment to be watched over is capable of accessing the position of the article determined as being left by the article-leaving-operation determination step from the ID and the position information of the person in the environment to be watched over and the ID and the position information of the article determined as being left by the article-leaving-operation determination step stored in the sensing history database, and information on the accessible location of the person stored in the accessible location database; and is determined that the article determined as being left by the article-leaving-operation determination step poses danger by being left when determined as matching in the first determination and determined as accessible in the second determination in the left-article danger degree determining step.

According to an eighth aspect of the present invention, there is provided the danger determining method according to the seventh aspect, characterized by further comprising:

an article usage determination step for determining that the person is using the article when the position of the article and the position of the person are within a predetermined value from the ID and the position information of the article and the ID and the position information of the person stored in the sensing history database; and an accessible location update step for updating content of the accessible location database;

wherein in the accessible location update step, the content of the accessible location database is updated to acquire, from the sensing history database, before-use position information of where the article has been placed before use by the person based on the ID of the article when determined that the person is using the article in the environment to be watched over by the article usage determination step, determine whether or not the person is able to access a before-use position related to the before-use position information from the ID and the position information of the person present in the environment to be watched over and stored in the sensing history database, and the ID and the position information of the article stored in the sensing history database and determined as being left by the article-leaving-operation determination step, and the information on the accessible location stored in the accessible location database, and store in the accessible location database, information of being the accessible location with respect to all the before-use position information of the article and the information of the accessible location same as the before-use position of the article or more easily accessible than the before-use position information, stored in the accessible location database when it is determined that the before-use position of the article is not the accessible location as not accessible for the person, according to the information of the accessible location stored in the accessible location database.

According to a ninth aspect of the present invention, there is provided a danger determining program for causing a computer to execute:

an article-leaving-operation determination step for determining that a person has left an article when a position of the article and a position of the person are apart by more than a predetermined distance from the ID, position information, and time of the article as well as an ID, position information, and time of the person stored in a sensing history database; and a left-article danger degree determination step for determining whether or not the article determined as being left in the article-leaving-operation determination step has a possibility of posing danger by being left, while using the sensing history database for storing the ID and the position information of the article in an environment to be watched over, and the ID and the position information of the person in the environment to be watched over, along with respective times;

a dangerous article database for storing dangerous combination information in which an ID of a dangerous article, which is an article having a possibility of posing danger, of the articles in the environment to be watched over and an ID of a person, who may be present in the environment to be watched over, are associated; and an accessible location database for storing information on accessible locations in the environment to be watched over for every ID of persons who may be present in the environment to be watched over, characterized in that in the left-article danger degree determination step, is performed a first determination of determining whether a combination of the ID of the person in the environment to be watched over and the ID of the article determined as being left by the article-leaving-operation determination step stored in the sensing history database matches the dangerous combination information of the ID of the dangerous article and the ID of the person stored in the dangerous article database; is performed a second determination of determining whether or not the person in the environment to be watched over is capable of accessing the position of the article determined as being left by the article-leaving-operation determination step from the ID and the position information of the person in the environment to be watched over and the ID and the position information of the article determined as being left by the article-leaving-operation determination step stored in the sensing history database, and information on the accessible location of the person stored in the accessible location database; and is determined that the article determined as being left by the article-leaving-operation determination step poses danger by being left when determined as matching in the first determination and determined as accessible in the second determination in the left-article danger degree determining step.

According to a 10th aspect of the present invention, there is provided the danger determining program according to the ninth aspect, characterized by further causing the computer to execute:

an article usage determination step for determining that the person is using the article when the position of the article and the position of the person are within a predetermined value from the ID and the position information of the article and the ID and the position information of the person stored in the sensing history database; and an accessible location update step for updating content of the accessible location database;

wherein in the accessible location update step, the content of the accessible location database is updated to acquire, from the sensing history database, before-use position information of where the article has been placed before use by the person based on the ID of the article when determined that the person is using the article in the environment to be watched over by the article usage determination step, determine whether or not the person is able to access a before-use position related to the before-use position information from the ID and the position information of the person present in the environment to be watched over and stored in the sensing history database, and the ID and the position information of the article stored in the sensing history database and determined as being left by the article-leaving-operation determination step, and the information on the accessible location stored in the accessible location database, and store in the accessible location database, information of being the accessible location with respect to all the before-use position information of the article and the information of the accessible location same as the before-use position of the article or more easily accessible than the before-use position information, stored in the accessible location database when it is determined that the before-use position of the article is not the accessible location as not accessible for the person, according to the information of the accessible location stored in the accessible location database.

The embodiments of the present invention will now be described with reference to the drawings.

First Embodiment

FIG. 1A is a block diagram showing a configuration of a danger notifying device 401 including a danger determining device 400 according to a first embodiment of the present invention. In FIG. 1A, the danger notifying device 401 includes an article detecting means (article detecting device) 100, a person detecting means (person detecting device) 110, an article-leaving-operation determining means 120, a left-article danger degree determining means 130, a dangerous article database 200, an accessible location database 210, a sensing history database 220, a notifying means (notifying device) 300, a controlling means 310, and an input means (input device) 320. The danger determining device 400 is configured by eliminating the notifying means 300 from the above configuration of the danger notifying device 401.

The controlling means 310 is connected to the article detecting means 100, the sensing history database 220, the input means 320, the accessible location database 210, the notifying means 300, the dangerous article database 200, the left-article danger degree determining means 130, the article-leaving-operation determining means 120, and the person detecting means 110 to control the respective operations. The sensing history database 220 is connected to the article detecting means 100, the person detecting means 110, the article-leaving-operation determining means 120, and the left-article danger degree determining means 130. The left-article danger degree determining means 130 is connected to the accessible location database 210. The left-article danger degree determining means 130 is connected to the dangerous article database 200. Furthermore, the article-leaving-operation determining means 120 and the notifying means 300 are connected to the left-article danger degree determining means 130.

Figure 2A:
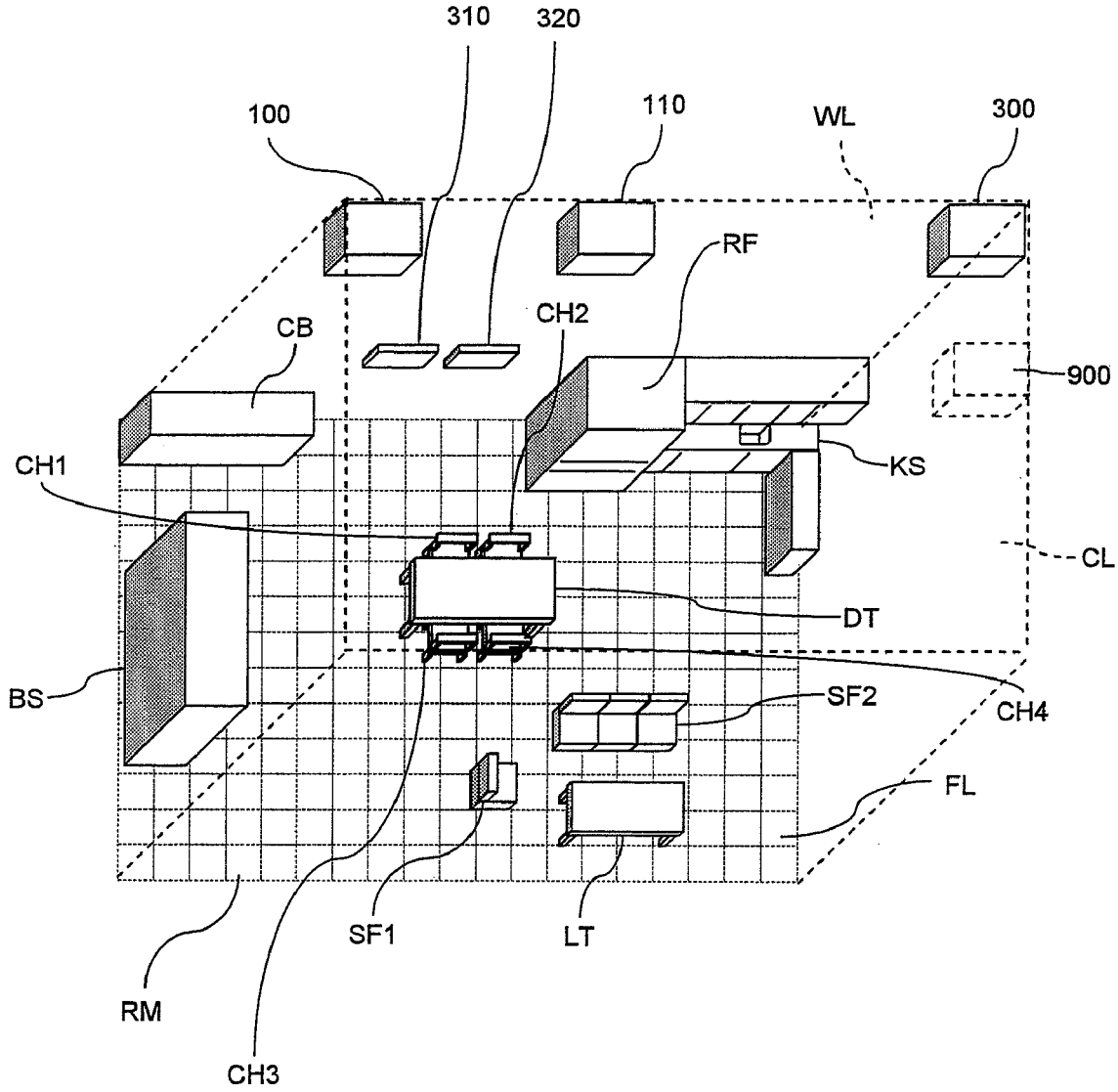
FIG. 2A is a view showing an example in which the danger determining device and the danger notifying device according to the first embodiment of the present invention are installed in a room.

FIG. 2A is an example in which the danger notifying device 401 of the first embodiment of the present invention is installed in a room MR. of a house, which is one example of an environment to be watched over. In the room MR., furnishings such as a bookshelf BS, a cabinet CB, a low table LT, a sofa 1 SF1, a sofa 2 SF2, a dining table DT, chairs 1 to 4 CH1 to CH4, a refrigerator RF, a kitchen system KS, and the like are arranged. Information on such facilities are preferably stored in advance in a database such as the sensing history database 220 as map information of the room MR., but may be detected by the article detecting means 100 and then stored. Suppose the danger determining device 400; the article detecting means 100 and the person detecting means 110, which are components of one part of the danger notifying device 401; and the notifying means 300, which is a component of one part of the danger notifying device 401, are installed at a ceiling CL of the room RM. The input means 320 and the controlling means 310 are assumed to be installed on a wall face WL of the room RM. Other components such as the article-leaving-operation determining means 120, the left-article danger degree determining means 130, the dangerous article database 200, the accessible location database 210, and the sensing history database 220 may be arranged in the room MR. such as the ceiling CL as shown with a box denoted with a reference numeral 900 in FIG. 2A, or that which commonly operates with respect to a plurality of rooms MR. may be arranged at least one for one environment (e.g., one house) to be watched over. Some or all of the article-leaving-operation determining means 120, the left-article danger degree determining means 130, the dangerous article database 200, the accessible location database 210, and the sensing history database 220 may be installed outside the environment (e.g., house) to be watched over and connected by way of a communication line.

The article detecting means 100 may be of any type that can detect the ID and the position information (e.g., position coordinate information) of an article, and the person detecting means 110 may be of any type that can detect the ID and the position information (e.g., position coordinate information) of a person (e.g., youngster including infant and child, adult, and the like), independently. The article detecting means 100 may detect a detected time along with the ID and the position information of the article. The person detecting means 110 may detect a detected time along with the ID and the position information of the person. The detected time can be obtained from a timer means (not shown). For instance, the article detecting means 100 attempts to make a detection at a predefined time interval (e.g., one second interval), and outputs the relevant time along with the ID and the position information of the detected article. Similarly, the person detecting means 110 attempts to make detection at a predefined time interval (e.g., one second interval), and outputs the relevant time along with the ID and the position information of the detected person.

Figure 2B:
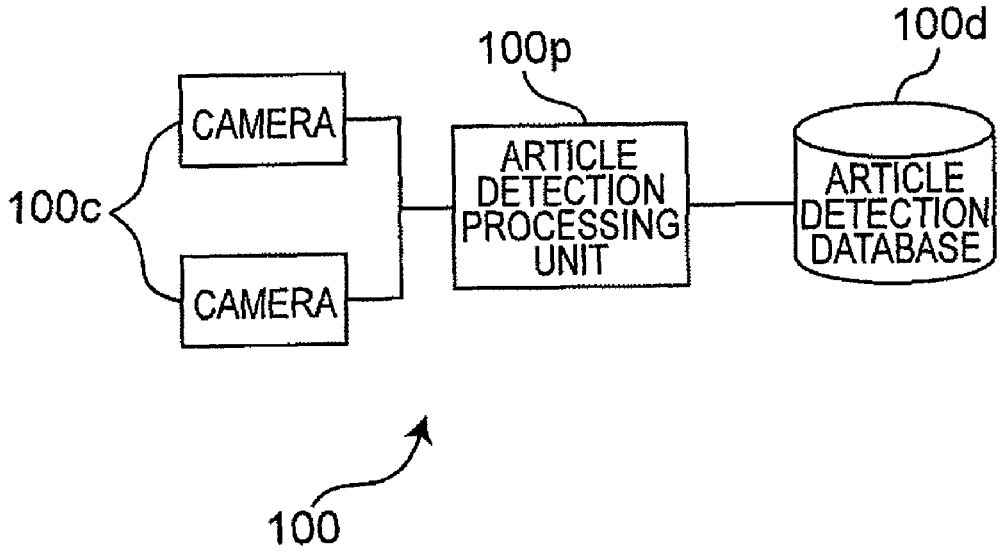
FIG. 2B is a block diagram showing one example of an article detecting means of the danger determining device according to the first embodiment of the present invention.

As one example of the article detecting means 100, a plurality of cameras 100*c* may be arranged at the ceiling etc. of the room, so that the ID of the article is detected in an article detection processing unit 100*p* through vision (outer appearance) of the article imaged with the camera 100*c*, and the position information of the article is detected with the article detection processing unit 100*p* using a stereo view by observation from the plurality of cameras 100*c* with reference to an article detection database 100*d*, as shown in FIG. 2B. A template matching technique etc. can be used for the method of detecting the ID of the article from the vision information (article outer appearance information). The vision (outer appearance) of the article from various directions is photographed in advance with the plurality of cameras 100*c*, and the images are saved in advance in the article detecting database 100*d* as a template in correspondence to the article ID. The image photographed with the camera 100*c* and the image of the template stored in the article detection database 100*d* are compared by the article detection processing unit 100*p* in time of article detection, and the ID of the article of the image of the most similar template is obtained as the article detection result by the article detection processing unit 100*p*. In this case, as one example, the article detecting means 100 can be configured by the plurality of cameras 100*c*, the article detection database 100*d*, and the article detection processing unit 100*p* for performing template matching.

Figure 2C:
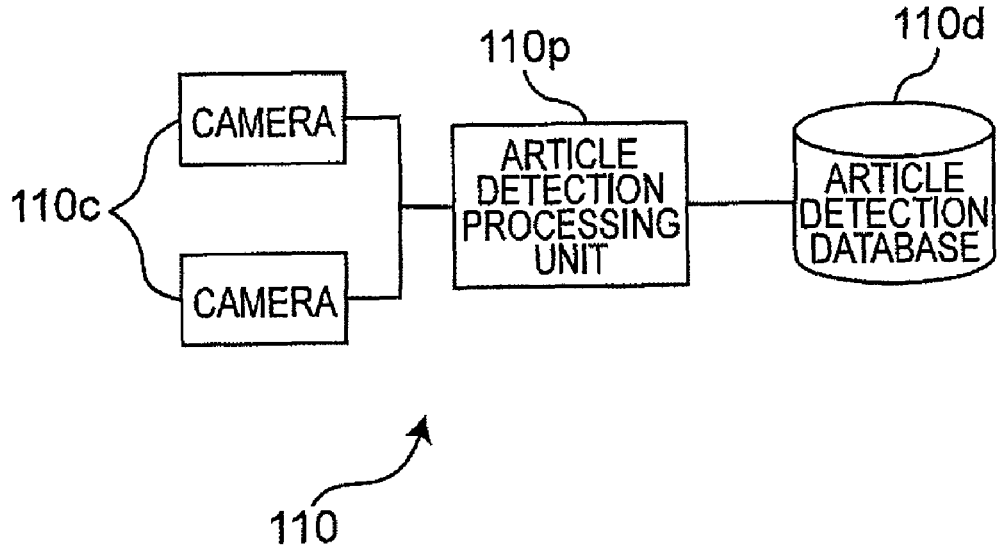
FIG. 2C is a block diagram showing one example of a person detecting means of the danger determining device according to the first embodiment of the present invention.

In the detection of a person, similar to the detection of an article, as one example of the person detecting means 110, a plurality of cameras 110*c* may be arranged at the ceiling etc. of the room, so that the ID of the person is detected in a person detection processing unit 110*p* from vision (outer appearance) of the person imaged with the camera 110*c*, and the position information of the person is detected with the person detection processing unit 110*p* using a stereo view by observation from the plurality of cameras 100*c* with reference to a person detection database 110*d*, as shown in FIG. 2C. Face recognition technique, iris authentication technique, or the like performed by the person detection processing unit 110*p* based on information of face etc. of the person stored in advance in the person detection database 110*d* can be used for the method of detecting the ID of the person from the vision information (person outer appearance information). In this case, as one example, the person detecting means 110 can be configured by the plurality of cameras 110*c*, the person detection database 110*d*, and the person detection processing unit 110*p* for performing face recognition technique, iris authentication technique, or the like.

Figure 3A:
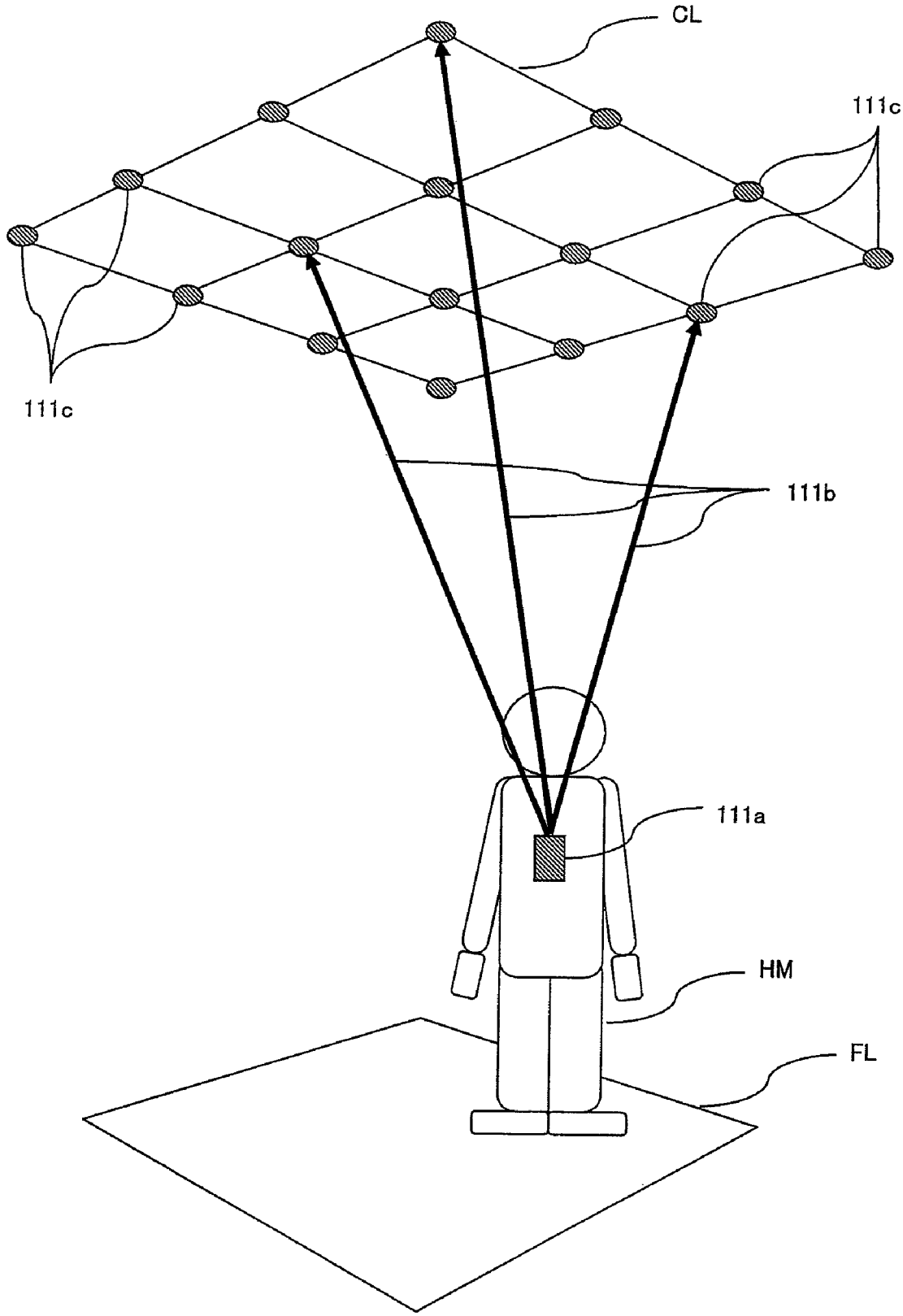
FIG. 3A is a view showing one example of a person detecting means of the danger determining device according to the first embodiment of the present invention.
Figure 3B:
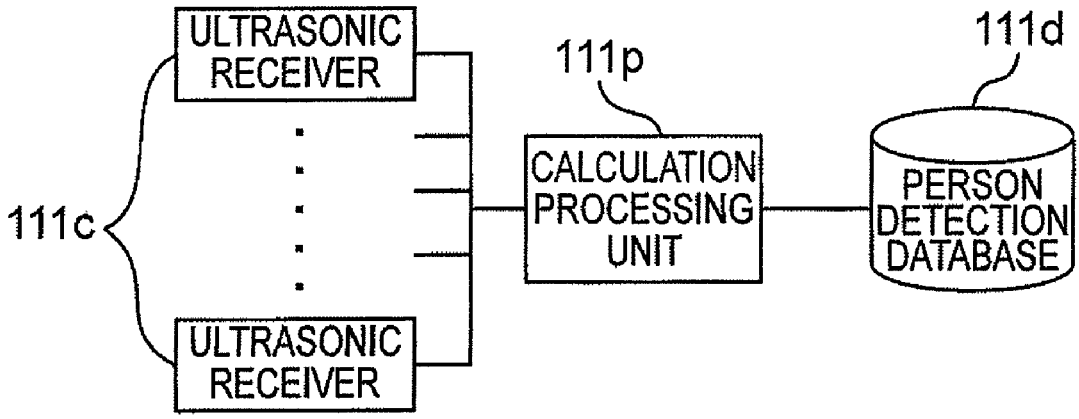
FIG. 3B is a block diagram showing the person detecting means of FIG. 3A.

An ultrasonic tag system as shown in FIG. 3A and FIG. 3B can be used as another example of the person detecting means 110. In the ultrasonic tag system of FIG. 3A and FIG. 3B, an ultrasonic transmitter 111*a* is carried by a person HM, an ultrasonic wave 111*b* emitted from the ultrasonic transmitter 111*a* is received by a plurality of ultrasonic receivers 111*c* arranged on the ceiling CL, and three-dimensional position information (value of three-dimensional position coordinate) of the ultrasonic transmitter 111*a* is calculated by a calculation processing unit (person detection processing unit) 111*p* from an arrival time difference of the ultrasonic wave while referencing the person detection database 111*d* storing the position information etc. of the ultrasonic receiver 111*c* as necessary. The ID of the person HM is stored in the person detection database 111*d* in correspondence to the ultrasonic transmitter 111*a*, and the ID of the person HM is detected by the calculation processing unit 111*p* by referencing the person detection database 111*d* from the calculation processing unit 111*p*. If the size of the article is sufficiently larger than the size of the ultrasonic transmitter 111*a*, the ultrasonic transmitter 111*a* can be given to the article to be used as the article detecting means 100. At the current technical level, the three-dimensional position information of the ultrasonic transmitter 111*a* can be specified at a precision of about 10 cm.

Figure 4A:
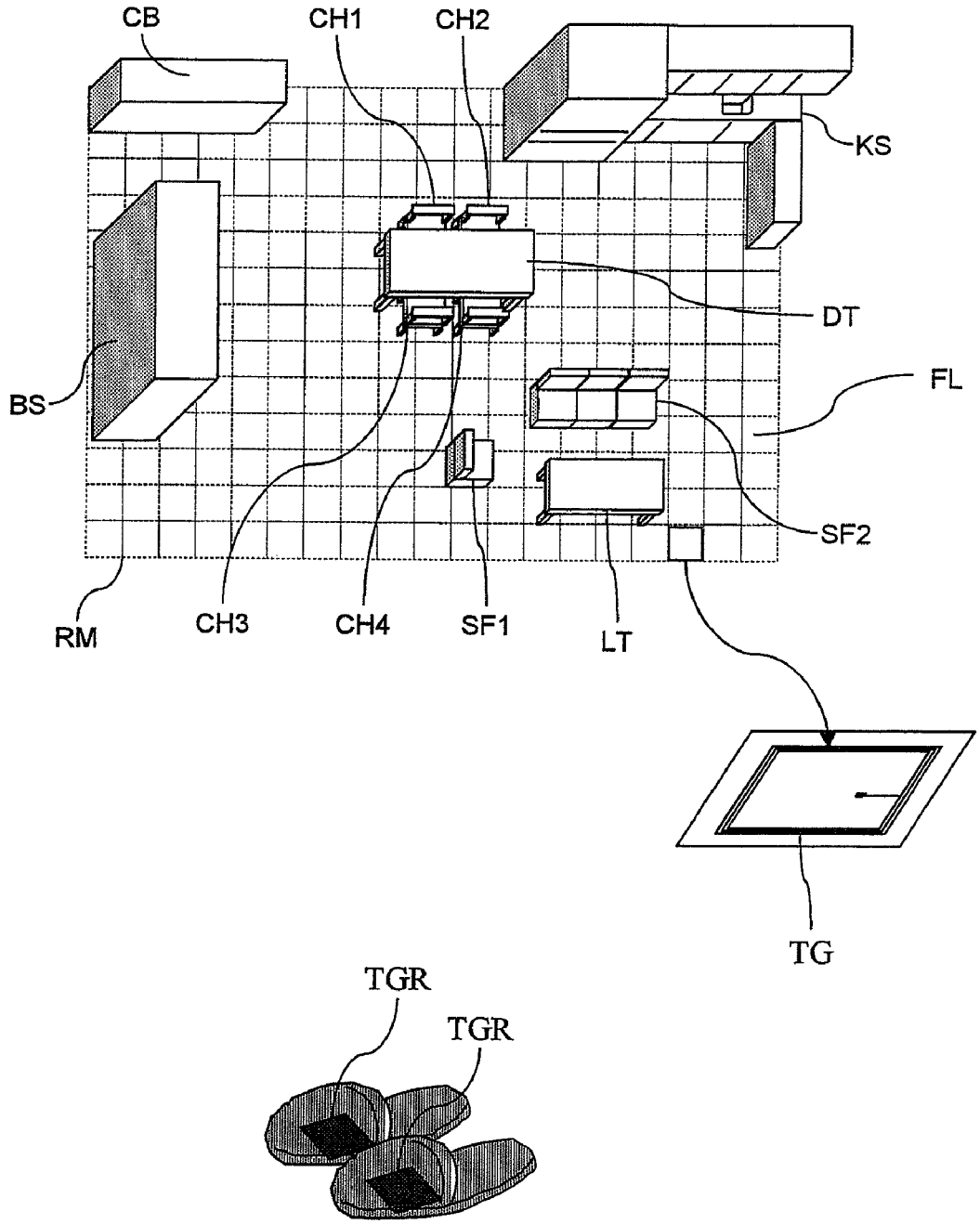
FIG. 4A is a view showing another example of the person detecting means of the danger determining device according to the first embodiment of the present invention.
Figure 4B:
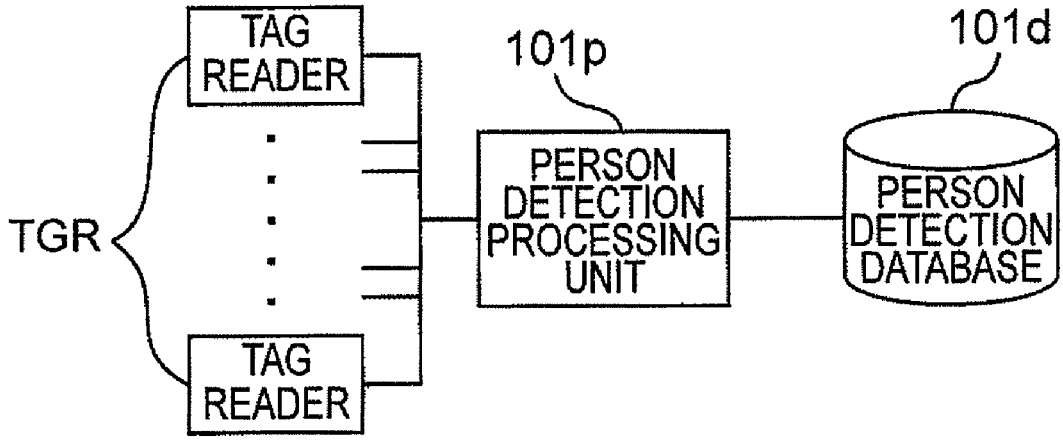
FIG. 4B is a block diagram showing the person detecting means of FIG. 4A.

A passive RF tag system as shown in FIG. 4A and FIG. 4B can be used as another example of the person detecting means 110. In the passive RF tag system of FIG. 4A and FIG. 4B, the person HM wearing footwear (e.g., slipper) incorporating a tag reader TGR walks on the floor FL, and the tag reader TGR of the footwear reads tags TG representing the position information and embedded in the floor FL, so that the position information of the person HM can be detected at a precision determined by the embedding density of the tags TG and the detection range of the tag reader TGR. The ID of the person HM is stored in the person detection database 101*d* in correspondence to the tag reader TGR, and the ID of the person HM is detected by the person detection processing unit 101*p* by referencing the person detection database 101*d* from the person detection processing unit 101*p*. In the case of infant of low age who does not wear footwear, a wearable tag reader TGR is attached to the ankle etc. to enable the use of the system.

In the first embodiment of the present invention, as one specific example of the person, child is mainly targeted on child from about eight months old of starting to "crawl" or "pull one's self up" as in particular "infant" to about six years old of before going to school. In a case of infant or child who is not able to "crawl" or "pull one's self up", the infant cannot move on his/her own, and thus the possibility the left article will pose danger on such infant is small. However, the first embodiment of the present invention also enables determination for a case where an article placed within a reaching range of the infant poses danger, and thus is also effective for infants of about five months old who cannot move on his/her own. The child (youngster) of about the age of entering elementary school obeys the guardian such as parents or grandparents, and thus the possibility the article will pose danger on the child is small. Obviously, the growth of infant or child (youngster) varies between individuals, and thus the dangerous combination information of the person and the dangerous article or an article having a possibility of posing danger when handled by the relevant person stored in the dangerous article database 200, and the relational information of the person and the location accessible (reachable) by the relevant person stored in the accessible location database 210 are set according to growth.

As another further example of the person detecting means 110, an active RF tag system may possibly be used in the future. In FIG. 3A and FIG. 3B, the reference numeral 111*a* indicating the ultrasonic wave transmitter is denoted for an active RF tag, the reference numeral 111*b* indicating ultrasonic wave for electric wave, and the reference numeral 111*c* indicating the ultrasonic receiver for an electric wave receiver, where the electric wave 111*b* emitted by the active RF tag 111*a* is received by a plurality of electric wave receivers 111*c* arranged on the ceiling CL, the three-dimensional position information of the active RF tag 111*a* is calculated in the calculation processing unit (person detection processing unit) 111*p* from an electric wave arrival time difference and the electric wave intensity ratio while referencing the person detection database 111*d* storing the position information etc. of the electric wave receivers as necessary. Although only a position precision of about 50 cm to 3 m can be achieved therewith at the current technical level, it may be used in the present application with future enhancement in technology. If the article is sufficiently larger than the size of the active RF tag, the active RF tag can be given to the article to be used as another example of the article detecting means 100.

Figure 5A:
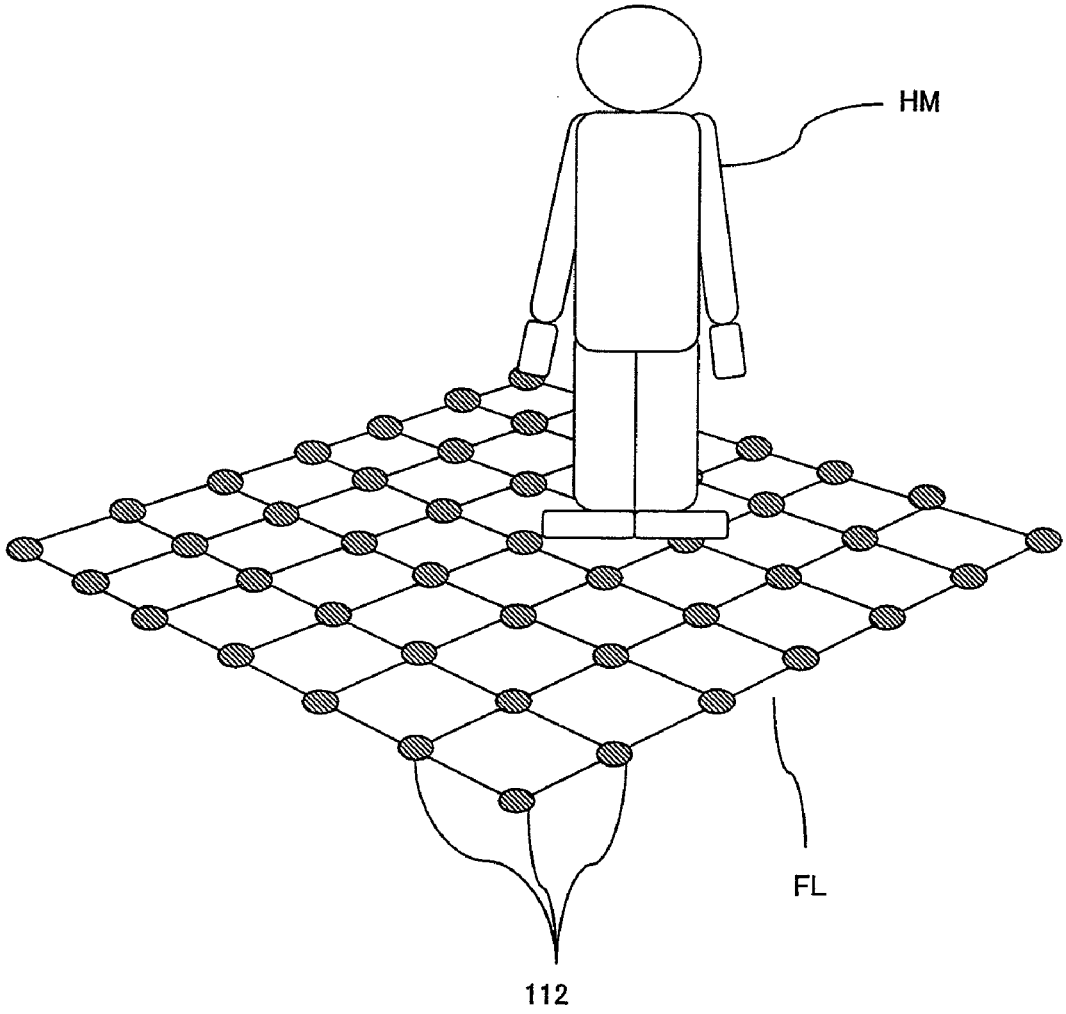
FIG. 5A is a view showing another example of the person detecting means according to the first embodiment of the present invention.
Figure 5B:
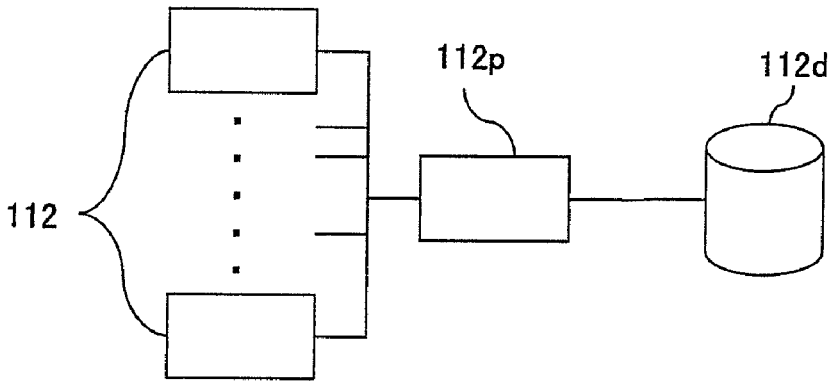
FIG. 5B is a block diagram showing the person detecting means of FIG. 5A.
Figure 5B:
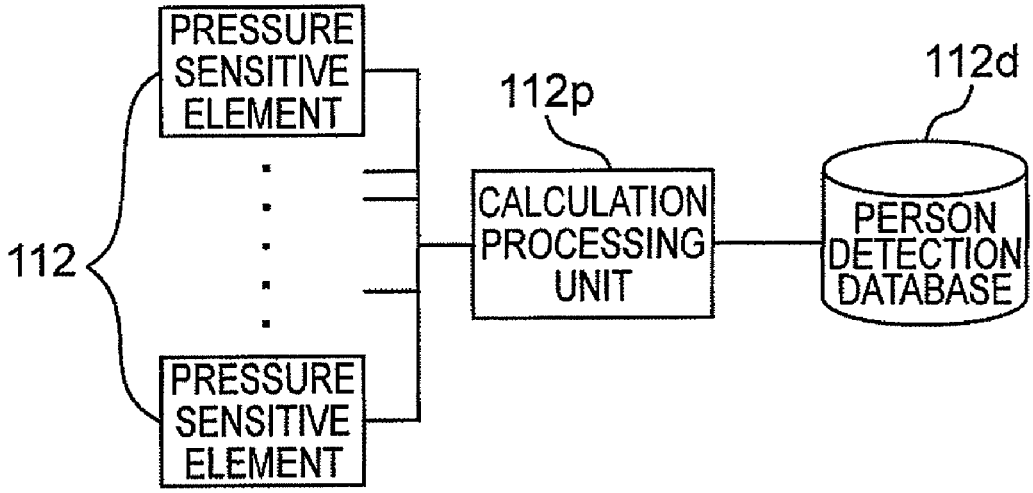

As another further example of the person detecting means 110, a floor pressure sensor as shown in FIG. 5A and FIG. 5B can be used. In the floor pressure sensor of FIG. 5A and FIG. 5B, when the person HM steps on a pressure sensitive elements 112 embedded in the floor FL, the position information of the person HM can be specified with an embedding density of the pressure sensitive elements 112 by a calculation processing unit (person detection processing unit) 112*p* while referencing the person detection database 112*d* storing the position information etc. of the pressure sensitive elements 112 as necessary. Furthermore, a method of performing personal identification from the walking pattern of the person HM or body pressure distribution of the sole of the foot is also proposed, and application to the present application is possible depending on the identification precision.

The sensing history database 220 stores the ID, the position information, and the detected time of the article detected by the article detecting means 100, and the ID, the position information, and the detected time of the person detected by the person detecting means 110. The ID and the position information of the article detected by the article detecting means 100, as well as, the ID and the position information of the person detected by the person detecting means 110 may be respectively stored in the sensing history database 220 with the detected time. The detected time may be detected in the article detecting means 100 and the person detecting means 110, respectively, and the ID, the position information, and the detected time of the article detected by the article detecting means 100, and the ID, the position information, and the detected time of the person detected by the person detecting means 110 may be respectively stored in the sensing history database 220. An example of the stored data is shown in FIG. 6. In FIG. 6, the position coordinate information of the sensed person and article is displayed in time series by ID. Here, the interval of the measurement time $t_1$ to $t_{20}$ . . . is one second.

In the table of FIG. 6, the numerical values representing the position information of the article and the person are coordinate values (unit: cm) in the coordinate system of the environment to be watched over. The position information is expressed in three-dimensional position coordinate (X, Y, Z) with respect to the person and the article. XY indicate coordinates along the lateral direction and along two axial directions orthogonal to each other, and Z indicates a height coordinate in the up and down direction. When detecting the person position information through image recognition using the image imaged with the camera, the position information of the person can be represented using position information of one part of the body defined in advance such as head or chest of the person. Furthermore, when measuring the position information of the person using equipments such as ultrasonic transmitter, the position information of the person can be represented using the position information of the relevant equipment. In the table of FIG. 6, the position information is detected between time $t_1$ to $t_{20}$ shown in the table of FIG. 6 for the person having person ID=1 and the person having person ID=2, but the position information is not detected for the person having person ID=3. This is a case where the person corresponding to person ID=3 is not present in the environment to be watched over (e.g., when out from a house serving as one example of the environment to be watched over). When detecting the position of the article through image recognition using the image imaged with the camera, the position information of the article can be expressed using one point on (in) the article defined in advance for each article. When measuring the position information of the article using equipments such as ultrasonic transmitter, the position information of the article can be represented using the position information of the relevant equipment. In FIG. 6, the position information does not change between time $t_1$ to $t_{20}$ shown in the table of FIG. 6 for the article ID=0001, and the Z coordinate value is zero so that assumption can be made as being placed on the floor FL. Similarly, the article ID=0002 is assumed to be stationary in a state placed on the floor FL until time $t_5$, but is then assumed as being moved by someone since the position information thereof changes from time $t_6$.

In the environment (space) to be watched over, information detected by the article detecting means 100 and the person detecting means 110 regarding the position information of all the registered persons and articles are stored in the sensing history database 220 in the format shown in FIG. 6.

Figure 28:
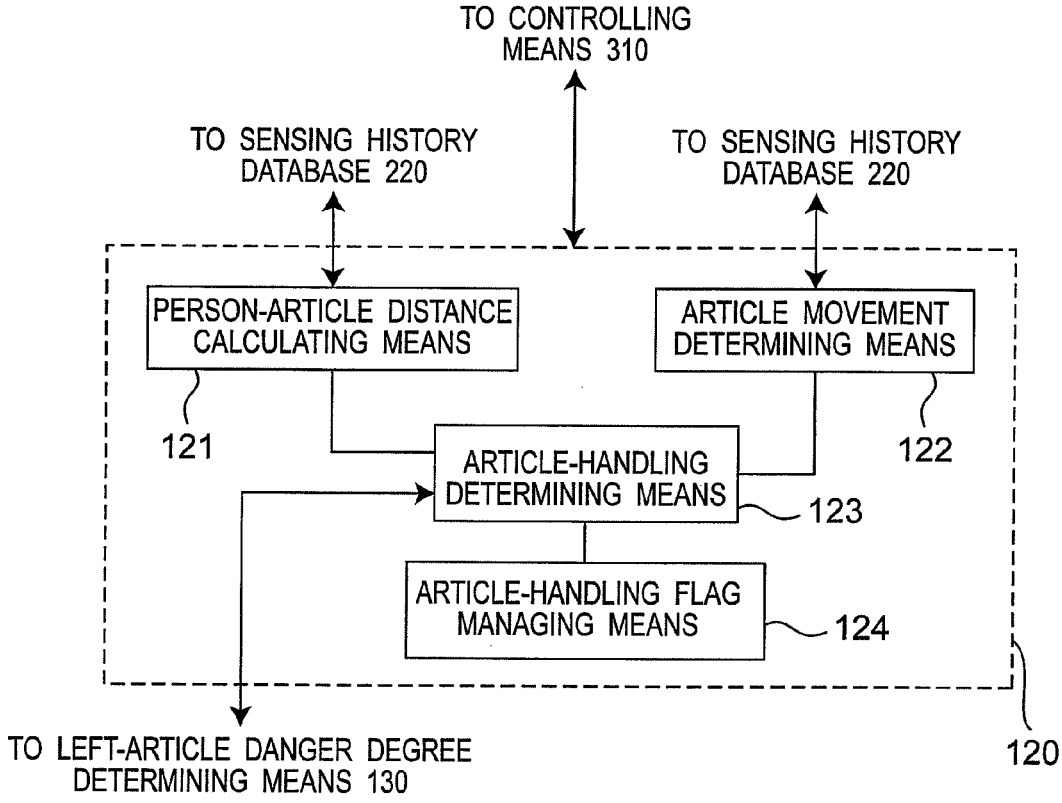
FIG. 28 is a block diagram showing an internal configuration of the article-leaving-operation determining means of FIG. 1A.

The article-leaving-operation determining means 120 detects, from the ID and the position information of the article and the ID and the position information of the person stored in the sensing history database 220 at substantially the same time, whether or not the person has left the article at a relevant time. A block diagram showing the internal configuration of the article-leaving-operation determining means 120 is shown in FIG. 28. The article-leaving-operation determining means 120 is configured by a person-article distance calculating means 121, an article movement determining means 122, an article handling determining means 123, and an article handling flag managing means 124. The person-article distance calculating means 121 and the article movement determining means 122 are respectively connected to the sensing history database 220 exterior to the article-leaving-operation determining means 120. The article handling determining means 123 is connected to the left-article danger degree determining means 130 exterior to the article-leaving-operation determining means 120, and is also connected to the person-article distance calculating means 121, the article movement determining means 122, and the article handling flag managing means 124.

Figures 7, 8:
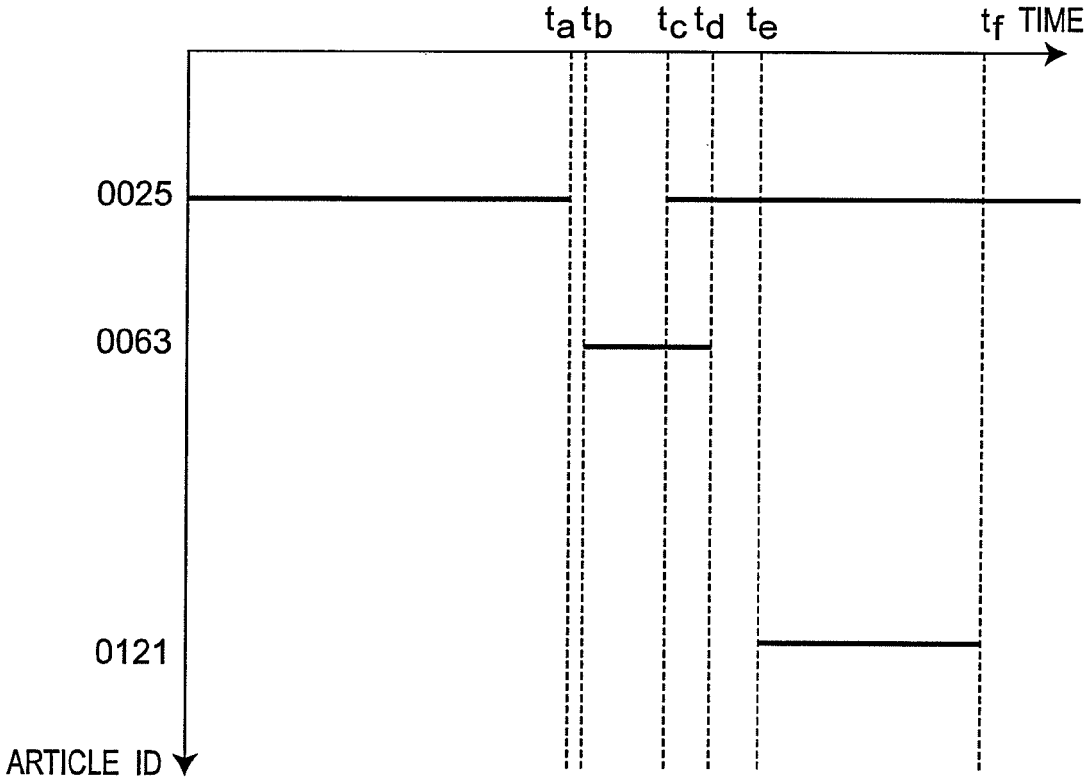
FIG. 7 is a view showing a threshold value of a distance for determining whether or not the person is leaving the article in the article-leaving-operation determining means according to the first embodiment of the present invention.
FIG. 8 is a view showing an example of a determination result of handling of article with respect to one person in the article-leaving-operation determining means according to the first embodiment of the present invention.
Figure 27:
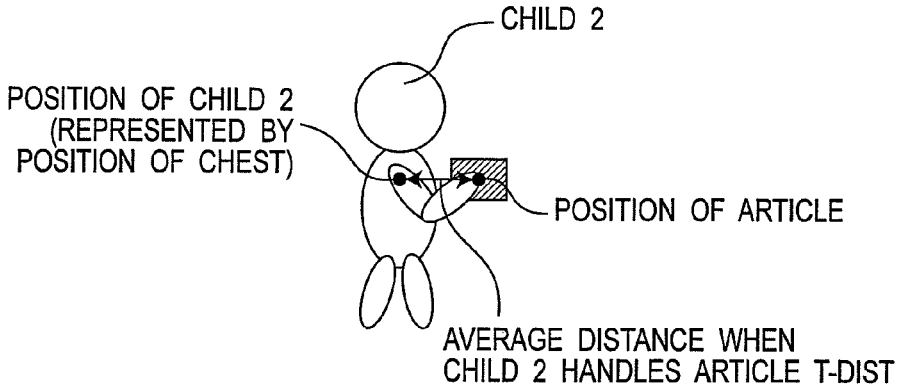
FIG. 27 is a view showing a state in which child 2 having person ID=6 in FIG. 7 is handling the article.

Immediately before the article is left by a person, the relevant article is obviously being handled by the person (or possessed, hereinafter referred to as "handle"), where the state in which the person is handling the article or the state in which the person is leaving the article is distinguished in the following manner. The state in which the person is handling the article is defined as "state in which a distance between a three-dimensional position of the article and a three-dimensional position of the person is within a predetermined value, and the article is not stationary". The distance between the three-dimensional position of the article and the three-dimensional position of the person is calculated by the person-article distance calculating means 121 using the three-dimensional position information of the article and the three-dimensional position information of the person stored in the sensing history database 220. Determination on whether or not the article is stationary is made by the article movement determining means 122 using temporal change of the three-dimensional position of the article stored in the sensing history database 220. An average distance between person and article when the person normally handles the article is measured in advance as the predetermined value, the relevant value (article handling threshold value) and the distance between the article and the person calculated by the person-article distance calculating means 121 are compared in the article handling determining means 123, and whether a state in which the person is handling the article or a state in which the person is leaving the article can be determined. In other words, determination is made as the state in which the person is handling the article when the distance between the article and the person is smaller than or equal to the value measured and defined in advance (article handling threshold value). Determination is made as the state in which the person is leaving the article when the distance between the article and the person is greater than the value measured and defined in advance (article handling threshold value) (in other words, when the position of the article and the position of the person are spaced apart more than a predetermined distance, and the article is stationary). This value (article handling threshold value) may be determined for every personal ID, or in the first embodiment, a value determined for every personal ID may be used from the table of FIG. 7. FIG. 7 is a table when the position information of the person is expressed by the position information of the chest of the relevant person, and is defined based on the length of the arm of the relevant person. FIG. 27 is a view showing a state where a child 2 (second child) or the person ID=6 is handling the article in FIG. 7. If the average distance T-DIST when the child 2 is handling the article in FIG. 27 is 25 cm, the article handling threshold value is defined as 30 cm in FIG. 7. The article handling threshold value is set larger than the average distance of when handling the article to respond to cases where the article is handled with the joint of the elbow extended where normally, the article is handled with the joint of the elbow bent. The position detection error of the article detecting means 100 and the person detecting means 110 may be taken into consideration, where if the position detection error of the article detecting means 100 and the person detecting means 110 is large, the article handling threshold value may be set larger than the average distance of when handling the article according to the size of the position detection error. When representing the position information of the person with the position information of another site of the body, the values of the table of FIG. 7 can be separately re-defined. For instance, when representing the position information of the person with the position information of the head of the relevant person, the average distance between the head and the finger tip of a case where the person normally handles the article is measured, and saved in the table in a format of FIG. 7. From the data of FIG. 6, the article ID=0002 can be assumed as being handled by a person having a person ID=1 by the article handling determining means 123 since the three-dimensional position coordinate (X, Y, Z) of the article ID=0002 changes close to and similar to the three-dimensional position coordinate (X, Y, Z) of the person having person ID=1 after time $t_6$. Assuming the state in which the person is leaving the article is defined as "state in which the distance between the three-dimensional position of the article and the three-dimensional position of the person is larger than the predetermined value, and the article is stationary" in the article handling determining means 123 as dangerous combination information. In addition to the two states of "state in which the person is leaving the article" and "state in which the person is handling the article" (state in which the distance between the three-dimensional position of the article and the three-dimensional position of the person is smaller than or equal to the predetermined value, and the article is not stationary), there are also "state in which the distance between the three-dimensional position of the article and the three-dimensional position of the person is within a predetermined value, and the article is stationary" and "state in which the distance between the three-dimensional position of the article and the three-dimensional position of the person is larger than a threshold value, and the article is not stationary", but neither state is included in either the handling state nor the leaving state in the first embodiment.

The operations of the article handling determining means 123 and the article handling flag managing means 124 will be described hereinafter using a flowchart.

According to the method described above, determination on who is handling which article and when can be made from the data stored in the sensing history database 220, and the threshold value defined for every person ID as shown in FIG. 7 stored in the article-leaving-operation determining means 120. By way of example, an example of the handling time of the article for the person having person ID=1 is shown in FIG. 8. The vertical axis of FIG. 8 shows the article ID and the lateral axis shows the time. The line segment along the lateral direction in the table of FIG. 8 corresponds to the time band during which the article is being handled. From FIG. 8, it can be read that the person having person ID=1 handles the article 0025 (cigarette) until time $t_a$, leaves the article 0025 at time $t_a$, starts to handle the article 0063 at time $t_b$, starts to handle the article 0025 at time $t_c$, leaves the article 0063 at time $t_d$, starts to handle the article 0121 at time $t_e$, and leaves the article 0121 at time $t_f$. After time $t_f$, the person having person ID=1 handles only the article 0025. The data as shown in FIG. 8 is obtained for all the persons who are present in the environment (space) to be watched over and who are registered in advance. An example of the article handling data obtained for six people registered in advance is displayed in the table of FIG. 9 in a simplified manner. In the table of FIG. 9, the lateral axis shows the time, similar to FIG. 8, where the arrow indicates the time band (i.e., terminating point of the arrow is the time the article is left) during which the article is being handled. The numbers described near the arrow are the ID of the article.

The dangerous article database 200 stores the ID of the person and the ID of the dangerous article in correspondence to each other as dangerous combination information so that the article that has a possibility of posing danger when handled is set as a dangerous article for every person ID, and a table as shown in FIG. 10 and the like can be used.

Generally, accidental ingestion occurs many times from about five months after birth to about three years old. According to "vital statistics of 2002 by Health, Labor and Welfare Ministry", accidental suffocation occupies 81.9% of the casualty at zero year old and 24.7% between one to four years old, and "accidental ingestion of foreign object" is reported to cause serious results. Not limited to suffocation, it is reported that accidents due to accidental ingestion also cause poisoning by cigarette, drugs and medicines, alcohol, detergent, agricultural chemical, battery, or the like. In the case of zero year old, there are many cases of suffocation by accidental ingestion of small articles such as coin and marble. In one to three years old at which age intelligence is growing, there tends to be many cases of poisoning than by suffocation as they watch parents smoke cigarette or take medicine and then put it in the mouth copying the parents or open a cap of a bottle etc.

In "National Consumer Information Center: research report on domestic accident", a list of detailed breakdown of products and facilities related to domestic accidents for zero to nine year olds is provided, and knife accidents ranked number five for five to nine year olds. At such age, the children start to learn how to use scissors, knives, and the like in handicraft in kindergarten and elementary school. Such articles cannot be completely distanced from children of the relevant age. Countermeasures such as having the parent first show the child how to use such article are necessary.

As described above, in various research reports, articles having a possibility of causing an accident are listed, and thus a dangerous article standard list by age (or by age in month or by year) is created based thereon, whereby the dangerous article database 200 as shown in FIG. 10 may be created based on the standard list. The dangerous article database 200 can be created by inputting information specifying the article name and the article ID through the input means 320.

It is, in reality, difficult to cover most of the (dangerous) articles in the household with only the article name listed in the research report. Thus, to respond to suffocation by accidental ingestion, determination may be made on whether or not the infant might put the article in the mouse by mistake based on the size of the article. In Europe and the United States, the guardian is provided with a plastic cylinder having a bore diameter of 32 mm and a length of between 25 and 57 mm and instructed that "articles that enter the cylinder have a risk of completely entering the mouse of the baby" in the infant medical examination. The article to be registered in the dangerous article database 200 may be automatically selected by the controlling means 310 according to shape if shape data corresponding to the article ID is prepared.

A cover is placed over the blade portion in scissors, where if such cover cannot be removed by infants to be watched over, it is not dangerous if the cover is attached, and it is dangerous if the cover is detached. Similarly, with respect to bins, cans, and bottles of drugs and medicines, alcohol, and the like, it is not dangerous if the lid or the cap is closed, and it is dangerous if it is opened. The registered content of the dangerous article database 200 may be changed according to the state of the target article. A device such as "state recognition tag" described in Japanese Patent No. 3811496 may be used to detect the state of the target article.

The accessible location database 210 stores information (information specified by height from the foot of the person or coordinate value) on the accessible location (reach of person's hand) for every person ID, and tables as shown in FIGS. 11A and 11B can be used. FIG. 11A is a simplified form of simply representing the information on the accessible location with the height from the foot of the person, and FIG. 11B represents the information on the accessible location with the coordinate value, and an accessible flag representing whether or not accessible by a person is set for every information of the location. The advantage of the representation form of FIG. 11A is that the definition of the accessible location is easy, and the advantage of the representation form of FIG. 11B is that the definition of the accessible location can be carried out in a more detailed manner. For instance, with respect to a shelf of a constant height, the accessible location can be defined in more detail by the input means 320 and stored in the accessible location database 210 by specifying a region using the (X, Y) coordinate value such as when the person hand can reach the near side of the shelf, but the hand cannot reach the far side of the shelf.

In FIG. 11B, the two-dimensional position is represented with a set of (X, Y) coordinate value of two opposing corners of the rectangle. This representation method will be described using FIG. 11C. In the first embodiment, a circumscribing rectangle RE in which each side is parallel to the X, Y coordinate axes of the environment to be watched over is set with respect to a region AR corresponding to a certain location. Among the four vertexes (p, q), (p, s), (r, q), (r, s) of the rectangle RE, the rectangle RE is represented by two vertexes (p, q), (r, s) respectively corresponding to those in which the X, Y coordinates are small and to those in which the X, Y coordinates are large, so that the region AR is easily and conveniently represented with the rectangle RE.

The definition of the accessible location may not be in a simple representation as in FIG. 11A and FIG. 11B, and may be in detail based on the actual three-dimensional position coordinate.

Figure 24A:
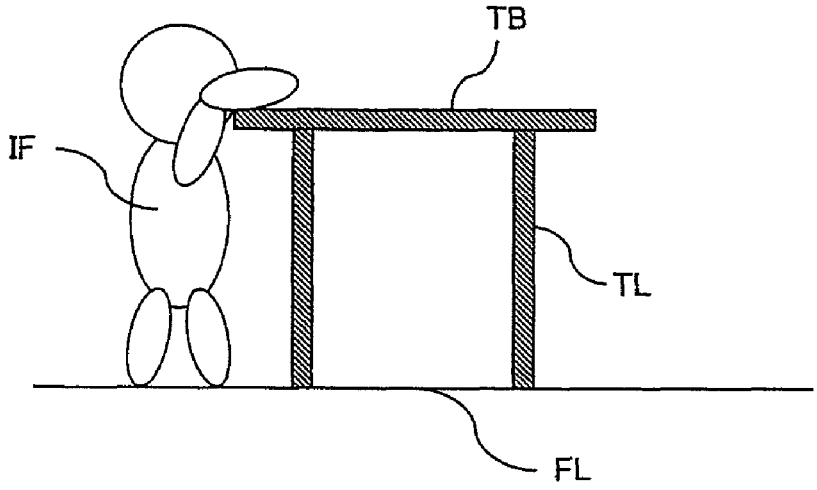
FIG. 24A is an explanatory view showing a state in which the accessible area of a table top plate differs according to the height of a table.
Figure 24B:
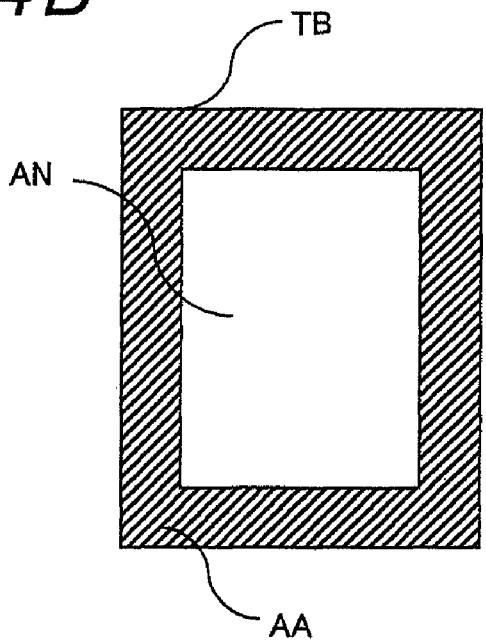
FIG. 24B is a plan view of the table top plate showing the accessible area of the table top plate in the case of FIG. 24A.
Figure 24C:
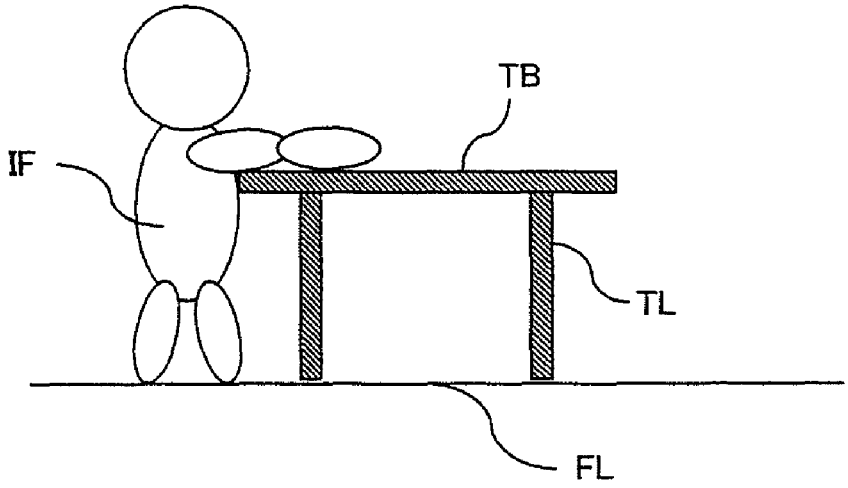
FIG. 24C is an explanatory view showing a state in which the accessible area of a table top plate differs according to the height of a table.
Figure 24D:
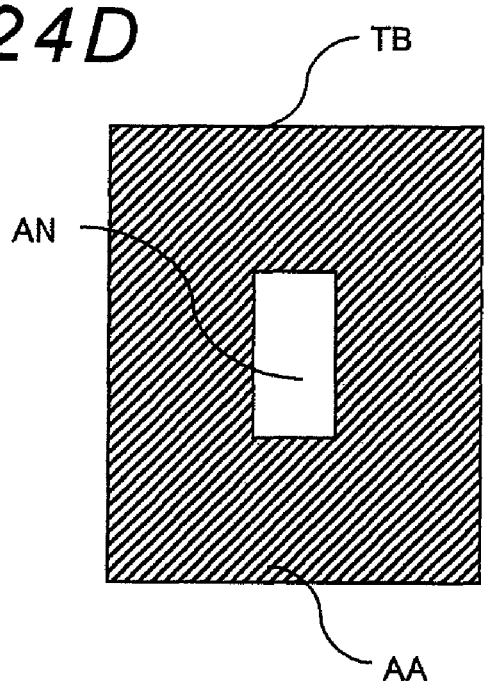
FIG. 24D is a plan view of the table top plate showing the accessible area of the table top plate in the case of FIG. 24C.
Figure 24E:
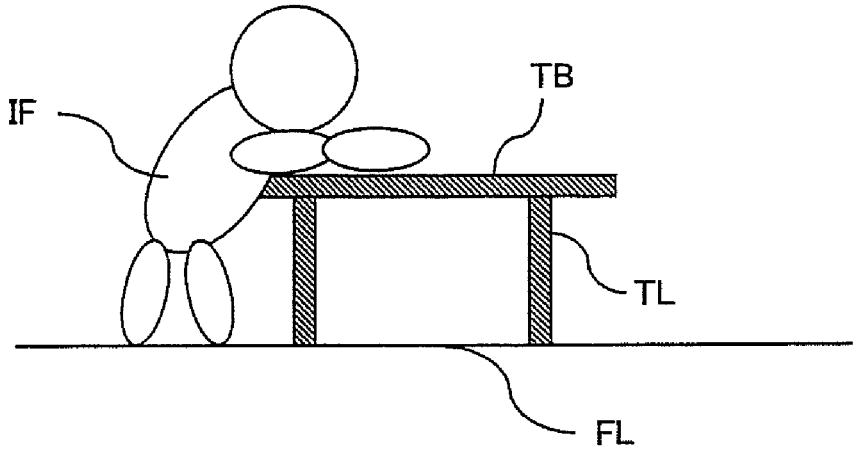
FIG. 24E is an explanatory view showing a state in which the accessible area of a table top plate differs according to the height of a table.
Figure 24F:
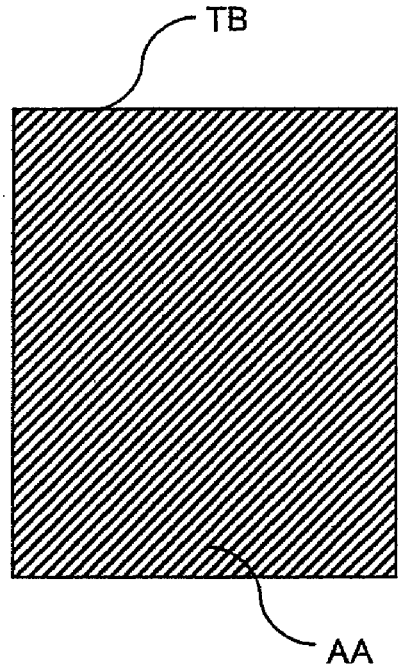
FIG. 24F is a plan view of the table top plate showing the accessible area of the table top plate in the case of FIG. 24E.

FIG. 24A to FIG. 24F show a case in which the accessible area AA (shaded region) of a table top plate TB differs according to the height of the table TL. FIG. 24A, FIG. 24C, and FIG. 24E are views of states in which the tables TL of different heights are arranged on the floor surface FL, and the infant IF is accessing the table top plates TB seen from the side. FIG. 24B, FIG. 24D, and FIG. 24F are views of the table top plates TB seen from above and are views showing the accessible areas AA and non-accessible areas NA, and respectively correspond to FIG. 24A, FIG. 24C, and FIG. 24E. The accessible area AA of the top plate TB changes according to the height of the table TL. That is, as shown in FIG. 24A and FIG. 24B, the accessible area AA of the top plate TB is a small region of only the periphery of the top plate TB if the height of the table TL is high. However, as shown in FIG. 24C and FIG. 24D, the accessible area AA of the top plate TB is a large region of most of the top plate TB excluding the central part if the height of the table TL is a little low. Furthermore, as shown in FIG. 24E and FIG. 24F, the accessible area AA of the top plate TB is the entire region of the top plate TB if the height of the table TL is considerably low. The accessible area AA can be represented in the table TL of FIG. 11B using the (X, Y) coordinate value and the height, and stored in the accessible location database 210.

The left-article danger degree determining means 130 determines whether or not the article determined as being left by the article-leaving-operation determining means 120 has a possibility posing danger when left, based on the ID, the position information, and the time (or date and time) of the left article, the ID, the position information, and the time (or date and time) of the person detected by the person detecting means 110, and the information stored in the dangerous article database 200 and the accessible location database 210. The operation of the left-article danger degree determining means 130 will be hereinafter described in detail.

The input means 320 accepts the input from the user. The input corresponds to the instructing information of start or termination of operation of the danger notifying device 401, and the creating information as well as the information necessary for maintenance of the dangerous article database 200. As described in the description of the dangerous article database 200, the dangerous article corresponding to the growth state of the target (infant) to be watched over in the household can be defined by adding/deleting the article to and from the dangerous article standard list by age/age group. Specific examples of the input means 320 include keyboard, mouse, touch panel, wireless or wired communication means, or the like.

The notifying means 300 makes a notification to the person who has left the article or the person set in advance if determined that danger is posed by such leaving operation in the left-article danger degree determining means 130. If the person who has left the article is to be notified, the notification is made immediately after the leaving operation, and thus the notifying content is simply "it is dangerous to leave this article" (here, assumption is made the person who has left the dangerous article is an adult). If the person who does not have left the article is to be notified, information on the person who has left the article, the article name that has been left, the left position information, the left time, and the like are notified.

The controlling means 310 is connected to all the means and databases, and controls the respective operations.

Subsequently, the operations of the danger determining device 400 and the danger notifying device 401 are described in detail using the flowchart of FIG. 12, FIG. 13, and FIG. 14A.

Figure 12:
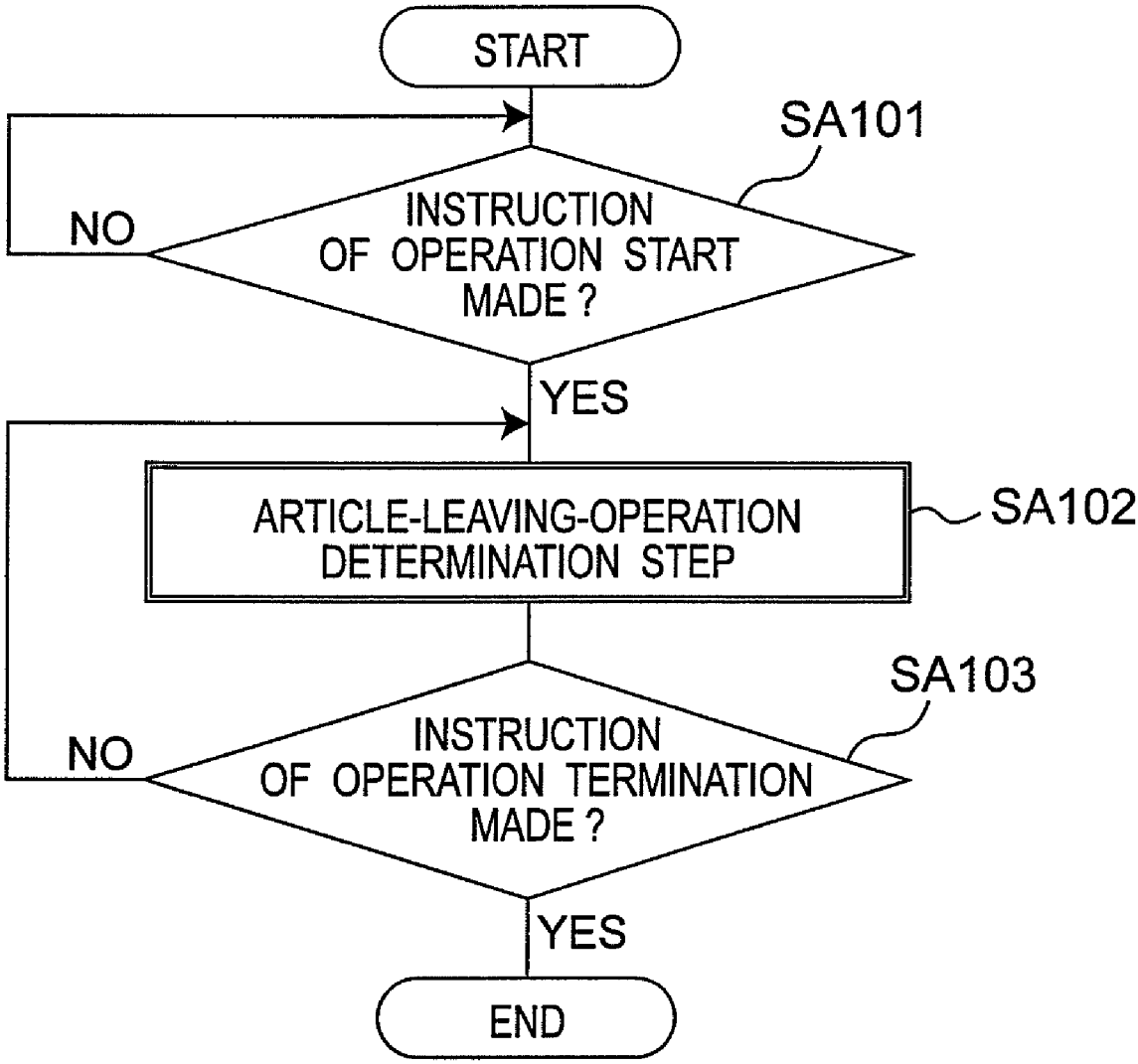
FIG. 12 is a flowchart of a danger notifying method according to the first embodiment of the present invention.

Steps SA101 and SA103 in FIG. 12 are executed by the controlling means 310 in the danger notifying device 401 of FIG. 1A. In step SA101, when input of the instructing information of operation start to the input means 320 is waited and instruction of operation start is made by the manager of the danger notifying device 401, the controlling means 310 starts the operation of the danger notifying device 401, and executes an article-leaving-operation determination step SA102 by the article-leaving-operation determining means 120.

The article-leaving-operation determination step SA102 is executed by the article-leaving-operation determining means 120. The sub-step of the article-leaving-operation determination step SA102 is shown in a flowchart of FIG. 13, and the detailed operation thereof will be hereinafter described. Step SA102 is repeated unless the instructing operation of operation termination is input in step SA103.

In step SA103, when input of the instructing information of operation termination to the input means 320 is waited, and instruction of operation termination is made by the manager of the danger notifying device 401, the operation of the danger notifying device 401 is terminated by the controlling means 310.

The operation of the article-leaving-operation determination step SA102 will be described in detail using the flowchart of FIG. 13. In FIG. 13, other steps other than step SB107 executed by the left-article danger degree determining means 130 are all executed by the article-leaving-operation determining means 120.

In step SB101, initialization of a variable i representing the person ID is performed by the article-leaving-operation determining means 120. Here, i=1 is set.

Next, in step SB102, the article-leaving-operation determining means 120 acquires a current position x (x is a vector. Hereafter simply referred to as "x") from the sensing history database 220 as current position information of the person having person ID=i. The storage content of the sensing history database 220 is shown in FIG. 6 and the like, and is represented using, as the position x, the three-dimensional position coordinate (X, Y, Z). The details are as described in the description of device configuration.

Next, in step SB120, determination on whether or not the position x of the person having person ID=i is acquired at step SB102 is made by the article-leaving-operation determining means 120. If the person having person ID=i is not in the environment to be watched over, the article-leaving-operation determining means 120 cannot acquire the position x from the sensing history database 220. The process proceeds to step SB103 if the position x of the person having person ID=i is acquired, and the process proceeds to step SB111 if the position x of the person having person ID=i is not acquired.

In step SB103, initialization of a variable j representing the article ID is made by the article-leaving-operation determining means 120. Here, j=1 is set.

Next, in step SB104, the article-leaving-operation determining means 120 acquires the current position y (y is a vector. Hereinafter simply referred to as "y") as the current position information of the article having article ID=j from the sensing history database 220. The storage content of the sensing history database 220 is shown in FIG. 6 and the like, and is represented using the three-dimensional position coordinate (X, Y, Z) as the position y. The details are as described in the description of device configuration. Although omitted in the flowchart of FIG. 13, if the article having the article ID=j is not present in the environment to be watched over, j is incremented by one, and the process is executed from SB104 on the next article.

Next, in step SB105, determination is made on whether or not the article handling flag of the article ID=j set in the past is in the ON state by the article-leaving-operation determining means 120. The article handling flag is a flag represented by binary information of ON when the article is being handled by a person, and OFF when the article is not being handled (is not in the environment to be watched over or is left in the environment to be watched over). The article handling flag is stored in the article handling flag managing means 124 of FIG. 28 in a format shown in FIG. 15. If the article handling flag is turned ON, the person ID of the handling person is also simultaneously stored. The line segment in FIG. 8 and the arrow in FIG. 9 represent the time band in which the article handling flag is turned ON. The setting of the article handling flag is performed in step SB108 and step SB114 described later. The setting will be described with step SB108 and step SB114. In step SB105, the process proceeds to step SB106 if the article handling flag is turned ON, and the process proceeds to step SB113 if the article handling flag is turned OFF. In FIG. 12, repetition of the article-leaving-operation determination step SA102 has been described, where "past" refers to "execution timing of sub-step SB108 or SB114 in the article-leaving-operation determination step SA102 executed in the past". The initial value of the article handling flag is turned OFF. That is, the article handling flags corresponding to all the articles are turned to OFF immediately after the instruction of operation start is made in step SA101. Furthermore, if there is a need to perform the left-article danger degree determination on the article already left at the point the instruction of operation start is made, the flowchart of FIG. 13 may be changed as below. When the flowchart of FIG. 13 is called out from the article-leaving-operation determination step SA102 at the time of first execution, step SB106 and step SB113 are both executed without executing step SB105.

In step SB106, determination is made on whether the distance between the current position x of the person having person ID=i and the current position y of the article having article ID=j is larger than a predetermined value (article handling threshold value) related to the person of person ID=i, and the article having article ID=j is stationary. This determination is made by the article handling determining means 123 in the article-leaving-operation determining means 120. If determined as Yes in step SB106 when the handling flag of the article is ON, the article is determined as being left. The process proceeds to step SB107 if Yes, and the process proceeds to step SB109 if No.

The distance between the current position x of the person having person ID=i and the current position y of the article having article ID=j is calculated by the person-article distance calculating means 121 in the article-leaving-operation determining means 120 using the article position information and the person position information stored in the sensing history database 220. Euclidean distance can be used in the calculation of the distance between the current position x of the person and the current position y of the article. The predetermined value (article handling threshold value) related to the person of person ID=i is obtained from the database of FIG. 7 stored in the article-leaving-operation determining means 120. The determination on whether or not the article is stationary is made by the article movement determining means 122 in the article-leaving-operation determining means 120 using temporal change of the three-dimensional position of the article stored in the sensing history database 220. The temporal change of the article position in the data (FIG. 6) stored in the sensing history database 220 is used to determine whether or not the article having article ID=j is stationary. If the stored article position information contains measurement error, the measured article position is not, in a narrow sense, a constant value with respect to time even if the article is actually stationary. In this case, the article movement determining means 122 determines that the article is stationary if the position variation of the article with respect to temporal change is within a predetermined threshold value.

Step SB107 corresponds to the left-article danger degree determination step, and is executed by the left-article danger degree determining means 130. Step SB107 is configured by each sub-steps in FIG. 14A, and the detailed operation thereof will be hereinafter described.

Next, in step SB108, the article handling flag corresponding to the article ID=j is set to OFF. This process is performed by the article handling flag managing means 124 in the article-leaving-operation determining means 120.

In step SB113, whether the distance between the current position x of a person having person ID=i and the current position y of an article having article ID=j is within the predetermined value (article handling threshold value) related to the person of person ID=i, and the article having article ID=j is moving are determined. This determination is made by the article handling determining means 123 in the article-leaving-operation determining means 120. The process proceeds to step SB114 if Yes in step SB113, and the process proceeds to SB109 if No. Each condition determination is performed similar to the determination of step SB106.

In step SB114, the article handling flag corresponding to the article ID=j is set to ON. This process is performed by the article handling flag managing means 124 in the article-leaving-operation determining means 120.

In step SB109, the variable j is incremented by one, and in the following step SB110, determination on whether or not the variable j is larger than the total number of objects M is made. The process proceeds to step SB111 if Yes, and the process is again executed from step SB104 if No. That is, steps SB104 to SB108 (step SB113, step SB114 depending on the condition determination of step SB105) are executed on all the articles.

In step SB111, the variable i is incremented by one, and determination on whether or not the variable i is larger than the total number of people N is made in the following step SB112. The article-leaving-operation determination process is terminated if Yes, and the process proceeds to step SA103 in FIG. 12. If No, the process is again executed from step SB102. That is, steps SB102 to SB108 (step SB113, step SB114 depending on the condition determination of step SB105) are executed on all the people.

The operation of the left-article danger degree determination step 107 will now be described in detail using the flowchart (sub-steps SC101 to SC104) of FIG. 14A. In FIG. 14A, other steps excluding the step SC104 executed by the notifying means 300 are all executed by the left-article danger degree determining means 130.

Figure 13:
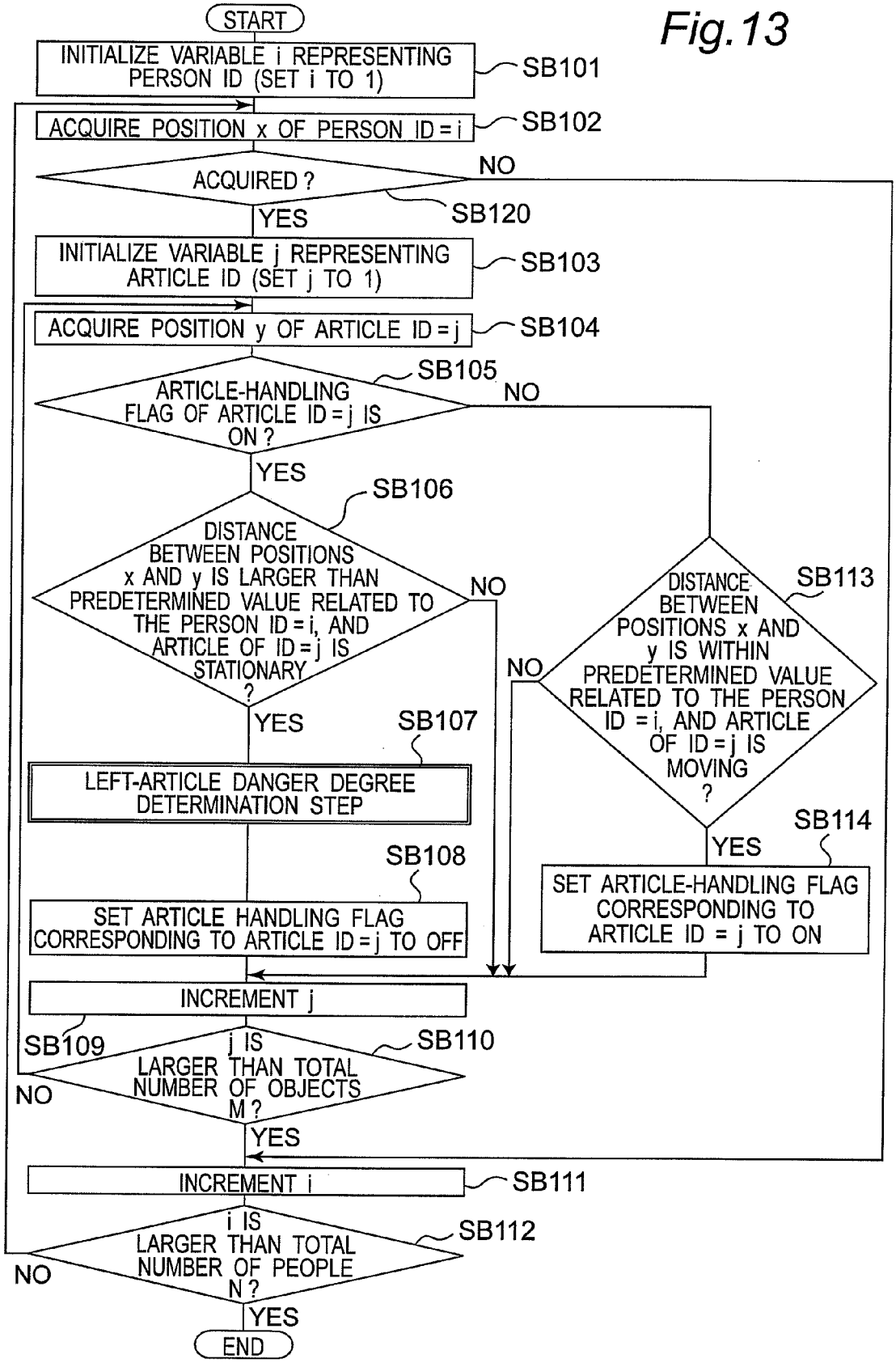
FIG. 13 is a flowchart of an article-leaving-operation determination step according to the first embodiment of the present invention.

As one example, a case in which the article having article ID=0025 is determined as being left at time $t_a$ in FIG. 8 in step SB106 of FIG. 13 will be considered. Describing FIG. 8 (FIG. 9) using the article handling flag, the article handling flag is set to ON at the starting point (starting point of the arrow of FIG. 9) of the line segment of FIG. 8, and the article handling flag is set to OFF at the terminating point (terminating point of the arrow of FIG. 9) of the line segment of FIG. 8. The left-article danger degree determination step SB107 is an on-line process (not collectively executed after all the data as shown in FIG. 8 and FIG. 9 are obtained), and thus data after the current time $t_a$ is not yet obtained.

Figure 14A:
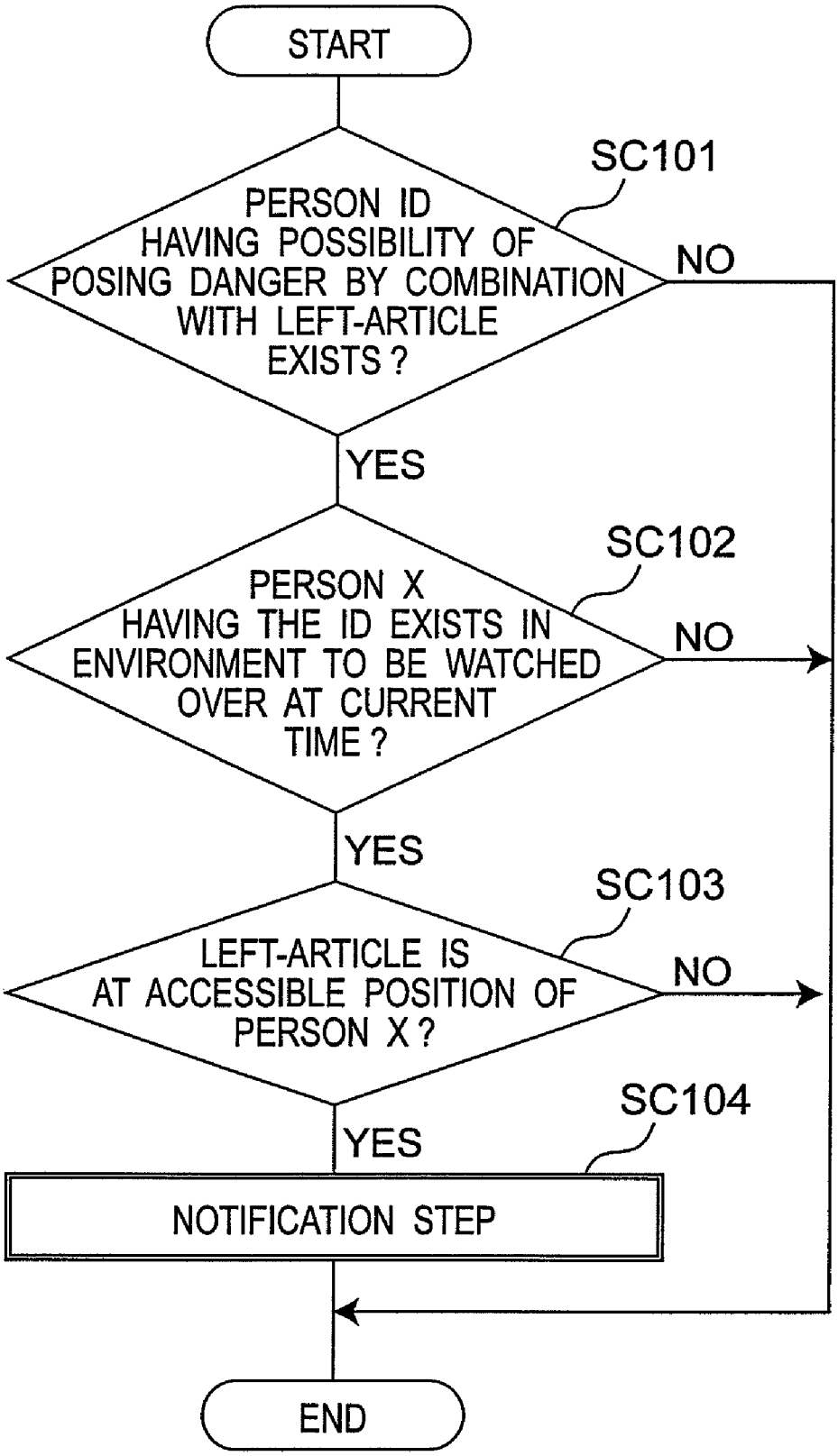
FIG. 14A is a flowchart of the left-article danger degree determination step according to the first embodiment of the present invention.

In step SC101 of FIG. 14A, regarding whether or not a person ID having a possibility of posing danger with a combination (dangerous combination information) with the left article having article ID=0025 is present in the environment to be watched over (whether or not ID (i.e., person ID having a possibility of posing danger) of a person in the dangerous combination information related to the article ID=0025 and person ID currently present in the environment to be watched over match), the data (FIG. 10) stored in the dangerous article database 200 is referenced by the left-article danger degree determining means 130, and determination is made by the left-article danger degree determining means 130 (first determination). If the person ID having a possibility of posing danger is present in the environment to be watched over (if ID (i.e., person ID having a possibility of posing danger) of a person in the dangerous combination information related to the article ID=0025 and person ID currently present in the environment to be watched over match), the process proceeds to step SC102, and if the person ID having a possibility of posing danger is not present in the environment to be watched over (if ID (i.e., person ID having a possibility of posing danger) of the person in the dangerous combination information related to the article ID=0025 and person ID currently present in the environment to be watched over do not match), the left-article danger degree determination process is terminated, and the process proceeds to step SB108 in FIG. 13. Here, the cigarette of article ID=0025 is dangerous to child 2 having person ID=6, and thus the process proceeds to step SC102.

In step SC102, whether the person of ID=6 is present in the environment to be watched over at the time point of time $t_a$ (time $t_a$ is the "current" time point) is determined by the left-article danger degree determining means 130 using the information stored in the sensing history database 220. The process proceeds to step SC103 if the person of ID=6 is present at the time point of time $t_a$, and the left-article danger degree determination process is terminated, and the process proceeds to step SB108 in FIG. 13 if the person of ID=6 is not present. Assuming the person of ID=6 is recognized, the process proceeds to step SC103.

Next, in step SC103, whether or not the left cigarette of article ID=0025 is at an accessible position of the person of ID=6 is determined by the left-article danger degree determining means 130 using the information stored in the sensing history database 220 and the accessible location database 210 (second determination). The process proceeds to step SC104 if determined as accessible, and the left-article danger degree determination process is terminated, and the process proceeds to step SB108 in FIG. 13 if determined as not accessible. Assume the left-article danger degree determining means 130 obtains that the cigarette of article ID=0025 is present at position ($X_A$, $Y_A$, $Z_A$) at time $t_a$ from the sensing history database 220. The left-article danger degree determining means 130 uses the accessible location database 210, and whether the child 2 having person ID=6 is accessible to the position ($X_A$, $Y_A$, $Z_A$) of the cigarette of article ID=0025 is determined by the left-article danger degree determining means 130. If the accessible location database 210 of FIG. 11A is used as the accessible location database 210, whether the height position coordinate $Z_A$ in the Z direction of the cigarette of article ID=0025 is less than 70 cm (value of height from the foot of the child 2 having person ID=6, or threshold value of whether accessible location or not from table data of FIG. 11A) is determined by the left-article danger degree determining means 130. Here, assuming the height position coordinate $Z_A$=50 (cm) in the Z direction of the cigarette of article ID=0025, the cigarette of article ID=0025 is determined as being at the accessible position by the left-article danger degree determining means 130 ($Z_A$<70), and the process proceeds to step SC104.

If the accessible location database 210 of FIG. 11B is used as the accessible location database 210, to which "location" the position at where the cigarette of article ID=0025 is left belongs, the position being represented by a three-dimensional position coordinate ($X_A$, $Y_A$, $Z_A$), is determined by the left-article danger degree determining means 130, and thereafter, whether the child 2 having person ID=6 is accessible to the relevant "location" is determined by the left-article danger degree determining means 130 with respect to the relevant location. Assume the relevant location is determined as the LT (low table) from the position ($X_A$, $Y_A$, $Z_A$) by the left-article danger degree determining means 130. Determination is made that the person having person ID=6 is accessible by the left-article danger degree determining means 130, and the process proceeds to step SC104. It should be noted that $x_3 \leqq X_A \leqq x_4$, $y_3 \leqq Y_A \leqq y_4$.

In the case of the danger determining device 400 not including the notifying means 300, the left-article danger degree determination process is terminated without executing step SC104, and the process proceeds to step SB108 in FIG. 13.

In the case of the danger notifying device 401 including the notifying means 300, the notification step SC104 is executed by the notifying means 300. As a specific example of the notifying means 300, the danger notification can be made using notifying equipment such as speaker or display installed in the environment (space) to be watched over, telephone or a PDA carried by an individual, or the like.

Here, notification is made to the person who has left the article and the person set in advance. For instance, in the environment to be watched over registered with six people as shown in FIG. 7, the mother of person ID=4 is assumed to be set as the person set in advance. If the grandfather of person ID=1 leaves the dangerous article, notification is made to the grandfather and the mother. If the person to be notified is the person (grandfather) who left the article, the notification is made immediately after the article is left, and thus the content is merely "it is dangerous to leave the article". If the person to be notified is the person (mother) set in advance, notification of "person (grandfather) who left the article, name of the left article (e.g., cigarette), left position, left time" is made. Since the position information of the person to be notified at the relevant time can be acquired by the notifying means 300 through the controlling means 220 from the sensing history database 220, notification may be made from the notifying equipment closest to the position of the person to be notified when making a notification from the notifying equipment installed in plurals in the environment to be watched over as one example of the notifying means 300. When making a notification from the notifying equipment carried by an individual, notification may be made by calling the notifying equipment of the person to be notified.

Such left-article danger degree determination step SB107 is executed every time determination is made that the article is left (time $t_a$, $t_d$, $t_f$ in the data of FIG. 8, time at which each person has left the article in FIG. 9). As a result of the left-article danger degree determination step SB107 executed on the article already left at the time point the operation of the danger notifying device 401 (danger determining device 400) is started, notification may be made only to the person defined in advance (e.g., mother having person ID=3, father of person ID=4), or notification may be made to all the notifying equipments installed in the environment to be watched over or to all the notifying equipments carried by the individual so that notification is made to everyone in the environment (space) to be watched over when notifying danger since the person who left the article is often distant from the relevant location.

The left-article danger degree determining means 130 determines dangerous when the information on the combination of the ID of the person present in the environment to be watched over and the ID of the article determined as being left by the article-leaving-operation determining means 120 and the dangerous combination information stored in the dangerous article database 200 match, and determination is made that the person in the environment to be watched over is accessible to the position of the article determined as being left by the article-leaving-operation determining means 120 from the information stored in the accessible location database 210, but the following conditions may be further added. Determination is made as dangerous if a condition that the time until the person (e.g., infant) in the environment to be watched over reaches the left dangerous article is smaller than the time until the person who has left the article or the person set in advance reaches the dangerous article is further satisfied. In other words, determination is made as not dangerous if the person who has left the article or the person set in advance can reach the dangerous article faster. Thus, the trouble of notifying when the person who left the article temporarily places the dangerous article based on the knowledge that the infant is far away can be reduced. The time until the person reaches the article is calculated based on the position information of the person and the article stored in the sensing history database 220, and the movement speed for every person ID. In place of such calculation, a movement speed database as shown in FIG. 32 prepared separately in advance can be used for the movement speed. For instance, an average movement speed and a maximum speed for every person ID in the environment can be obtained in advance, and such speed obtained in advance can be used as the movement speed for every person ID. The movement speed at a relevant point can be obtained and used from the position history information of a person stored in the sensing history database 220. When such additional conditions are used, determination is not made as dangerous immediately after the person leaves the dangerous article, but determination is made as dangerous between when the person who left the article moves away from the dangerous article and immediately before the infant reaches the dangerous article faster. As a setting for safety, the time until the person (e.g., infant) in the environment to be watched over reaches the left dangerous article is desirably smaller than the value obtained by adding a predetermined time (positive time) to the time until the person who left the article or the person (e.g., mother) set in advance reaches the left dangerous article. In other words, the person who left the article or the person set in advance can reach the left dangerous article faster than the person in the environment to be watched over.

In the flowchart of FIG. 13 described above, a processing loop (steps SB104 to SB110) on all the articles present in the environment (space) to be watched over is executed for every focusing person ID=i. Such process is sufficient if the processing ability of the danger determining device 400 is sufficiently ensured on the number of articles, but otherwise, the following process can be performed by the control of the controlling means 310. Before executing step SB101, all the person IDs in the environment to be watched over are acquired, and are referred to as group A. The left-article danger degree determining means 130 references the dangerous article database 200 as shown in FIG. 10, so that all the dangerous articles on the person ID, which is an element of the group A, are extracted by the left-article danger degree determining means 130, and then are referred to as group B. In steps SB101, SB111, the person ID=i to be processed is selected from the group A by the article-leaving-operation determining means 120. In steps SB103, SB109, the article ID=j to be processed is selected from the group B by the article-leaving-operation determining means 120. The person and the article to be processed can be limited by adding such change to the flowchart of FIG. 13, and the processing amount in the danger determining device 400 can be reduced.

The flowchart of FIG. 13 is repeatedly executed in correspondence to step SA102 in the flowchart of FIG. 12, but depending on the processing ability of the danger determining device 400, after processes from step SB103 to step SB110 are executed on a certain person, the time interval until executing the process from step SB103 to step SB110 on the relevant person sometimes becomes long. In this case, countermeasures such as increasing the frequency of executing the process from step SB103 to step SB110 for the person who is likely to leave the article may be taken by the control of the controlling means 310. For instance, if the grandfather of person ID=1 tends to recently have a short memory and has a high possibility of leaving the article, the processes from step SB103 to step SB110 are executed in the order of grandfather having person ID=1→grandmother having person ID=2→father having person ID=3→mother having person ID=4→child 1 (first child) having person ID=5→child 2 (second child) having person ID=6, and thereafter as a next loop, the above processes are not executed in the same frequency with respect to all the people of grandfather having person ID=1→ . . . , and the controlling means 310 may perform an operation control so that the frequency of executing the processes increases on the grandfather having ID=1 such that grandfather having person ID=1→grandmother having person ID=2→father having person ID=3→grandfather having person ID=1→mother having person ID=4→child 1 having person ID=5→grandfather having person ID=1→child 2 having person ID=6→(next loop) grandfather having person ID=1→ . . . .

Figures 15, 16A:
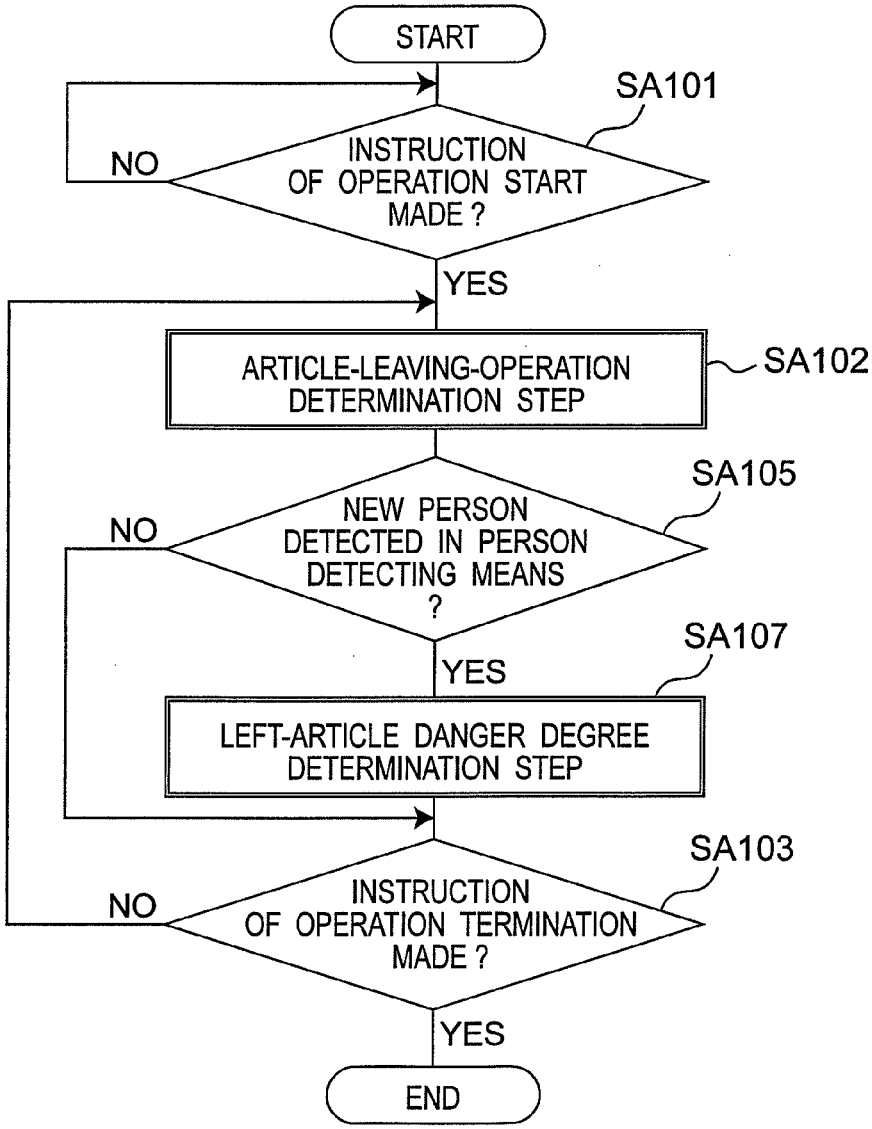
FIG. 15 is a view showing an example of a storage form of an article handling flag according to the first embodiment of the present invention.
FIG. 16A is a flowchart of a danger notification method where left-article danger degree determination is performed every time a person is detected according to the first embodiment of the present invention.

In the first embodiment, the left-article danger degree determination step is executed by the left-article danger degree determining means 130 at the time the article is left, but the left-article danger degree determination step (step SB107) may be executed by the left-article danger degree determining means 130 at the time a new person is detected (step SA105) by the person detecting means 110 using the flowchart of FIG. 16A in place of the flowchart of FIG. 12. For instance, assume that during the execution of the flowchart of FIG. 12, the person of person ID=P is outside (i.e., person having person ID=P not present in the environment to be watched over) at the relevant time in step SC102 although the person of person ID=P having a possibility of posing danger on the left article is registered in the dangerous article database 200 (determined as Yes in step SC101). If the left-article danger degree determination step is executed by the left-article danger degree determining means 130 only at the time the article is left, a possibility of posing danger arises at the point the person having person ID=P returns home (i.e., at the point the person having person ID=P enters the environment to be watched over to be in the environment to be watched over). Therefore, using the flowchart of FIG. 16A, it is desirable to execute the left-article danger degree determination step SB107 by the left-article danger degree determining means 130 even when a new person is detected in the person detecting means 110 in step SA105. In the case of the left-article danger degree determination step SB107 called out from the flowchart of FIG. 13, the left-article danger degree determination step is executed by the left-article danger degree determining means 130 only on the left article, but in the case of the left-article danger degree determination step SB107 executed after step SA105 in FIG. 16A, steps after SC101 need to be executed by the left-article danger degree determining means 130 on all the articles left at the relevant point. The steps SA101, SA102, and SA103 in FIG. 16A are similar to the respective steps of FIG. 12, and thus the description will be omitted.

Figures 1B, 1C:
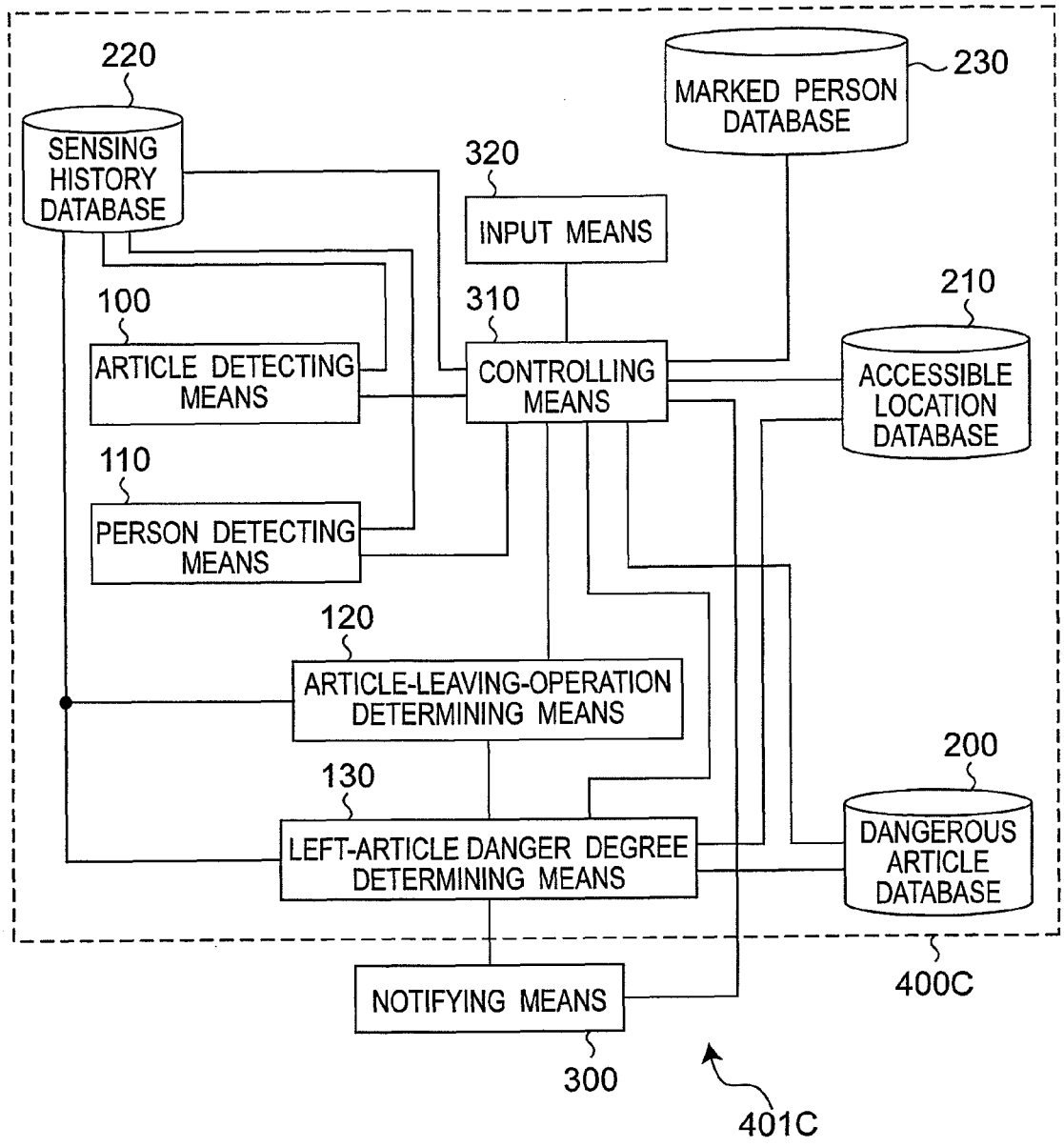
FIG. 1B is a block diagram showing another configuration example of a danger determining device and a danger notifying device according to the first embodiment of the present invention.
FIG. 1C is a view showing one example of information stored in a marked person database of the danger determining device the danger notifying device in FIG. 1B.
Figure 16B:
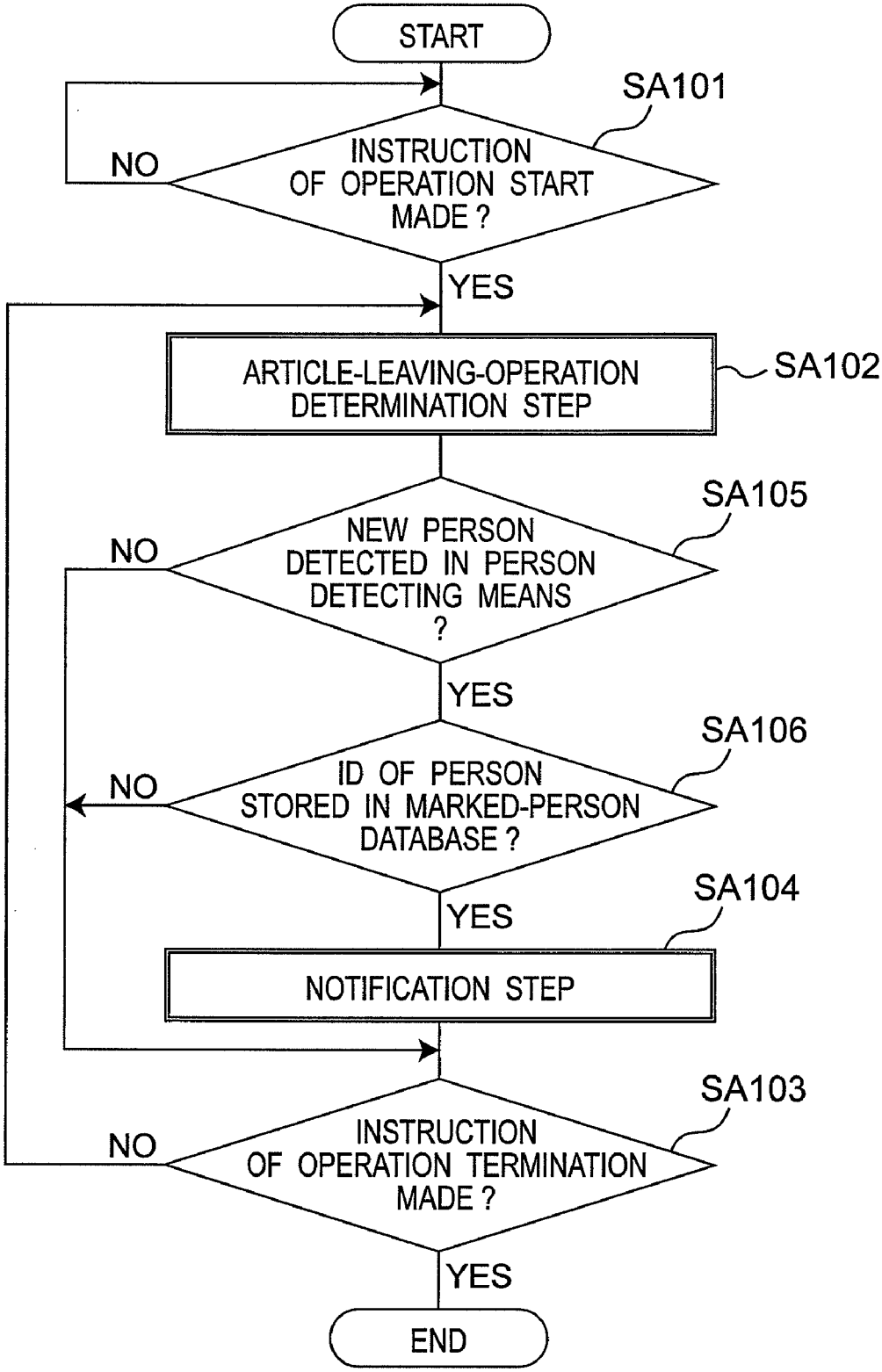
FIG. 16B is a flowchart of a danger notification method where notification is made every time a person is detected according to another example of the first embodiment of the present invention.

The flowchart of FIG. 16B may be used in place of FIG. 16A. Here, the danger determining device 400C and the danger notifying device 401C shown in the block diagram of FIG. 1B may be used in place of those of FIG. 1A with the flowchart of FIG. 14B in place of that of FIG. 14A. In FIG. 1B, the devices are the same as the danger determining device 400 and the danger notifying device 401 of FIG. 1A other than that a marked person database 230 is newly arranged to be connected to the controlling means 310.

FIG. 1C shows an example of information stored in the marked person database 230. Information represented by a set of person ID and dangerous article ID with respect to the relevant person ID is stored in the marked person database 230. Information of one set of the person ID=6 and the article ID=0008 is only recorded in the marked person database 230 of FIG. 1C, but information of a plurality of sets such as a set of the same person ID and a different article ID, a set of a different person ID and article ID, and the like may be recorded in the marked person database 230. The marked person database 230 will be described again when describing the operation using the flowchart.

The operation of the danger determining device 400C and the danger notifying device 401C of FIG. 1B will be described using the flowchart of FIG. 16B.

First, the operation of step SA101 in FIG. 16B is the same as the operation of step SA101 in FIG. 16A, and thus the description will be omitted.

Figure 14B:
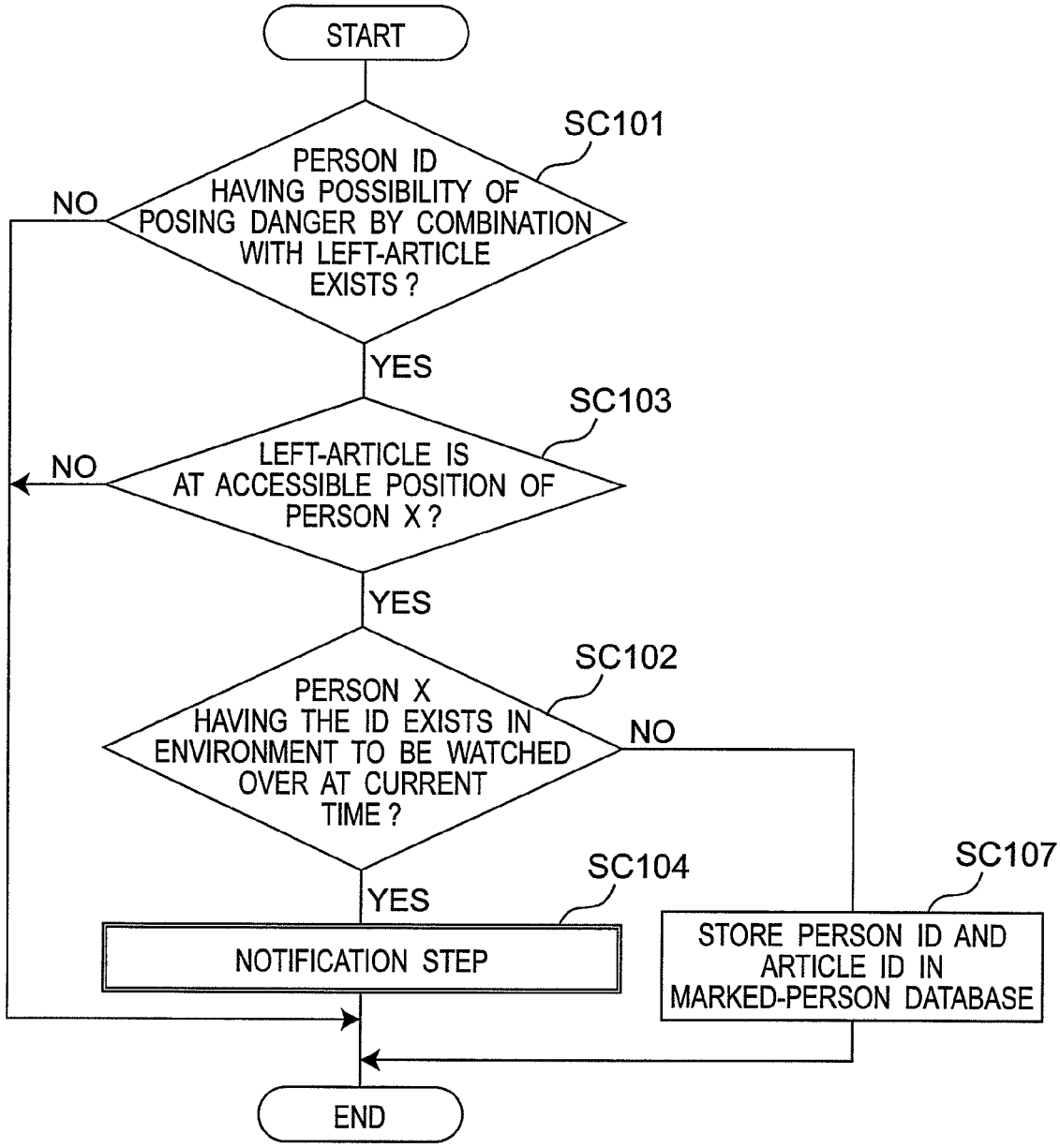
FIG. 14B is a flowchart of the left-article danger degree determination step according to another example of the first embodiment of the present invention.

The article-leaving-operation determination step SA102 is then executed, but the flowchart of FIG. 13 will be executed as the article-leaving-operation determination step. The flowchart of FIG. 13 is the same as when called out from the flowchart of FIG. 16A other than that the flowchart of FIG. 14B is executed in the left-article danger degree determination step SB107, and thus the description of steps other than the left-article danger degree determination step SB107 will be omitted. In FIG. 14B (correspond to left-article danger degree determination step SB107), step SC101, step SC103, and step SC102 are executed by the left-article danger degree determining means 130 in this order. The order of execution differs from FIG. 14A, but the processing content of each step is the same. In the flowchart of FIG. 14A, the notification step SC104 is executed if determined as Yes in all of step SC101, step SC102, and step SC103, and the process is terminated without executing the notification step SC104 if determined as No in one of the steps. The flowchart of FIG. 14B, on the other hand, is the same as FIG. 14A in that the notification step SC104 is executed if determined as Yes in all of step SC101, step SC102, and step SC103, but step SC107 is executed if determined as No in step SC102 after determined as Yes in step SC101 and step SC103.

If determined as No in step SC101, and if determined as No in step SC103, the above processes are terminated.

In step SC107, information of a set of left article ID and person ID who may be dangerous to the relevant article and who is not present in the environment to be watched over at the current time is stored in the marked person database 230 through the controlling means 310 by the left-article danger degree determining means 130, and the above processes are terminated. Example of information stored in the marked person database 230 is shown in FIG. 1C.

Return now to the description of the flowchart of FIG. 16B. The determination of step SA105 is the same as that of step SA105 in FIG. 16A. The process proceeds to step SA106 if determined as Yes in step SA105, and the process proceeds to step SA103 if determined as No in step SA105.

In step SA106, whether the person ID of the person newly detected in step SA105 is stored in the marked person database 230 is determined by the left-article danger degree determining means 130. If the person ID of the person newly detected in step SA105 is determined to be stored in the marked person database 230 by the left-article danger degree determining means 130, for example, if the information as shown in FIG. 1C is stored in the marked person database 230 and the person of person ID=6 is determined to be newly detected by the left-article danger degree determining means 130, the notification step SC104 is executed by the notifying means 300.

The person ID of the person and the ID of the article not present in the target to be watched over which may be a dangerous combination on the left article at the time of executing step SC107 of FIG. 14B are stored in the marked person database 230, and thus if a new person is detected in step SA105 of FIG. 16B and if determined that the relevant person is stored in the marked person database 230 by the left-article danger degree determining means 130 in step SA106, the notification step SC104 is immediately executed by the notifying means 300, whereby a safer danger notifying device is provided.

According to the danger determining devices 400, 400C described above, even if the left article is stored as the dangerous article by the dangerous article database 200, it is not determined as dangerous if a person having a possibility of posing danger in combination (dangerous combination information) with the article is not present in the environment to be watched over, and even if the person having a possibility of posing danger in combination with the relevant article is present in the environment to be watched over, determination is not made as dangerous if the article is left at a location not accessible by the relevant person by the accessible location database 210, and thus the determination accuracy on the dangerous state can be enhanced.

According to the danger notifying devices 401, 401C using the danger determining devices 400, 400C, notification is made to the person who has left the article or the person set in advance only if determined as dangerous by the danger determining device 400, and thus the trouble of being notified every time when the article is simply left is reduced.

Modification of First Embodiment

In the first embodiment, the accessible location database 210 as shown in FIG. 11A and FIG. 11B is used. In particular, the accessible location database 210 of FIG. 11A defines the position information of the height that can be reached by hand according to the height of the person as accessible location AA. According to such accessible location database 210, determination is made that high places cannot be accessed (cannot be reached by hand) since the infant is short. However, if infants are of a certain age, the hand of the infant can reach places higher than the height the hand of the infant can reach in normal time (when articles such as footstep is not used) if the infants use articles such as footstep, chair, or the like. In the modification of the first embodiment, the danger determining device 400 and the danger notifying device 401 that can respond to such cases are provided. In the present specification, articles such as footstep and chair are referred to as "furnishing" to be distinguished from articles to be determined of danger by the combination (dangerous combination information) with the ID of the person described in the first embodiment. Regarding such "furnishing", the ID and the position information of the "furnishing" can be detected in the article detecting means 100.

The configurations of the danger determining device 400 and the danger notifying device 401 are the same as the first embodiment (FIG. 1A), and thus the description thereof will be omitted. The left-article danger degree determining means 130 executes the flowchart of FIG. 17 in place of the flowchart of FIG. 14A. The left-article danger degree determining means 130 in the modification of the first embodiment simultaneously detects the ID of the furnishing that exists near the left article and that may serve as a footstep in addition to the ID and the position information of the left article and the ID of the person present in the environment to be watched over, and determines the degree of danger using such information.

Figure 17:
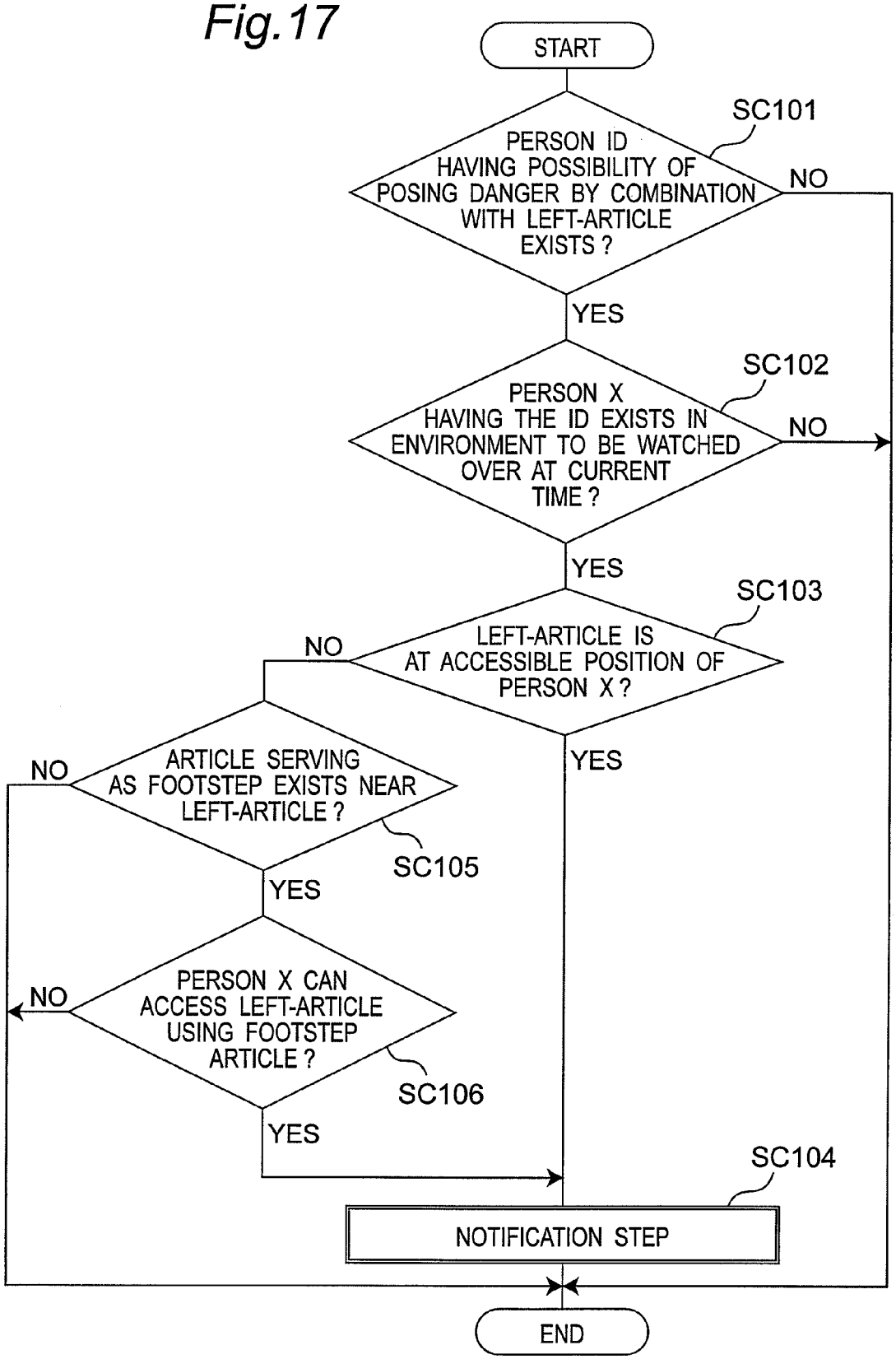
FIG. 17 is a flowchart of a danger notification method according to a modification of the first embodiment of the present invention.

Description will be made using the flowchart of FIG. 17.

The operations of steps SC101, SC102 are the same as steps SC101, SC102 of FIG. 14A of the first embodiment, and thus the description thereof will be omitted.

Next, in step SC103, if determined by the left-article danger degree determining means 130 that the person (person of person ID=P) having a possibility of posing danger by combination (dangerous combination information) with the article is present in step SC101, whether or not the left article is at the accessible location of the person P is determined by the left-article danger degree determining means 130. In determination, position information of the left article stored in the sensing history database 220, and information on the accessible location of the person stored in the accessible location database 210 are used by the left-article danger degree determining means 130. The process proceeds to step SC104 if determined as Yes in step SC103 by the left-article danger degree determining means 130. The process proceeds to step SC105 if determined as No in step SC103 by the left-article danger degree determining means 130.

Figures 18A, 18B:
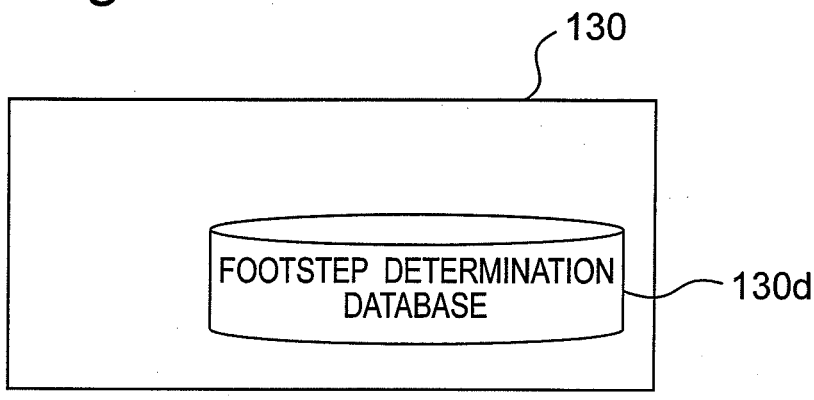
FIG. 18A is a view showing an example of a storage format of the footstep flag.
FIG. 18B is a view showing that a footstep determination database storing the footstep flag is arranged in the left-article danger degree determining means.

In step SC105, whether or not a furnishing that serves as a footstep exists near the left article is determined by the left-article danger degree determining means 130. The process proceeds to step SC106 if determined as Yes in step SC105 by the left-article danger degree determining means 130, and the left-article danger degree determination process is terminated and the process proceeds to step SB108 in FIG. 13 if determined as No in step SC105 by the left-article danger degree determining means 130. First, the furnishing that exists within a predetermined distance from the position ($X_A$,$Y_A$, $Z_A$) of the left article and that serves as a footstep is extracted by the left-article danger degree determining means 130 from the information stored in the sensing history database 220. Whether or not the furnishing serves as the footstep is set in advance for all the articles as shown in FIG. 18A, and the information thereof is stored in the left-article danger degree determining means 130. FIG. 18A shows an example of a footstep determination database 130*d* set with a flag ("ON" if serving as footstep, and "OFF" if not) representing whether or not the furnishing serves as a footstep, height of a footstep surface when used as a footstep, and a threshold value of a distance for determining whether or not within a predetermined distance from the left article with respect to all the articles. As shown in FIG. 18B, the footstep determination database 130*d* is arranged in the left-article danger degree determining means 130, and footstep flag, height information as a footstep, and threshold value of a distance are stored in the footstep determination database 130*d* as information related to footstep determination. The threshold value of the distance (distance threshold value) differs for every ID of the furnishing that can serve as a footstep for the following reasons. The threshold value of the distance is set small for heavy objects such as sofa SF2 and fixed furniture since they cannot be easily moved by infants. The threshold value of the distance is set large for chairs CH1 to CH4 for dining table, and the like of light weight since they can be easily moved by infants. Determination on whether or not within the predetermined distance is made by the left-article danger degree determining means 130 using the threshold value in FIG. 18A, and the position information for every furnishing ID stored in the sensing history database 220.

In FIG. 18A, the footstep flag and the distance threshold value are determined for every furnishing ID, but may be set for every person ID. Even for articles (furnishing) that may serve as a footstep, there is a possibility that a specific person may not be able to climb thereon due to the height etc. thereof. The footstep flag is arranged for every person ID, and with respect to the article (furnishing) on which the person cannot climb thereon, the footstep flag related to the relevant person is set to OFF, or the threshold value of the distance related to the relevant person may be set to infinitely large in the threshold value of the distance for every person ID.

In step SC106, the person P uses the furnishing serving as a footstep, and whether or not the left article is accessible is determined by the left-article danger degree determining means 130. The process proceeds to step SC104 if determined as Yes by the left-article danger degree determining means 130, and the left-article danger degree determination process is terminated and the process proceeds to step SB108 in FIG. 13 if determined as No by the left-article danger degree determining means 130.

For instance, assume a case in which the dangerous article database 200 stores the information of FIG. 10, and the cigarette of article ID=0025 is left at height of 80 cm from the foot, and child 2 of person ID=6 is in the environment (space) to be watched over. If the accessible location database stores the information of FIG. 11A, the child 2 of person ID=6 cannot access the position (height 80 cm) of the cigarette of article ID=0025 since the accessible location AA is less than a height of lower than 70 cm from the foot according to FIG. 11A, and thus determination is made as No (not dangerous) in step SC103 by the left-article danger degree determining means 130. However, if the furnishing (article ID=0006) that serves as a footstep exists at a position of distance 30 cm from the position at where the cigarette is left, determination is made as Yes in step SC105 by the left-article danger degree determining means 130.

In step SC106, the following determination is made by the left-article danger degree determining means 130. From the database of FIG. 18A, it can be determined that the height of 30 cm is obtained if the furnishing of article ID=0006 is used as a footstep, by the left-article danger degree determining means 130. If the child 2 of person ID=6 climbs on the footstep, calculation can be made by the left-article danger degree determining means 130 that in addition to 70 cm (less) that can be originally reached by hand, places (height of less than 100 cm) higher by the height 30 cm of the footstep can be reached by hand. Therefore, determination is made by the left-article danger degree determining means 130 that the child 2 of person ID=6 can access the cigarette of article ID=0025 at a height of 80 cm. Therefore, the notification step SC104 is executed by the notifying means 300. The notifying operation of the notification step SC104 is the same as in the first embodiment, and thus the description thereof will be omitted.

In FIG. 24A to FIG. 24F of the first embodiment, an example of defining the accessible area AA using the two-dimensional coordinate value and the height has been described, but the accessible area AA of when the footstep FS is used will be described using FIG. 26A and FIG. 26B. FIG. 26A is a view showing a state in which the infant IF is accessing the table TL using the footstep FS when the table TL same as that in FIG. 24A is arranged. FIG. 26B is a view showing a state in which an accessible area AA−1 is added to the accessible area AA of FIG. 24B when the infant IF climbs on the footstep FS. In FIG. 26B, a circle of a predetermined radius having the position of the footstep FS as a center is added as the accessible area AA−1. The radius of the circle may be determined in view of the height of the footstep FS, the height and the length of the arm of the infant IF, and the like.

According to the danger determining device 400 described above, danger determination is made in view of the furnishing that can serve as the footstep FS existing near the left article, and thus the determination accuracy of the dangerous state can be enhanced.

An example in which the accessible location changes according to the relationship of the position at where the article is left and the furnishing (footstep in the above description) nearby has been described, but this concept is also applicable to the following examples. Consider a case where a tablecloth is placed on the table top plate TB, and an article is left on the tablecloth. Even if the hand of the infant cannot directly reach the position of the left article, the infant can pull the tablecloth to move the article closer so that the infant can access the article. This case can be responded by reading the tablecloth near the left article by means of the article detecting means 100 of RFID etc., and changing the content of the accessible location database 210 according to the read result by the left-article danger degree determining means 130. Specifically, if the tablecloth is detected simultaneously with the article at a certain location, the accessible flag corresponding to such location may be changed to ON in the accessible location database as shown in FIG. 11B.

A case in which, depending on the furnishing such as table on which the article is placed, the article placed on the table might drop from the table when the infant rocks or tilts the table is considered. In this case, the infant can actually access the article on the table even if the place on the table cannot be accessed by the infant in terms of position. If the weight ratio of the infant with respect to the weight of the table is larger than a predetermined value, or if the table top plate is slippery, customization of the accessible location database may be performed such as setting the place on the table as the accessible location of the infant regardless of the height of the table. This customization can be performed by inputting the above information through the input means 320, and making a determination by the left-article danger degree determining means 130. The slipperiness of the tabletop plate is determined based on, for example, the friction coefficient between the standard object and the table surface.

According to the danger notifying device 401 using the danger determining device 400, the determination accuracy of the dangerous state is enhanced, and thus notification can be made even on a state that cannot be determined as dangerous in the first embodiment, whereby an effect of preventing danger in advance enhances.

Second Embodiment

In a second embodiment of the present invention, a danger determining device 400B and a danger notifying device 401B that can respond to the growth of an infant will be described.

The daily growth of an infant is very fast, and even guardians are amazed by the growth of the infant on knowing "the infant can now reach where the infant could not reach until yesterday". In such situation, the danger determining device 400B of the second embodiment determines the risk of accident by the dangerous article placed at the location the guardian assumes the infant "cannot reach" by an infant who can now reach certain places without realizing due to growth. The danger notifying device 401B of the second embodiment notifies the notifying means 300 of the danger determined by the danger determining device 400B to prevent accidents beforehand.

Figure 19:
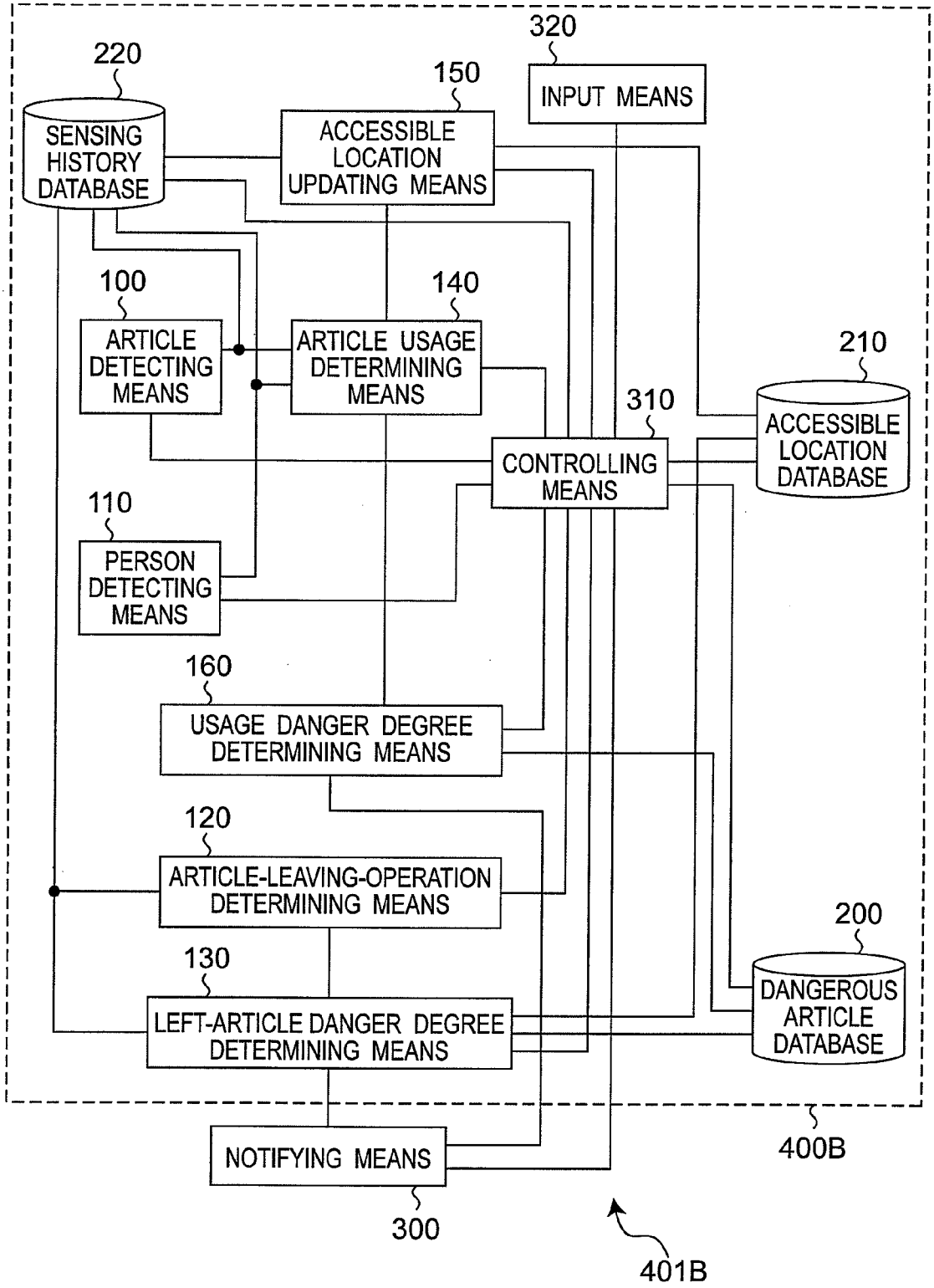
FIG. 19 is a block diagram showing a configuration example of a danger determining device and a danger notifying device according to a second embodiment of the present invention.

FIG. 19 is a block diagram showing configurations of the danger notifying device 401B including the danger determining device 400B according to the second embodiment of the present invention. In FIG. 19, the danger notifying device 401B includes the article detecting means 100, the person detecting means 110, the article-leaving-operation determining means 120, the left-article danger degree determining means 130, an article usage determining means 140, an accessible location updating means 150, a usage danger degree determining means 160, the dangerous article database 200, the accessible location database 210, the sensing history database 220, the notifying means 300, the controlling means 310, and the input means 320. The danger determining device 400B is configured by excluding the notifying means 300 from the above configuration. The danger determining device 400B of the second embodiment differs from the danger determining device 400 of the first embodiment in that the article usage determining means 140, the accessible location updating means 150, and the usage danger degree determining means 160 are arranged.

A state in which the danger notifying device 401B of the second embodiment of the present invention is installed in a room MR. of a house serving as an example of the environment to be watched over will be described using FIG. 2A similar to the first embodiment. In the room MR., furnishings such as a bookshelf BS, a cabinet CB, a low table LT, a sofa 1 SF1, a sofa 2 SF2, a dining table DT, chairs 1 to 4 CH1 to CH4, a refrigerator RF, and a kitchen system KS are arranged. Suppose the danger determining device 400B; the article detecting means 100 and the person detecting means 110, which are components of one part of the danger notifying device 401B; and the notifying means 300 which is a component of one part of the danger notifying device 401B are installed at the ceiling CL of the room RM. The input means 320 and the controlling means 310 are assumed to be installed on a wall face WL of the room RM. Other components such as the article-leaving-operation determining means 120, the left-article danger degree determining means 130, the article usage determining means 140, the accessible location updating means 150, the usage danger degree determining means 160, the dangerous article database 200, the accessible location database 210, and the sensing history database 220 may be arranged in the room MR. such as the ceiling CL as shown with a box denoted with a reference numeral 900 in FIG. 2A, or that which commonly operates with respect to a plurality of rooms MR. may be arranged at least one for one environment (e.g., one house) to be watched over. Some or all of the article-leaving-operation determining means 120, the left-article danger degree determining means 130, the article usage determining means 140, the accessible location updating means 150, the usage danger degree determining means 160, the dangerous article database 200, the accessible location database 210, and the sensing history database 220 may be installed outside the environment (e.g., house) to be watched over and connected by way of a communication line.

In the danger notifying device 401B of FIG. 19, the components denoted with the same reference numerals as the danger notifying device 401B of FIG. 1A have the same function with respect to each other, and thus the description thereof will be omitted.

The article usage determining means 140 is connected to the accessible location updating means 150, the controlling means 310, the article detecting means 100, the person detecting means 110, the sensing history database 220, and the usage danger degree determining means 160. The article usage determining means 140 uses the ID and the position information of the article detected by the article detecting means 100 and the ID and the position information of the person detected by the person detecting means 110 to detect the state a person is using an article in the environment (space) to be watched over. Here, "carrying the article" state is also included in "usage". The specific operation will be hereinafter described.

The accessible location updating means 150 is connected to the accessible location database 210, the controlling means 310, and the sensing history database 220. The accessible location updating means 150 updates the content of the accessible location database 210 for every furnishing ID. The specific information will be hereinafter described.

The usage danger degree determining means 160 is connected to the article-leaving-operation determining means 120, the dangerous article database 200, and the controlling means 310. When the article usage determining means 140 detects a state a certain person is using a certain article, the usage danger degree determining means 160 determines whether or not the relevant usage state is dangerous. The specific operation will be hereinafter described.

The operations of the danger determining device 400B and the danger notifying device 401B will be specifically described using the flowcharts of FIG. 20 to FIG. 23.

Figure 20:
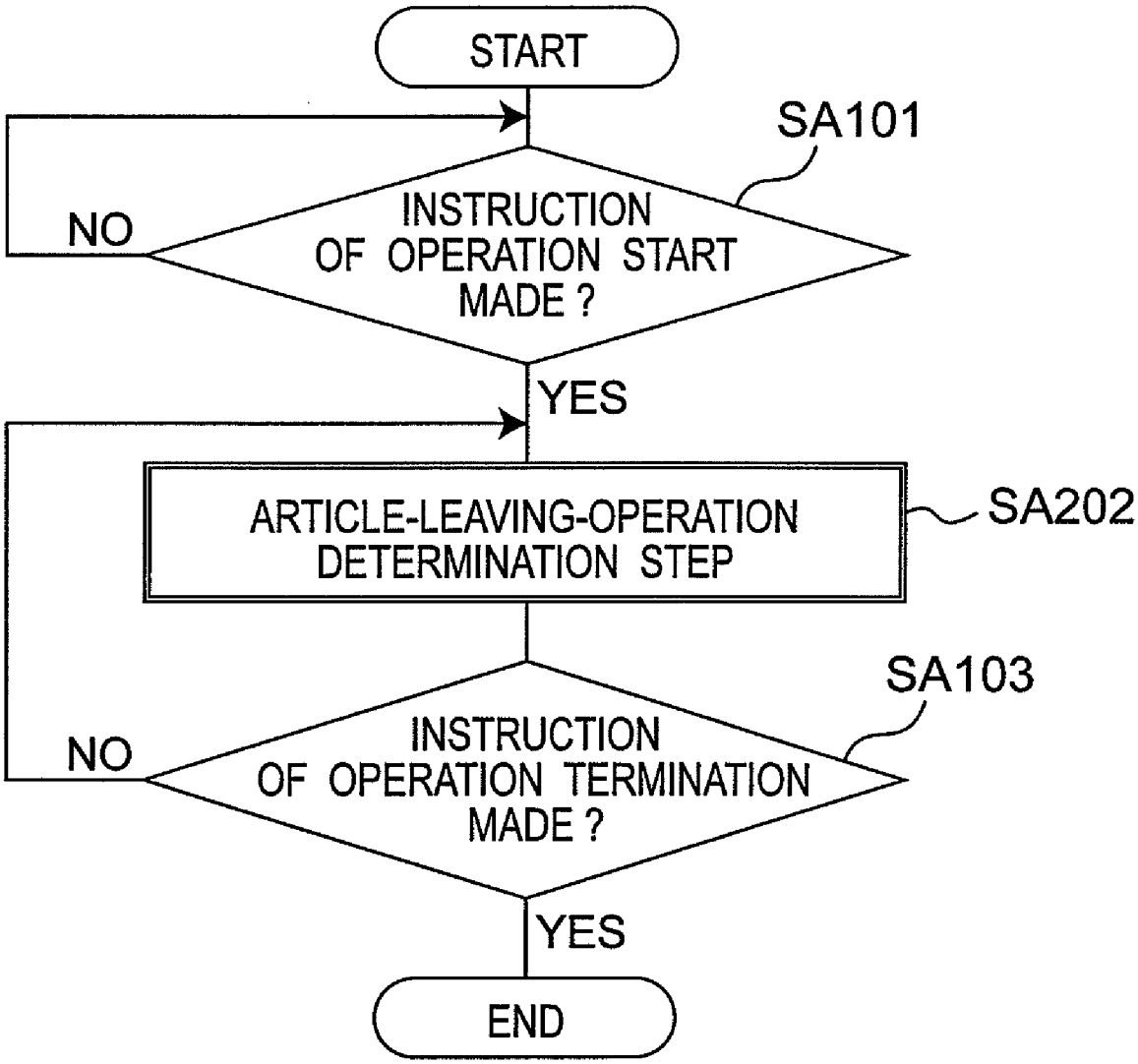
FIG. 20 is a flowchart of a danger notifying method according to the second embodiment of the present invention.

Steps SA101 and SA103 in FIG. 20 are executed by the controlling means 310 in the danger notifying device 401B of FIG. 19. In step SA101, when input of the instructing information of operation start to the input means 320 is waited and instruction of operation start is made by the manager of the danger notifying device 401B, the controlling means 310 starts the operation of the danger notifying device 401B, and an article-leaving-operation determination step SA202 is executed by the article-leaving-operation determining means 120.

Figure 21:
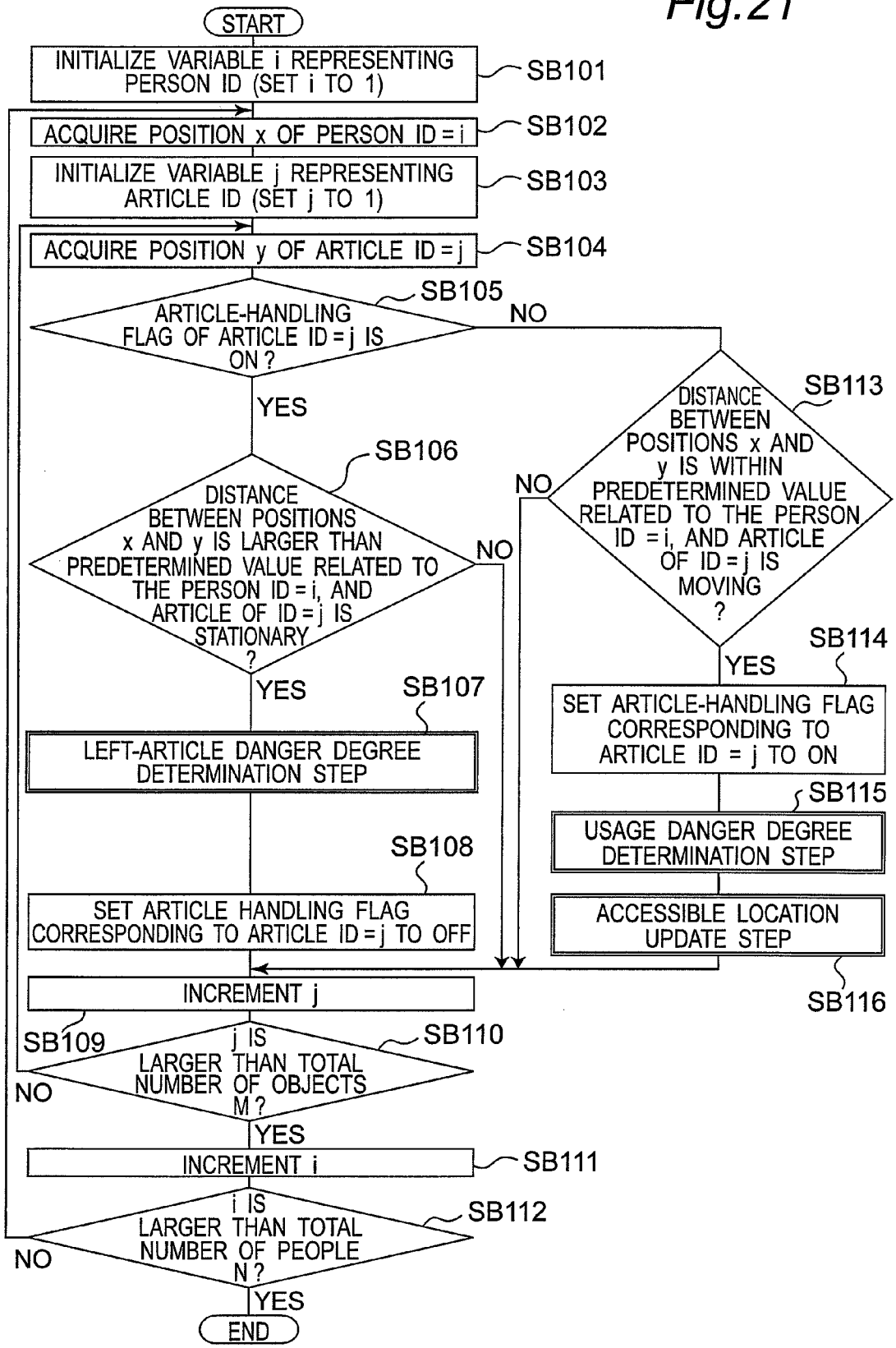
FIG. 21 is a flowchart of an article-leaving-operation determination step according to the second embodiment of the present invention.

The sub-step of the article-leaving-operation determination step SA202 is shown in steps SB101 to SB116 in the flowchart of FIG. 21. The article-leaving-operation determination step SA202 is executed by the article-leaving-operation determining means 120 excluding the subs-steps SB107, SB113, SB115, and SB116. The detailed operation of step SA202 will be hereinafter described using the sub-steps SB101 to SB116. In the flowchart of FIG. 21, the step SB120 in the flowchart of FIG. 13 of the first embodiment is omitted, but may be performed between step SB102 and step SB103.

In step SA103, when input of the instructing information of operation termination to the input means 320 is waited, and instruction of operation termination is made by the manager of the danger notifying device 401B, the operation of the danger notifying device 401 is terminated by the controlling means 310. That is, step SA202 is repeated unless the instructing operation of operation termination is input in step SA103.

The operation of the article-leaving-operation determination step SA202 in FIG. 20 will be described in detail using the flowchart of FIG. 21. The operations of steps SB101 to SB112 performed by the article-leaving-operation determining means 120 are the same as the operations of the respective steps in the flowchart of FIG. 13 of the first embodiment, and thus the description thereof will be omitted.

The operation of step SB113 is the same as step SB113 in the flowchart of FIG. 13 of the first embodiment, but is executed by the article usage determining means 140 in the second embodiment, where it is performed by the article handling determining means 123 in the article-leaving-operation determining means 120 in the first embodiment. This step SB113 is referred to as an article usage determination step.

The operation of step SB114 is the same as each step in the flowchart of FIG. 13 of the first embodiment. Step SB114 is executed by the article-leaving-operation determining means 120 similar to the first embodiment.

Figure 22:
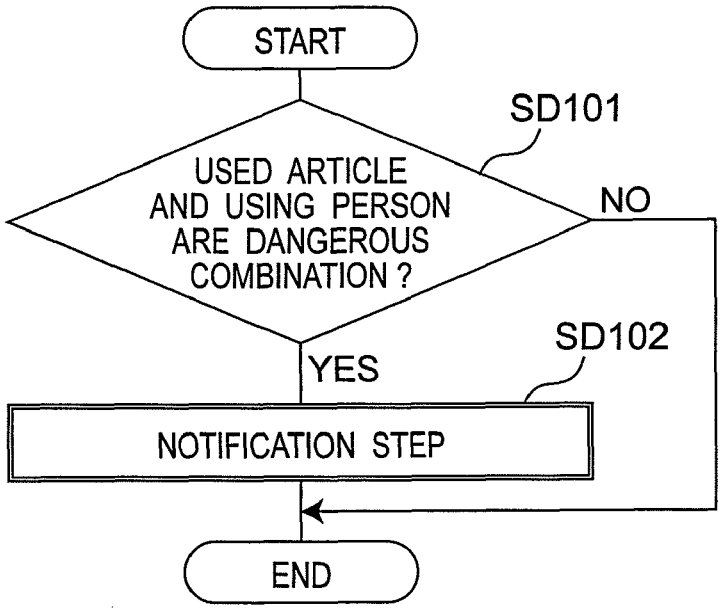
FIG. 22 is a flowchart of a usage danger degree determination step according to the second embodiment of the present invention.

The operation of the usage danger degree determination step SB115 executed by the usage danger degree determining means 160 in FIG. 21 will be described in detail using the flowchart of FIG. 22.

In step SD101, whether or not the used article ID and the using person ID are dangerous combination information (dangerous combination information) is determined by the usage danger degree determining means 160 by referencing the data (FIG. 10) stored in the dangerous article database 200 by the usage danger degree determining means 160. If the child 2 of person ID=6 is touching the cigarette of article ID=0025, determination is made as dangerous by the usage danger degree determining means 160. The process proceeds to step SD102 if determined as dangerous by the usage danger degree determining means 160, and the usage danger degree determination process is terminated and the process proceeds to the accessible location update step SB116 in the flowchart of FIG. 21 when not determined as dangerous by the usage danger degree determining means 160.

In the case of the danger determining device 400B not including the notifying means 300, the usage danger degree determination process is terminated without executing step SD102, and the process proceeds to the accessible location update step SB116 in the flowchart of FIG. 21.

The notification step of step SD102 is executed by the notifying means 300. In the notification step of the first embodiment, notification to the person who has left the article or the person set in advance is made by the notifying means 300 if determined that danger might be posed by such leaving by the left-article danger degree determining means 130, but in the notification step of the second embodiment, notification is made to the person set in advance by the notifying means 300. For instance, "using person, using article name (e.g., cigarette), using position" are notified to the mother by the notifying means 300. The possibility danger might occur from the article being used is greater than when being left, and thus the level of importance of notification is set high. For instance, when the notifying means 300 makes notification by voice, the volume is set larger than in the case of leaving. Even if the using person is an infant, if the infant has reached an age (about one year old) capable of understanding things, warning such as "dangerous", "don't touch the cigarette" and the like may be simultaneously made by the notifying means 300 on the infant using the same. If the infant is an age (less than one year old) not capable of understanding things, a means for causing distraction such as presenting voice, image, picture, etc. of interest to the infant using the dangerous article may be arranged as an example of the notifying means 300. If temporarily distracted from the dangerous article, a temporal extension until the person set in advance (e.g. mother) comes can be ensured.

The process proceeds to the accessible location update step SB116 in the flowchart of FIG. 21 after the notification step SD102 is terminated.

Figure 23:
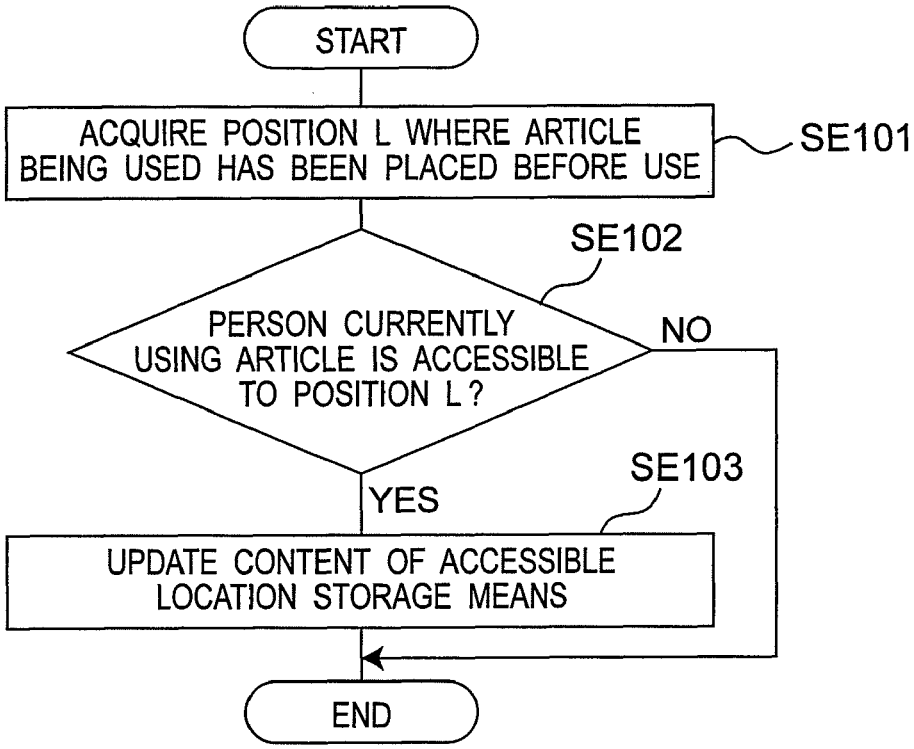
FIG. 23 is a flowchart of an accessible location update step according to the second embodiment of the present invention.

The operation of the accessible location update step SB116 in FIG. 21 will be described in detail using the flowchart of FIG. 23. Step SB116 (steps SE101 to SE103) are executed by the accessible location updating means 150.

In step SE101, the position L at where the currently using article has been placed before use is acquired by the accessible location updating means 150 from the sensing history database 220. The sensing history database 220 stores information shown in FIG. 6, so that the position L at where the currently using article has been placed before use is easily acquired by the accessible location updating means 150 by tracking back time. While tracking back time, the time of switching from a state the position of the article is changing to a state the position is stationary is searched by the accessible location updating means 150, and the stationary position can be used as the position L before use by the accessible location updating means 150. To determine whether in use or before use by the accessible location updating means 150, step SB106 in the flowchart of FIG. 13 of the first embodiment is used as the determining condition of "before use", and step SB113 is used the determining condition of "in use". That is, in step SB106, whether the distance between the current position x of the person having person ID=i and the current position y of the article having article ID=j is greater than a predetermined value (article handling threshold value) related to the person of person ID=i, and whether the article having article ID=j is stationary are determined by the article usage determining means 140. If determined that the distance between the current position x of the person having person ID=i and the current position y of the article having article ID=j is greater than the predetermined value (article handling threshold value) related to the person of person ID=i, and the article having article ID=j is stationary by the article usage determining means 140, the accessible location updating means 150 uses the stationary position of the article having article ID=j as the position L of "before use" of the article having article ID=j. In other determinations, it is not used as information of "before use". In step SB113, whether the distance between the current position x of the person having person ID=i and the current position y of the article having article ID=j is within the determined value (article handling threshold value) related to the person of person ID=i, and whether the article having article ID=j is moving are determined by the article usage determining means 140. If determined that the distance between the current position x of the person having person ID=i and the current position y of the article having article ID=j is within the determined value (article handling threshold value) related to the person of person ID=i, and the article having article ID=j is moving by the article usage determining means 140, the accessible location updating means 150 uses the article having article ID=j as "in use". In other determinations, it is not used as information of "in use".

In step SE102, whether the person currently using the article can access the position L is determined by the accessible location updating means 150, based on the information stored in the accessible location database 210. If determined as accessible by the accessible location updating means 150, the accessible location update process in the flowchart of FIG. 23 is terminated, and the process proceeds to step SB109 in the flowchart of FIG. 21. If determined as not accessible by the accessible location updating means 150, the process proceeds to step SE103.

In step SE103, the content of the accessible location database 210 is updated by the accessible location updating means 150. Thereafter, the process proceeds to step SB109.

Next, the description on the operation of steps SB115, SB116 will be made in the following example.

Consider a case where the person currently using the article is a child 2 of person ID=6, and the using article is a toy of article ID=425. If the dangerous article database 200 of FIG. 10 is used, determination is made that the person ID and the article ID are not dangerous combination (dangerous combination information) by the usage danger degree determining means 160 in step SD101. In step SE101, the position L ($X_B$, $Y_B$, $Z_B$) before use of a toy of article ID=425 is acquired by the accessible location updating means 150. The accessible location database 210 stores information (accessible location of child 2 of person ID=6 is less than height of 70 cm from foot) as shown in FIG. 11A. If the height $Z_B$ in the Z direction of the position L before use of the toy having article ID=425 is $Z_B$<70(cm), the child 2 of person ID=6 obviously can access the relevant toy, and thus the process proceeds to step SB109. If $Z_B$=75≧70 (cm), determination is made that the accessible range of the child 2 of person ID=6 is extending without realizing due to growth by the accessible location updating means 150. Thus, the accessible location of FIG. 11A is updated by the accessible location updating means 150. Since access is made to the position of height 75 cm in the past, the accessible location of person ID=6 is changed from "less than height of 70 cm from foot" to "less than height of 76 cm from foot" by the accessible location updating means 150. Access is merely made to the position of height of 75 cm in the past, but actually, there is a possibility higher places can be reached. When setting the danger notifying device 401 more on the safe side, the accessible location of person ID=6 is changed to "less than height of 80 cm from foot" by the accessible location updating means 150 so as to enlarge the accessible location in view of a margin of a certain extent. FIG. 25 shows one example of information stored in the accessible location database after change.

Consider a case where information such as FIG. 11B is stored in the accessible location database 210. Assume the position L ($X_B$, $Y_B$, $Z_B$) before use of a toy of article ID=425 is on the top plate of the cupboard CB. The child 2 having person ID=6 is set to be not capable of accessing the top plate of the cupboard CB (accessible flag is OFF), and thus update of information by the accessible location updating means 150 is necessary. In this case, the accessible flag corresponding to the top plate of the cupboard CB actually accessed by the child 2 having person ID=6 is updated to ON by the accessible location updating means 150, and furthermore, update is simultaneously performed by the accessible location updating means 150 on the location more easily accessed than the top plate of the cupboard CB. In the example of FIG. 11B, if the three-dimensional position coordinate ($x_5$, $y_5$, 85)-($x_6$, $y_6$, 85) of the top plate of the cupboard CB is accessible, the three-dimensional position coordinate ($x_1$, $y_1$, 75)-($x_2$, $y_2$, 75) of the dining table DT at a lower position is also accessible, and thus the accessible flag corresponding to the dining table DT is simultaneously updated to ON by the accessible location updating means 150. Here, determination by the accessible location updating means 150 on whether or not a location more easily accessed than the top plate of the cupboard CB is simply made as all accessible if at the position lower than the position of the top plate of the cupboard CB. In determination by the accessible location updating means 150 on whether or not a more easily accessible location, the region which distance from the edge of the table is smaller may be determined as the more easily accessible region with respect to the table of the same height.

In other words, the article usage determining means 140 determines, from the ID and the position information of the article and the ID and the position information of the person stored in the sensing history database 220, whether or not the person is using the article by whether or not the position of the article and the position of the person are within a predetermined value, and the accessible location stored in the accessible location database 210 is greatly changed by the accessible location updating means 150, so that the following operation is performed.

That is, the accessible location updating means 150 updates the content of the accessible location database to, acquire, from the sensing history database 220, before-use position information of where the article is placed before use by the person based on the ID of the article if determined that the person is using the article in the environment to be watched over by the article usage determining means 140;

determine whether or not the person is able to access the before-use position related to the before-use position information of the article, from the ID and the position information of the person present in the environment to be watched over, and the ID and the position information of the article determined as being left by the article-leaving-operation determining means 120 stored in the sensing history database 220, and the information on the accessible location stored in the accessible location database 210; and store in the accessible location database 210, according to the information of the accessible location stored in the accessible location database 210, information of being the accessible location with respect to all the before-use position information of the article and the information of accessible location same as the before-use position of the article or more easily accessible than the before-use position information stored in the accessible location database 210 if the before-use position of the article is not the accessible location and determined as not accessible for the person.

The height from the foot is used in FIG. 11A and the three-dimensional position coordinate is used in FIG. 11B as a measure for representing whether accessible or not, but other measures may be used. For instance, when expressing the access difficulty level to the inside of the shelf with door, the type (sliding door, hinged door), the type/shape of the door handle, the height of the door handle, and the like may be used. Similarly, when a door exists before reaching a location, the type (sliding door, hinged door), the type/shape of the door, the height of the door, and the like may be used. In the course of growth, the infants learn about various things such as the manner of opening the door through experience, but sometimes in the middle of growth, a state in which the hinged door can be opened but the sliding door cannot be opened arises. In order to respond to such state, the access difficultly level of the location of the accessible location database 210 can be expressed using the above index.

Figure 30A:
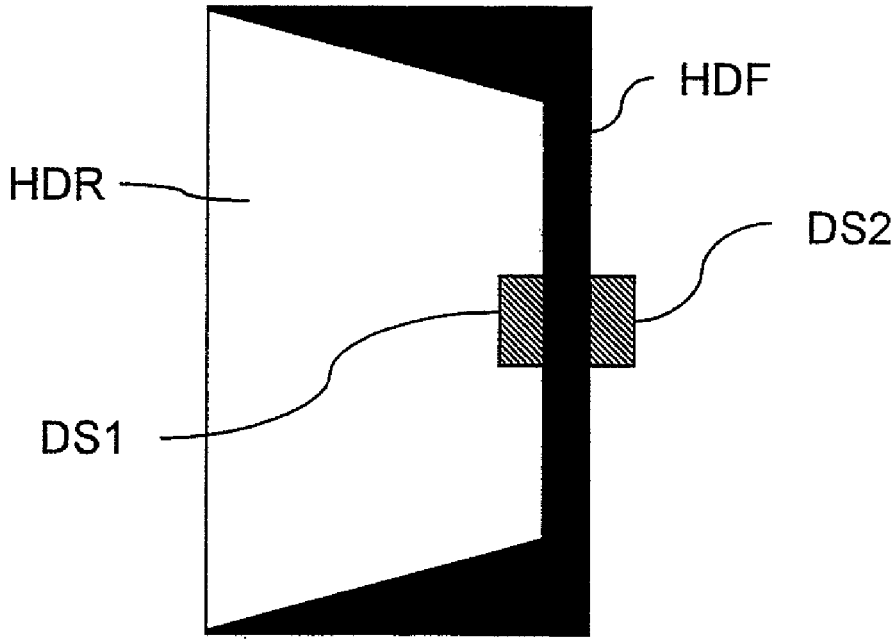
FIG. 30A is a view showing an example in which a door open/close sensor is arranged on a hinged door.
Figure 30B:
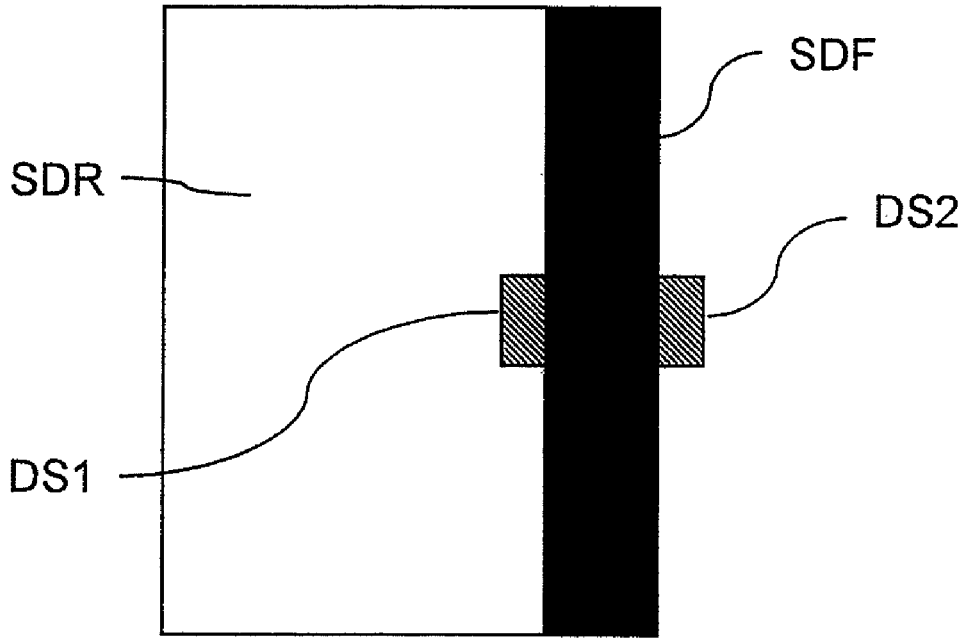
FIG. 30B is a view showing an example in which a door open/close sensor is arranged on a sliding door.
Figure 31A:
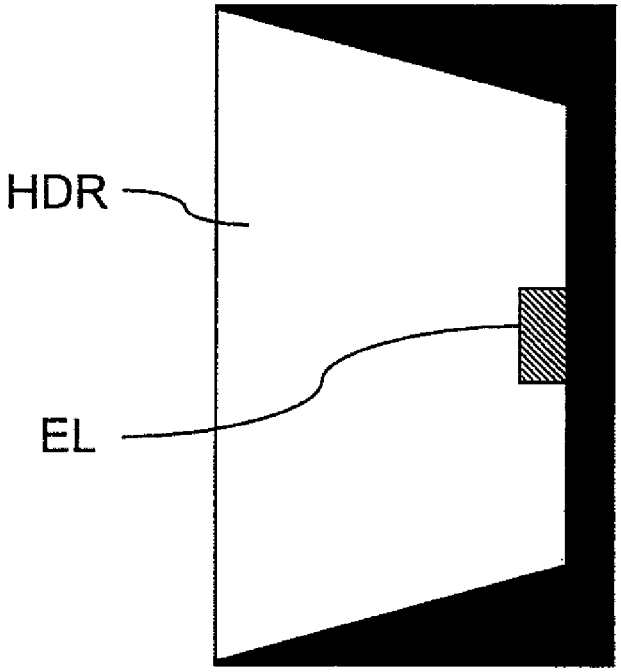
FIG. 31A is a view showing an example in which an electronic lock is arranged on a hinged door.
Figure 31B:
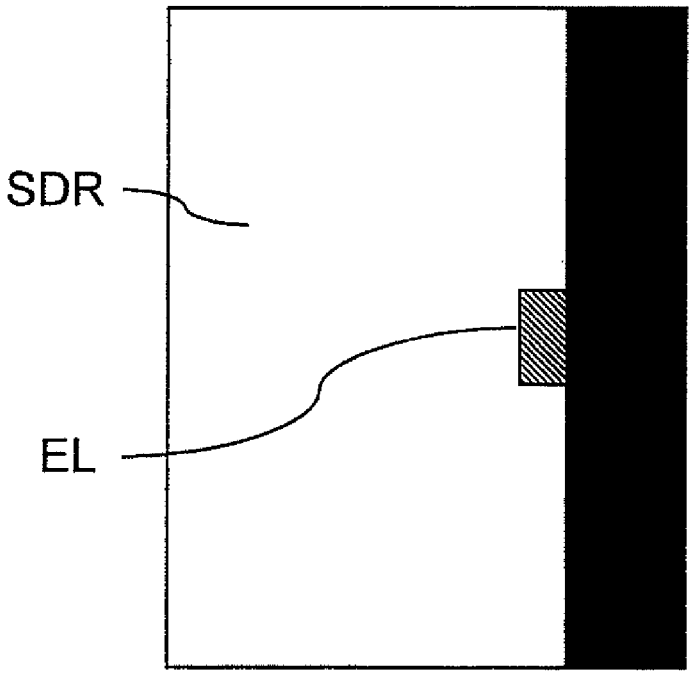
FIG. 31B is a view showing an example in which an electronic lock is arranged on a sliding door.

The open/close state of the door and the locking state of the key may be sensed using a separately prepared sensor, and whether accessible or not can be determined using such information. In this case, the determination result on whether dangerous or not changes every time the open/close state of the door or the locking state of the key changes, and thus the left-article danger degree determination step SB107 is executed every time a new person is detected in SA105 of FIG. 16A, and the left-article danger degree determination step is executed every time the open/close state of the door or the locking state of the key changes. An example in which the sensor for detecting the open/close state of the door is arranged is shown in FIG. 30A and FIG. 30B. FIG. 30A is a view for the hinged door HDR, and FIG. 30B is a view for the sliding door SDR. In FIG. 30A and FIG. 30B, a pair of door open/close sensors DS1, DS2 is arranged at the door HDR or SDR and the door frame HDF or SDF. A type for detecting the contact electrically, a type for detecting open/close optically with a set of light source and sensor, or the like may be used for the door open/close sensors DS1, DS2. The locking state of the key can be detected using a general electronic lock. An example in which the electronic lock EL is arranged at the door HDR or SDR is shown in FIG. 31A and FIG. 31B. FIG.

31A is a view for the hinged door HDR, and FIG. 31B is a view for the sliding door SDR.

Modification of Second Embodiment

Figure 29:
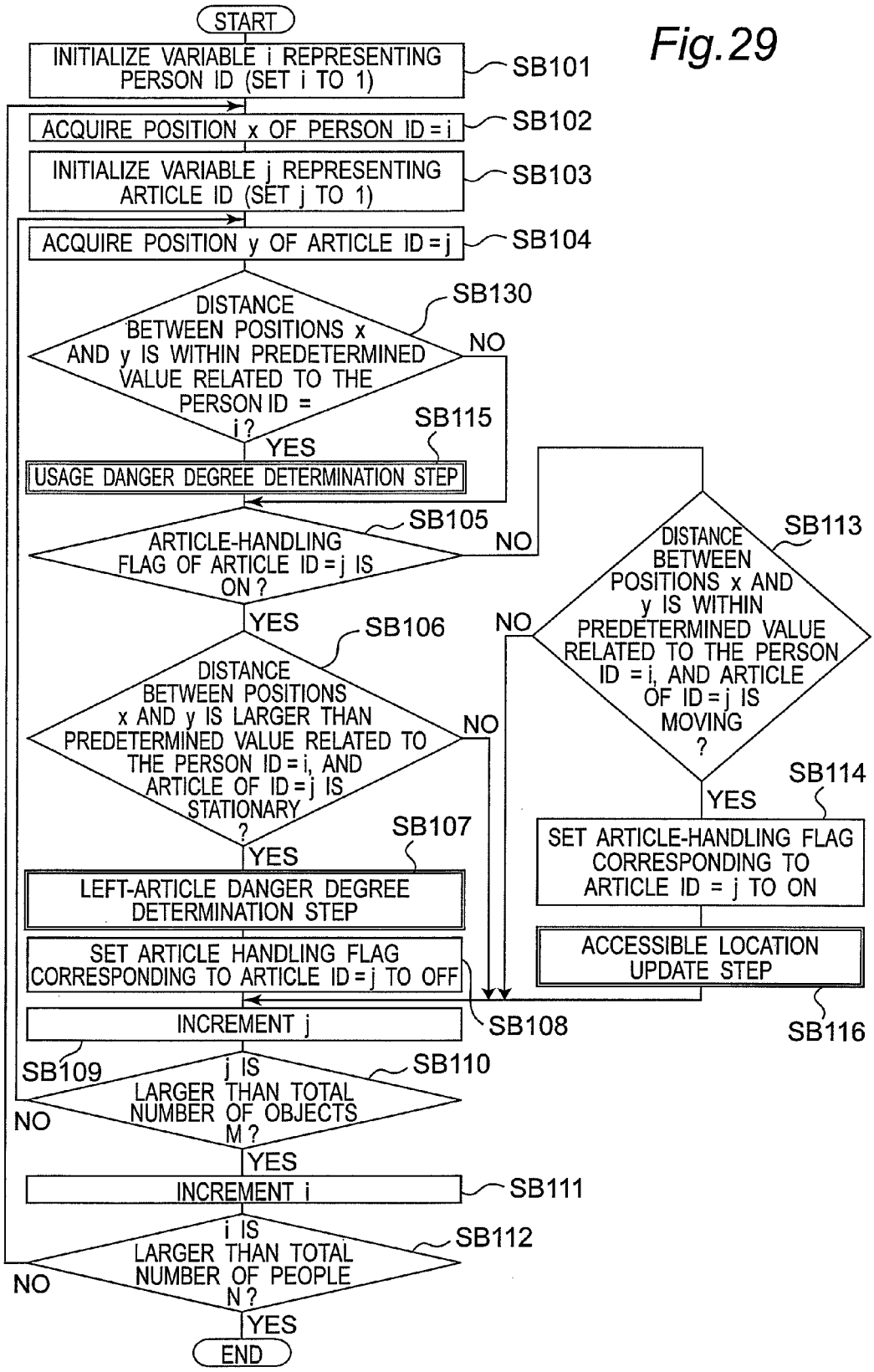
FIG. 29 is a flowchart of an article-leaving-operation determination step according to a modification of the second embodiment of the present invention.

In the second embodiment, the usage danger degree determination step SB115 is executed only when the article handling flag of article ID=j is in the OFF state in the article-leaving-operation determination step shown in FIG. 21. In this case, after the child 1 of person ID=5 acquires a pair of scissors having article ID=0388 (in the dangerous article database 200 of FIG. 10, article having article ID=0388 is not dangerous on the child 1 of person ID=5), the usage danger degree determination step SB115 is not executed on the use of the scissors by the child 2 of person ID=6, and thus notification may not be made to the guardian if the child 1 having person ID=5 hands over the pair of scissors of article ID=0388 to child 2 having person ID=6 without the child 1 having person ID=5 leaving the pair of scissors of article ID=0388. Taking the safety aspect into view, the flowchart of FIG. 29 is used for the article-leaving-operation determination step. In the flowchart of FIG. 29, step SB130 of determining whether the distance between the position x of person ID=i and the position y of article ID=j is within a predetermined value (article handling threshold value) related to person ID=i is determined by the article usage determining means 140 is executed after step SB104.

If determined that the distance between the position x of person ID=i and the position y of article ID=j is within the predetermined value (article handling threshold value) by the article usage determining means 140, the usage danger degree determination step SB115 is executed by the usage danger degree determining means 160. The predetermined value (article handling threshold value) related to the person of person ID=i is obtained from the database of FIG. 7 stored in the article-leaving-operation determining means 120, similar to step SB106. In step SB113 of FIG. 21, whether or not the article of article ID=j is stationary is additionally determined, but if the distance between the position x of person ID=i and the position y of article ID=j is within the predetermined value (article handling threshold value) (if the distance between the article and the person is close) regardless of a situation whether the article is stationary (placed) or moving (actually handled), the usage danger degree determining means 160 is executed to perform the usage danger degree determination operation, so that a safer danger notifying device 401B can be built. If the distance between the position x of person ID=i and the position y of article ID=j is greater than the predetermined value, step SB105 is executed by the article-leaving-operation determining means 120, similar to FIG. 21. The difference with FIG. 21 is only that step SB115 is not provided between step SB114 and step SB116, and thus the description will be omitted. In the flowchart of FIG. 29, step SB120 in the flowchart of FIG. 13 of the first embodiment is omitted, but may be performed between step SB102 and step SB103.

According to the danger determining device 400B of the second embodiment described above, the location where the article accessed by the person in the environment to be watched over is placed before access is acquired from the sensing history database 220, and the content of the accessible location database 210 is constantly updated by the accessible location updating means 150, and thus the determining device 400B and the determining method of the dangerous state capable of responding to the growth of the infant are provided.

Through the use of the danger notifying device 401B and the method using the dangerous state determining device 400B, notification is made when there is a possibility of arising a dangerous state, and thus the danger can be prevented in advance.

One part of the danger determining device or method including the article-leaving-operation determining means etc. excluding various detecting means or devices may be recorded on a recording medium such as CD-ROM as a danger determining program so as to be read from the CD-ROM by the computer and used as necessary. Specifically, in a system (not shown) connected with a display serving as one example of the display device, a keyboard serving as one example of the input device, hard disc, memory, a CD-ROM drive, and the like capable of storing the various databases and various means serving as one example to realize the danger determining device or method, the danger determining program recorded on the CD-ROM is installed in the hard disc through the CD-ROM drive, so that the danger determining device or method can be executed.

By properly combining the arbitrary embodiments of the aforementioned various embodiments, the effects possessed by the embodiments can be produced.

The danger determining device, the danger determining method, the danger notifying device, and the danger determining program according to the present invention provide device, method, and program for determining the risk of an accident by an article of youngsters such as infants and children, and preventing in advance the domestic accident by the article.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The invention claimed is:

1. A danger determining device comprising:

an article detecting means for detecting an ID and position information of an article in an environment to be watched over;

a person detecting means for detecting an ID and position information of a person in the environment to be watched over;

a sensing history database for storing the ID and the position information of the article detected by the article detecting means and the ID and the position information of the person detected by the person detecting means along with respective times;

a dangerous article database for storing dangerous combination information in which an ID of a dangerous article, which is an article having a possibility of posing danger, of the articles in the environment to be watched over, and an ID of a person, who may be present in the environment to be watched over, are associated;

an accessible location database for storing information on accessible locations in the environment to be watched over for every ID of a person who may be present in the environment to be watched over;

an article-leaving-operation determining means for determining that the person has left the article when the position of the article and the position of the person are apart by more than a predetermined distance from the ID, the position information, and the time of the article as well as the ID, the position information, and the time of the person stored in the sensing history database;

a left-article danger degree determining means for performing a first determination of determining whether a combination of the ID of the person in the environment to be watched over and the ID of the article determined as being left by the article-leaving-operation determining means stored in the sensing history database matches the dangerous combination information of the ID of the dangerous article and the ID of the person stored in the dangerous article database; a second determination of determining whether or not the person in the environment to be watched over is capable of accessing the position of the article determined as being left by the article-leaving-operation determining means, from the ID and the position information of the person in the environment to be watched over and the ID and the position information of the article determined as being left by the article-leaving-operation determining means, which are stored in the sensing history database, and the information on the accessible location of the person stored in the accessible location database; and determining that the article determined as being left by the article-leaving-operation determining means poses danger by being left when determined as matching in the first determination and determined as accessible in the second determination in the left-article danger degree determining means; and a notification means for providing a danger notification when the left-article danger degree determining means determines that the left article poses danger.

2. The danger determining device according to claim 1, wherein the left-article danger degree determining means further determines, in the first determination, whether or not, when the ID of the article determined as being left by the article-leaving-operation determining means is the ID of the dangerous article, the person matching the dangerous combination information in combination with the ID of the dangerous article but has the ID of the person related to the dangerous combination information and is not present in the environment to be watched over is detected by the person detecting means; and after it is determined that the person who has the ID of the person related to the dangerous combination information and is not present in the environment to be watched over is detected by the person detecting means, when the person determined as being present in the environment to be watched over is able to access the position of the article determined as being left by the article-leaving-operation determining means in the second determination based on the ID, the position information, and the time of the article as well as the ID and the position information of the person, and the ID and the position information of the article determined as being left by the article-leaving-operation determining means stored in the sensing history database, and the information on the accessible location of the person stored in the accessible location database, the left-article danger degree determining means determines that the article determined as being left by the article-leaving-operation determining means poses danger by being left.

3. The danger determining device according to claim 1, further comprising an accessible location updating means for changing the accessible location stored in the accessible location database to become wider when an article to be determined of danger by combination with the ID of the person and a furnishing other than the article exist in the environment to be watched over, and when the position of the article stored in the accessible location database and determined as being left by the article-leaving-operation determining means and a position of the furnishing are within a predetermined distance.

4. The danger determining device according to claim 1, further comprising:

an article usage determining means for determining that the person is using the article when the position of the article and the position of the person are within a predetermined value from the ID and the position information of the article and the ID and the position information of the person stored in the sensing history database; and an accessible location updating means for changing the accessible location stored in the accessible location database to become wider; wherein the accessible location updating means updates content of the accessible location database to acquire, from the sensing history database, before-use position information of where the article has been placed before use by the person based on the ID of the article when determined that the person is using the article in the environment to be watched over by the article usage determining means, determine whether or not the person is able to access a before-use position related to the before-use position information from the ID and the position information of the person present in the environment to be watched over, the ID and the position information of the article determined as being left by the article-leaving-operation determining means stored in the sensing history database, and the information on the accessible location stored in the accessible location database, and store in the accessible location database, information of being the accessible location with respect to all the before-use position information of the article and the information of the accessible location same as the before-use position of the article or more easily accessible than the before-use position information stored in the accessible location database when it is determined that the before-use position of the article is not the accessible location as not accessible for the person, according to the information of the accessible location stored in the accessible location database.

5. A danger notifying device comprising:

the danger determining device according to claim 1; and a notifying means for issuing an alarm when determined as dangerous by the left-article danger degree determining means.

6. The danger notifying device according to claim 4, further comprising a usage danger degree determining means for determining whether or not current usage state is dangerous from whether or not the ID of the article being used and the ID of the person using the article are dangerous combination information by the information stored in the dangerous article database when determined that the person is using the article in the article usage determining means; wherein the notifying means issues an alarm when determined as dangerous by the usage danger degree determining means.

7. A danger determining method for determining danger using, a sensing history database for storing an ID and position information of an article in an environment to be watched over, and an ID and position information of a person in the environment to be watched over, along with respective times;

a dangerous article database for storing dangerous combination information in which an ID of a dangerous article, which is an article having a possibility of posing danger, of the articles in the environment to be watched over and an ID of a person, who may be present in the environment to be watched over, are associated; and an accessible location database for storing information on accessible locations in the environment to be watched over for every ID of a person who may be present in the environment to be watched over;

the method comprising:

an article-leaving-operation determination step for determining that the person has left the article when the position of the article and the position of the person are apart by more than a predetermined distance from the ID, the position information, and the time of the article as well as the ID, the position information, and the time of the person stored in the sensing history database;

a left-article danger degree determination step for determining whether or not the article determined as being left in the article-leaving-operation determination step has a possibility of posing danger by being left; wherein in the left-article danger degree determination step, is performed a first determination of determining whether a combination of the ID of the person in the environment to be watched over and the ID of the article determined as being left by the article-leaving-operation determination step stored in the sensing history database matches the dangerous combination information of the ID of the dangerous article and the ID of the person stored in the dangerous article database; is performed a second determination of determining whether or not the person in the environment to be watched over is capable of accessing the position of the article determined as being left by the article-leaving-operation determination step from the ID and the position information of the person in the environment to be watched over and the ID and the position information of the article determined as being left by the article-leaving-operation determination step stored in the sensing history database, and information on the accessible location of the person stored in the accessible location database; and is determined that the article determined as being left by the article-leaving-operation determination step poses danger by being left when determined as matching in the first determination and determined as accessible in the second determination in the left-article danger degree determining step; and a notification step of providing a danger notification when the left-article danger degree determining step determines that the left article poses danger.

8. The danger determining method according to claim 7, further comprising:

an article usage determination step for determining that the person is using the article when the position of the article and the position of the person are within a predetermined value from the ID and the position information of the article and the ID and the position information of the person stored in the sensing history database; and an accessible location update step for updating content of the accessible location database;

wherein in the accessible location update step, the content of the accessible location database is updated to acquire, from the sensing history database, before-use position information of where the article has been placed before use by the person based on the ID of the article when determined that the person is using the article in the environment to be watched over by the article usage determination step, determine whether or not the person is able to access a before-use position related to the before-use position information from the ID and the position information of the person present in the environment to be watched over and stored in the sensing history database, and the ID and the position information of the article stored in the sensing history database and determined as being left by the article-leaving-operation determination step, and the information on the accessible location stored in the accessible location database, and store in the accessible location database, information of being the accessible location with respect to all the before-use position information of the article and the information of the accessible location same as the before-use position of the article or more easily accessible than the before-use position information, stored in the accessible location database when it is determined that the before-use position of the article is not the accessible location as not accessible for the person, according to the information of the accessible location stored in the accessible location database.

9. A danger determining program stored on a non-transitory computer-readable storage medium for causing a computer to execute at least:

an article-leaving-operation determination step for determining that a person has left an article when a position of the article and a position of the person are apart by more than a predetermined distance from the ID, position information, and time of the article as well as an ID, position information, and time of the person stored in a sensing history database; and a left-article danger degree determination step for determining whether or not the article determined as being left in the article-leaving-operation determination step has a possibility of posing danger by being left, while using the sensing history database for storing the ID and the position information of the article in an environment to be watched over, and the ID and the position information of the person in the environment to be watched over, along with respective times;

a dangerous article database for storing dangerous combination information in which an ID of a dangerous article, which is an article having a possibility of posing danger, of the articles in the environment to be watched over and an ID of a person, who may be present in the environment to be watched over, are associated;

an accessible location database for storing information on accessible locations in the environment to be watched over for every ID of persons who may be present in the environment to be watched over, wherein in the left-article danger degree determination step, is performed a first determination of determining whether a combination of the ID of the person in the environment to be watched over and the ID of the article determined as being left by the article-leaving-operation determination step stored in the sensing history database matches the dangerous combination information of the ID of the dangerous article and the ID of the person stored in the dangerous article database; is performed a second determination of determining whether or not the person in the environment to be watched over is capable of accessing the position of the article determined as being left by the article-leaving-operation determination step from the ID and the position information of the person in the environment to be watched over and the ID and the position information of the article determined as being left by the article-leaving-operation determination step stored in the sensing history database, and information on the accessible location of the person stored in the accessible location database; and is determined that the article determined as being left by the article-leaving-operation determination step poses danger by being left when determined as matching in the first determination and determined as accessible in the second determination in the left-article danger degree determining step; and a notification step of providing a danger notification when the left-article danger degree determining step determines that the left article poses danger.

10. The danger determining program according to claim 9, further causing the computer to execute:

an article usage determination step for determining that the person is using the article when the position of the article and the position of the person are within a predetermined value from the ID and the position information of the article and the ID and the position information of the person stored in the sensing history database; and an accessible location update step for updating content of the accessible location database;

wherein in the accessible location update step, the content of the accessible location database is updated to acquire, from the sensing history database, before-use position information of where the article has been placed before use by the person based on the ID of the article when determined that the person is using the article in the environment to be watched over by the article usage determination step, determine whether or not the person is able to access a before-use position related to the before-use position information from the ID and the position information of the person present in the environment to be watched over and stored in the sensing history database, and the ID and the position information of the article stored in the sensing history database and determined as being left by the article-leaving-operation determination step, and the information on the accessible location stored in the accessible location database, and store in the accessible location database, information of being the accessible location with respect to all the before-use position information of the article and the information of the accessible location same as the before-use position of the article or more easily accessible than the before-use position information, stored in the accessible location database when it is determined that the before-use position of the article is not the accessible location as not accessible for the person, according to the information of the accessible location stored in the accessible location database.

* * * * *